US010032379B1

(12) United States Patent
Chambers et al.

(10) Patent No.: US 10,032,379 B1
(45) Date of Patent: Jul. 24, 2018

(54) TRAFFIC CIRCLE WARNING SYSTEM AND METHOD

(71) Applicant: Nissan North America, Inc., Franklin, TN (US)

(72) Inventors: Jeremy Chambers, Casco, MI (US); Roy Goudy, Farmington Hills, MI (US); Neal Probert, Farmington Hills, MI (US)

(73) Assignee: Nissan North America, Inc., Franklin, TN (US)

( * ) Notice: Subject to any disclaimer, the term of this patent is extended or adjusted under 35 U.S.C. 154(b) by 0 days.

(21) Appl. No.: 15/477,947

(22) Filed: Apr. 3, 2017

(51) Int. Cl.
*G08G 1/00* (2006.01)
*G08G 1/16* (2006.01)
*G08G 1/01* (2006.01)

(52) U.S. Cl.
CPC ..... *G08G 1/164* (2013.01); *G08G 1/0145* (2013.01); *G08G 1/166* (2013.01)

(58) Field of Classification Search
CPC ..... G08G 1/164; G08G 1/0145; G08G 1/166
USPC ..... 340/435, 502, 901, 907, 933, 936; 701/117
See application file for complete search history.

(56) References Cited

U.S. PATENT DOCUMENTS 6,151,552 A * 11/2000 Koizumi ..... G01C 21/3629 340/988
2004/0227647 A1* 11/2004 Yanai ..... B60R 1/00 340/995.1
2013/0184930 A1* 7/2013 Fuehrer ..... G06F 17/00 701/32.3

* cited by examiner

*Primary Examiner* — Daryl Pope

(57) ABSTRACT

A traffic circle warning system and method employ a controller. The controller is configured to determine whether a traffic circle exists along a current travel path of the host vehicle based on remote vehicle information representing a travel condition of at least one remote vehicle. The controller is further configured to, upon determining that the traffic circle exists, evaluate a travel condition of the host vehicle relative to the traffic circle and the travel condition of the remote vehicle to determine whether to control a warning system onboard the host vehicle to issue a warning.

20 Claims, 35 Drawing Sheets

TRAFFIC CIRCLE WARNING SYSTEM AND METHOD

CROSS-REFERENCE TO RELATED APPLICATIONS

Related subject matter is disclosed in U.S. patent application Ser. No. 15/477,827, entitled "Traffic Circle Identification System and Method,", filed concurrently herewith. The entirety of the "Detailed Description of the Embodiments," and the entirety of all of the Figures, of U.S. patent application Ser. No. 15/477,827 entitled "Traffic Circle Identification System and Method," is incorporated by reference herein.

BACKGROUND OF THE INVENTION

Field of the Invention

The present invention generally relates to a traffic circle warning system and method. More specifically, the present invention relates to an on-board vehicle system and method for evaluating travel conditions of a host vehicle and a remote vehicle relative to a traffic circle to determine whether to control a warning system onboard the host vehicle to issue a warning.

Background Information

Vehicles having a navigation system typically acquire and store road map data that the navigation system uses to generate a map display. A map display typically includes images representing the roads within a designated area of the vehicle, as well as other images such as landmarks, fueling station locations, restaurants, weather data, traffic information and so on.

Traffic circles are becoming more common, especially to avoid the use of traffic signals in highly traveled areas. As drivers understand, traffic circles are different to navigate than typical intersections. Therefore, it can be beneficial for a driver to be informed of the presence of an upcoming traffic circle in advance, and whether there should be any concern for other vehicles that are in or approaching the traffic circle. Map data is currently the most common way of detecting the presence of a traffic circle in a vehicle's path.

SUMMARY OF THE INVENTION

Although map data can be used to identify traffic circles, it is possible that a vehicle may be unable to acquire accurate map data in certain locations. For example, map data may not take into account recently constructed traffic circles if the map data is out of date. Therefore, a need exists for an improved traffic circle warning system for identifying a traffic circle, especially along a current travel path of a host vehicle, and determining whether to issue a warning to the driver of the host vehicle based on the location and movement of any other vehicle in or near the traffic circle.

In accordance with one aspect of the present invention, a traffic circle warning system and method are provided which employ a controller. The controller is configured to determine whether a traffic circle exists along a current travel path of the host vehicle based on remote vehicle information representing a travel condition of at least one remote vehicle. The controller is further configured to, upon determining that the traffic circle exists, evaluate a travel condition of the host vehicle relative to the traffic circle and the travel condition of the remote vehicle to determine whether to control a warning system onboard the host vehicle to issue a warning.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
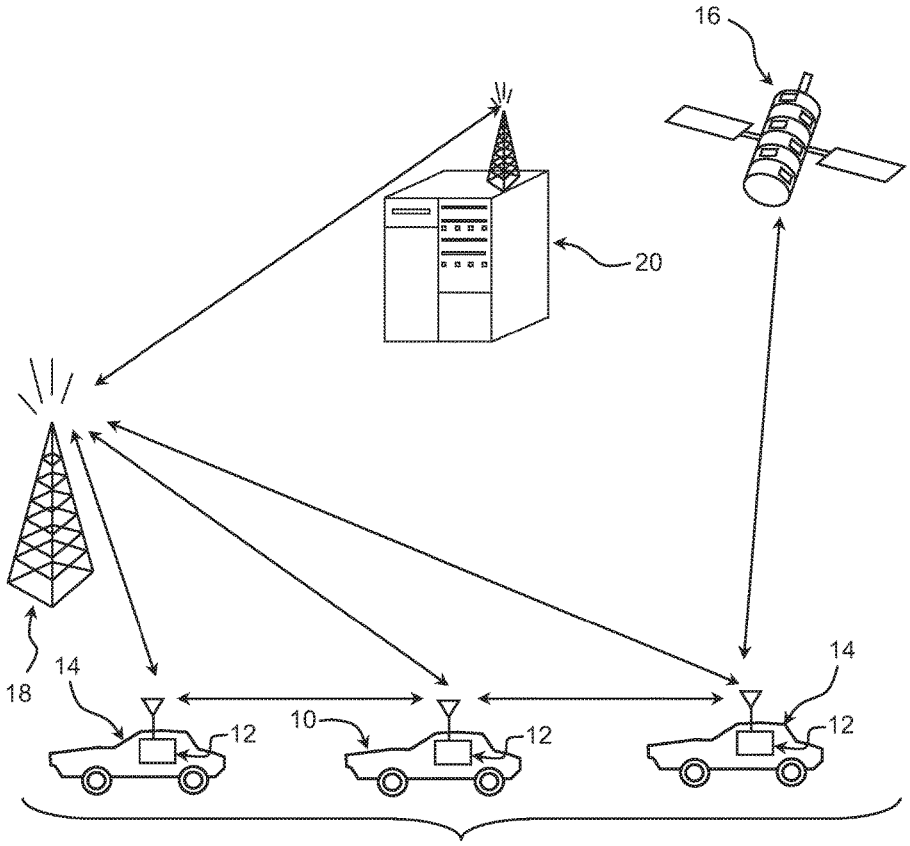
FIG. 1 is a schematic diagram illustrating an example of a host vehicle equipped with a traffic circle warning system according to embodiments disclosed herein, in relation to remote vehicles and components of a global positioning system (GPS) and a communication system.

Referring initially to FIG. 1, a two-way wireless communications network is illustrated that includes vehicle to vehicle communication and vehicle to base station communication. In FIG. 1, a host vehicle (HV) 10 is illustrated that is equipped with a traffic circle warning system 12 according to a disclosed embodiment, and two remote vehicles (RV) 14 that also includes the traffic circle warning system 12. As discussed herein, the host vehicle 10 can also be referred to as a subject vehicle (SV). The remote vehicle 14 can also be referred to as a target or threat vehicle (TV). While the host vehicle (HV) 10 and the remote vehicles 14 are illustrated as having the same traffic circle warning system 12, it will be apparent from this disclosure that each of the remote vehicles 14 can include another type of two-way communication system that is capable of communicating remote vehicle information representing a travel condition of the remote vehicle 14 to the host vehicle 10. The remote vehicle information can include, for example, information representing the location (e.g., GPS location), speed, acceleration and heading of the remote vehicle 14 at each of a plurality of locations of the remote vehicle 14, information representing a respective turning radius of the remote vehicle 14 at each of the plurality of locations of the remote vehicle 14, turn signal activation at the remote vehicle 14 at each of the plurality of locations, and any other type of information suitable for representing a travel path of the remote vehicle 14. Likewise, the host vehicle 10 can also exchange host vehicle information with each of the remote vehicles 14. This host vehicle information can include, for example, information representing the location (e.g., GPS location), speed, acceleration and heading of the host vehicle 10 at each of a plurality of locations of the host vehicle 10, information representing a respective turning radius of the host vehicle 10 at each of the plurality of locations of the host vehicle 10, turn signal activation at the host vehicle 10 at each of the plurality of locations, and any other type of information suitable for representing a travel path of the host vehicle 10. The host vehicle 10 and the remote vehicles 14 can exchange this type of host vehicle information and remote vehicle information with each other several times per second, or at any suitable time intervals.

The traffic circle warning system 12 of the host vehicle 10 and the remote vehicle 14 communicates with the two-way wireless communications network. As seen in FIG. 1, for example, the two-way wireless communications network can include one or more global positioning satellites 16 (only one shown), and one or more roadside (terrestrial) units 18 (only one shown), and a base station or external server 20. The global positioning satellites 16 and the roadside units 18 send and receive signals to and from the traffic circle warning system 12 of the host vehicle 10 and the remote vehicles 14. The base station 20 sends and receives signals to and from the traffic circle warning system 12 of the host vehicle 10 and the remote vehicles 14 via a network of the roadside units 18, or any other suitable two-way wireless communications network.

Figure 2:
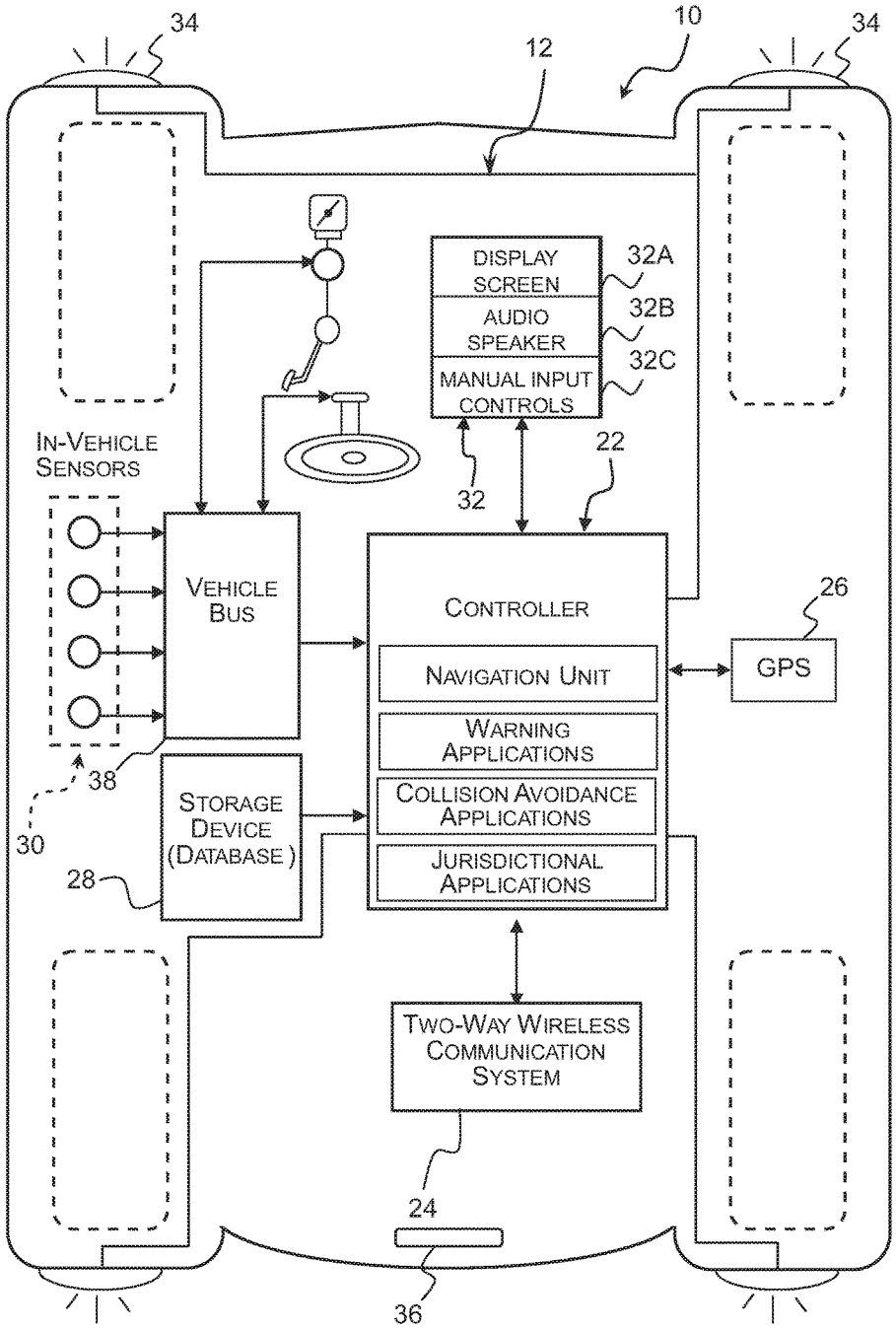
FIG. 2 is a block diagram of exemplary components of the host vehicle equipped with a traffic circle warning system according to embodiments disclosed herein.

As shown in more detail in FIG. 2, the traffic circle warning system 12 includes an application controller 22 that can be referred to simply as a controller 22. The controller 22 preferably includes a microcomputer with a control program that controls the components of the traffic circle warning system 12 as discussed below. The controller 22 includes other conventional components such as an input interface circuit, an output interface circuit, and storage devices such as a ROM (Read Only Memory) device and a RAM (Random Access Memory) device. The microcomputer of the controller 22 is at least programmed to control the traffic circle warning system 12 in accordance with the flow chart of FIG. 8 as discussed below. It will be apparent to those skilled in the art from this disclosure that the precise structure and algorithms for the controller 22 can be any combination of hardware and software that will carry out the functions of the present invention. Furthermore, the controller 22 can communicate with the other components of the traffic circle warning system 12 discussed herein via, for example a controller area network (CAN) bus or in any other suitable manner as understood in the art.

As shown in more detail in FIG. 2, the traffic circle warning system 12 can further include a wireless communication system 24, a global positioning system (GPS) 26, a storage device 28, a plurality of in-vehicle sensors 30 and a human-machine interface unit 32. The wireless communication system 24 can include, for example, a transmitter, a receiver, a transceiver, and any other suitable type of equipment as understood in the art. The human-machine interface unit 32 includes a screen display 32A, an audio speaker 32B and various manual input controls 32C that are operatively coupled to the controller 22. The screen display 32A and the audio speaker 32B are examples of interior warning devices of a warning system that are used to alert a driver. Of course, it will be apparent to those skilled in the art from this disclosure that interior warning devices include anyone of or a combination of visual, audio and/or tactile warnings as understood in the art that can be perceived inside the host vehicle 10. The host vehicle 10 also includes a pair of front headlights 34 and rear brake lights 36, which constitutes examples of exterior warning devices of the traffic circle warning system 12. These components can communicate with each other and, in particular, with the controller 22 in any suitable manner, such as wirelessly or via a vehicle bus 38.

The wireless communications system 24 can include an omni-directional antenna and a multi-directional antenna, as well as communication interface circuitry that connects and exchanges information with a plurality of the remote vehicles 14 that are similarly equipped, as well as with the roadside units 20 through at least a portion of the wireless communications network within the broadcast range of the host vehicle 10. For example, the wireless communications system 24 can be configured and arranged to conduct direct two way communications between the host and remote vehicles 10 and 14 (vehicle-to-vehicle communications) and the roadside units 18 (roadside-to-vehicle communications). Moreover, the wireless communications system 24 can be configured to periodically broadcast a signal in the broadcast area. The wireless communication system 24 can be any suitable type of two-way communication device that is capable of communicating with the remote vehicles 14 and the two-way wireless communications network. In this example, the wireless communication system 24 can include or be coupled to a dedicated short range communications (DSRC) antenna to receive, for example, 5.9 GHz DSRC signals from the two-way wireless communications network. These DSRC signals can include basic safety messages (BSM) defined by current industry recognized standards that include information which, under certain circumstances, can be analyzed to warn drivers of a potential problem situation or threat in time for the driver of the host vehicle 10 to take appropriate action to avoid the situation. For instance, the DSRC signals can also include information pertaining to weather conditions, adverse driving conditions and so on. In the disclosed embodiments, a BSM includes information in accordance with SAE Standard J2735 as can be appreciated by one skilled in the art. Also, the wireless communication system 24 and the GPS 26 can be configured as a dual frequency DSRC and GPS devices as understood in the art.

The GPS 26 can be a conventional global positioning system that is configured and arranged to receive global positioning information of the host vehicle 10 in a conventional manner. Basically, the global positioning system 26 receives GPS signals from the global positioning satellite 16 at regular intervals (e.g. one second) to detect the present position of the host vehicle 10. The GPS 26 has an accuracy in accordance with industry standards and thus, can indicate the actual vehicle position of the host vehicle 10 within a few meters or less (e.g., 10 meters less). The data representing the present position of the host vehicle 10 is provided to the controller 22 for processing as discussed herein. For example, the controller 22 can include or be coupled to navigation system components that are configured and arranged to process the GPS information in a conventional manner as understood in the art.

The storage device 28 can store the remote vehicle information as discussed above. The storage device 28 can also store road map data, as well as other data that can be associated with the road map data such as various landmark data, fueling station locations, restaurants, weather data, traffic information and so on. Furthermore, the storage device 28 can store other types of data, such as data pertaining to vehicle-related parameters and vehicle conditions. For example, the vehicle-related parameters can include predetermined data indicating relationships between vehicle speed, vehicle acceleration, yaw, steering angle, etc. when a vehicle is preparing to make a turn. In this event, the storage device 28 can further store data pertaining to vehicle conditions, which can represent a determined vehicle condition of a vehicle of interest, such as the host vehicle 10, a remote vehicle 14, or both. This determined vehicle condition can represent, for example, a vehicle speed and acceleration that is determined for the vehicle of interest at a moment in time. Accordingly, the embodiments disclosed herein can evaluate whether the vehicle condition lies within the area of interest, as represented by the vehicle-related parameters, to determine, for example, whether the vehicle of interest is preparing to make a turn. The storage device 28 can include, for example, a large-capacity storage medium such as a CD-ROM (Compact Disk-Read Only Memory) or IC (Integrated Circuit) card. The storage device 28 permits a read-out operation of reading out data held in the large-capacity storage medium in response to an instruction from the controller 22 to, for example, acquire the map information and/or the vehicle condition information as needed or desired for use in representing the location of the host vehicle 10, the remote vehicle 14 and other location information and/or vehicle condition information as discussed herein for route guiding, map display, turning indication, and so on as understood in the art. For instance, the map information can include at least road links indicating connecting states of nodes, locations of branch points (road nodes), names of roads branching from the branch points, place names of the branch destinations, and so on. The information in the storage device 28 can also be updated by the controller 22 or in any suitable manner as discussed herein and as understood in the art.

The in-vehicle sensors 30 are configured to monitor various devices, mechanisms and systems within the host vehicle 10 and provide information relating to the status of those devices, mechanisms and systems to the controller 22. For example, the in-vehicle sensors 30 can be connected to a traction control system, a windshield wiper motor or wiper motor controller, a headlight controller, a steering system, a speedometer, a braking system and so on as understood in the art.

Examples of operations performed by the traffic circle warning system 12 will now be discussed with reference to FIGS. 3 to 45. As can be appreciated from the following description, because the host vehicle 10 and the remote vehicles 14 are equipped with vehicle to vehicle communication technology as discussed above, the host vehicle 10 can use the remote vehicle information received from other similarly equipped remote vehicles 14 to determine the presence and size of a traffic circle without need for map data, which can provide a significant cost savings. Also, in view of pending NHTSA regulations that would require vehicle to vehicle communication technology in new vehicles in the future, the traffic circle warning system 12 according to the disclosed embodiments can significantly enhance the functionality of crash warning systems that leverage information received via vehicle to vehicle communication from other vehicles to either suppress warnings that are not necessary, or issue warnings under circumstances that other sensor-based systems could not detect. For instance, by using GPS position and heading information received from remote vehicles 14, the traffic circle warning system 12 according to the disclosed embodiments provides an accurate identification of the presence and size of an approaching traffic circle. This information can be used to suppress unnecessary warnings that could otherwise be a nuisance. The traffic circle warning system 12 also provides a very rapid detection of wrong-way driving of a remote vehicle 14, as well as the host vehicle 10, that may be travelling in the wrong direction around the traffic circle. The traffic circle warning system 12 can also be beneficial with regard to compliance with Federal Motor Vehicle Safety Standards (FMVSS) and New Car Assessment Program (NCAP) requirements.

Figure 3:
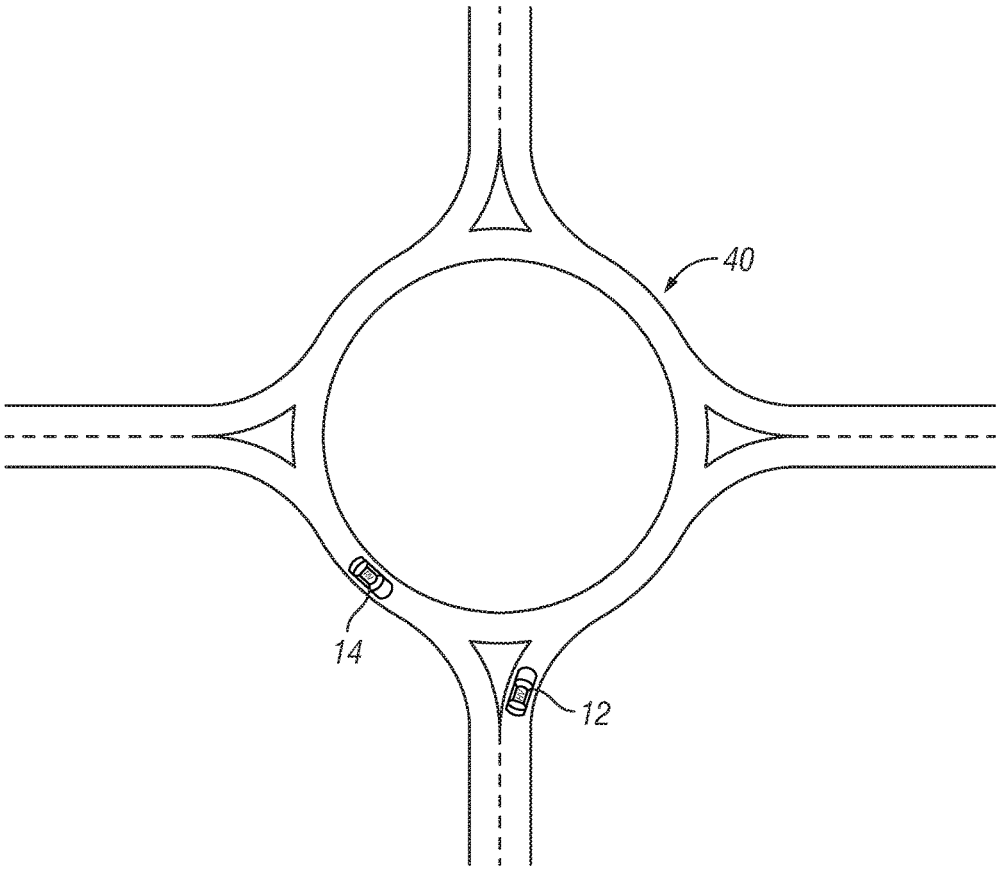
FIG. 3 is a diagrammatic view illustrating an example of a condition in which a remote vehicle is in the traffic circle and is about to cross the path of the host vehicle which is entering the traffic circle.

As can be appreciated from FIGS. 3 through 10, unlike a traditional intersection where threat of contact with another vehicle can occur from all directions, only two scenarios exist in a traffic circle where a contact may occur. One condition is when the host vehicle 10 is approaching the traffic circle 40, and another is when the host vehicle 10 is in the traffic circle 40. When the host vehicle 10 is approaching the traffic circle 10, the threat of contact with a remote vehicle 14 only exists when a remote vehicle 14 in the traffic circle 40 is about the cross the path of the host vehicle 10 as shown, for example, in FIG. 3. That is, FIG. 3 is a diagrammatic view illustrating an example of a condition in which a remote vehicle 14 is in the traffic circle and is about to cross the path of the host vehicle 10 which is entering the traffic circle 40.

Figure 4:
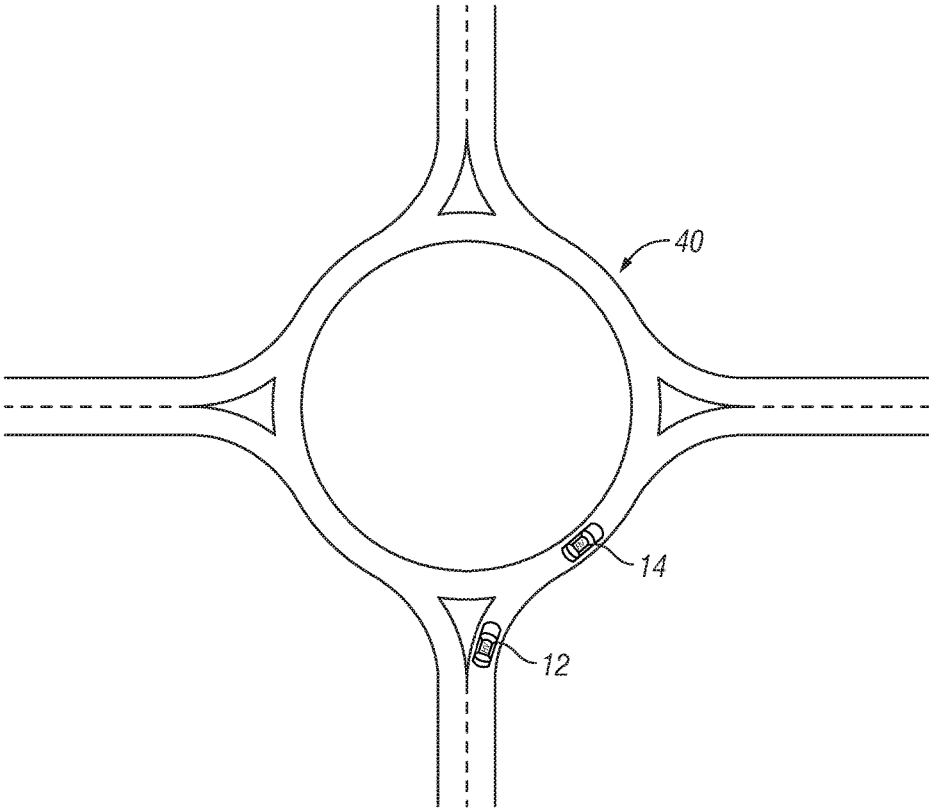
FIG. 4 is a diagrammatic view illustrating an example of a condition in which a remote vehicle is in the traffic circle and is ahead of the host vehicle after crossing the path of the host vehicle.
Figure 5:
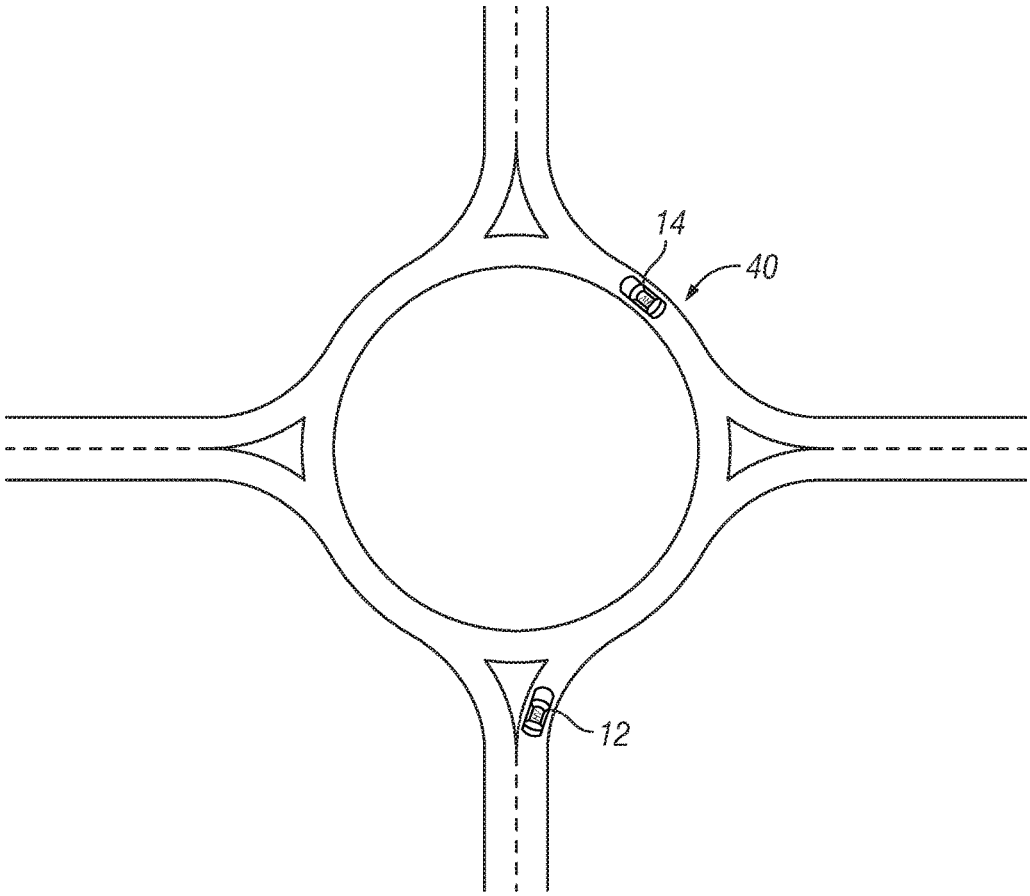
FIG. 5 is a diagrammatic view illustrating an example of a condition in which a remote vehicle is in the traffic circle on the opposite side of the traffic circle from the host vehicle and diverging from the host vehicle.
Figure 6:
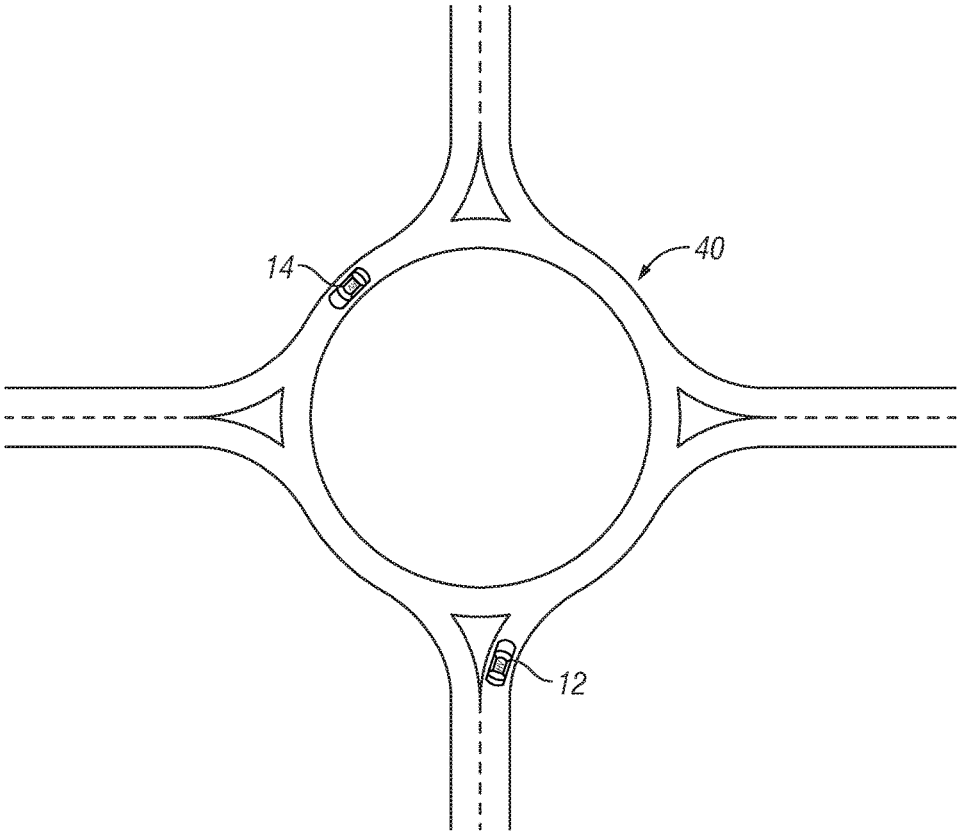
FIG. 6 is a diagrammatic view illustrating an example of a condition in which a remote vehicle is in the traffic circle on the opposite side of the traffic circle from the host vehicle and converging with the host vehicle.

However, under the other instances shown in FIGS. 4 through 6, the likelihood of the host vehicle 10 and the remote vehicle 14 contacting each other is extremely remote. For example, FIG. 4 is a diagrammatic view illustrating an example of a condition in which a remote vehicle 14 is in the traffic circle 40 and is ahead of the host vehicle 10 after crossing the path of the host vehicle 10. FIG. 5 is a diagrammatic view illustrating an example of a condition in which a remote vehicle 14 is in the traffic circle 40 on the opposite side of the traffic circle 40 from the host vehicle 10 and diverging from the host vehicle 10. FIG. 6 is a diagrammatic view illustrating an example of a condition in which a remote vehicle 14 is in the traffic circle 40 on the opposite side of the traffic circle 40 from the host vehicle 10 and converging with the host vehicle 10.

Figure 7:
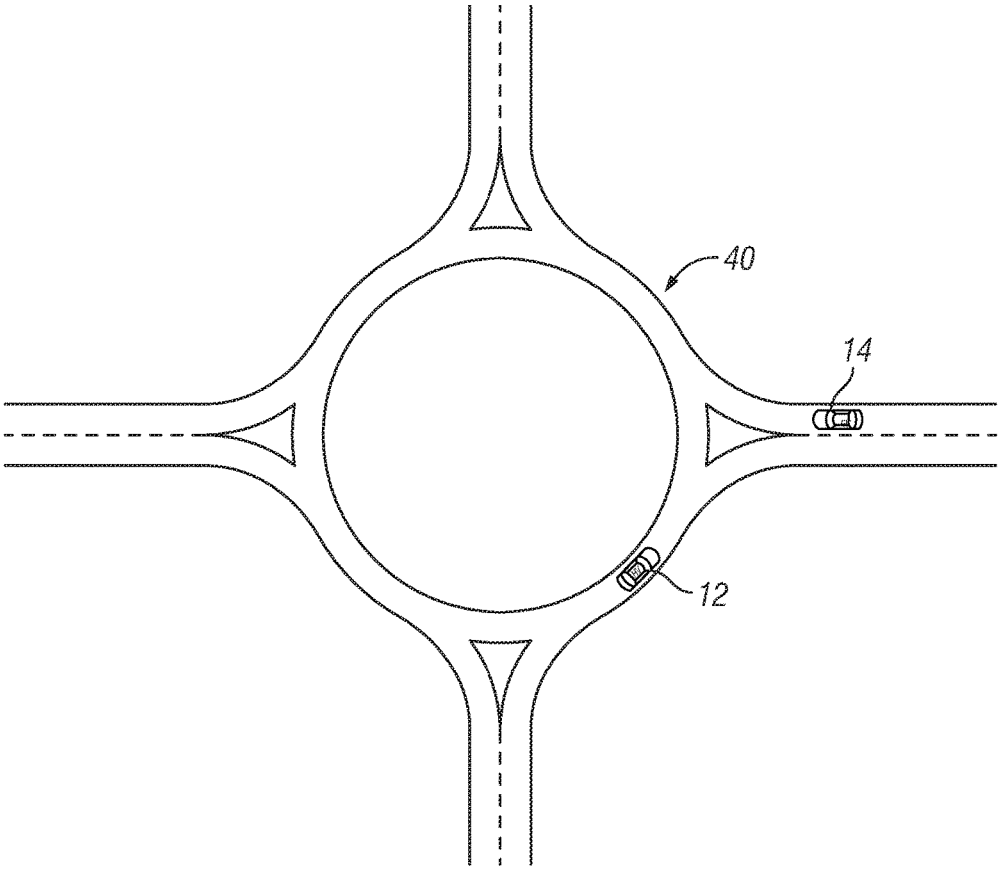
FIG. 7 is a diagrammatic view illustrating an example of a condition in which the host vehicle is in the traffic circle and the remote vehicle is approaching the traffic circle and is about to cross the path of the host vehicle.
Figure 8:
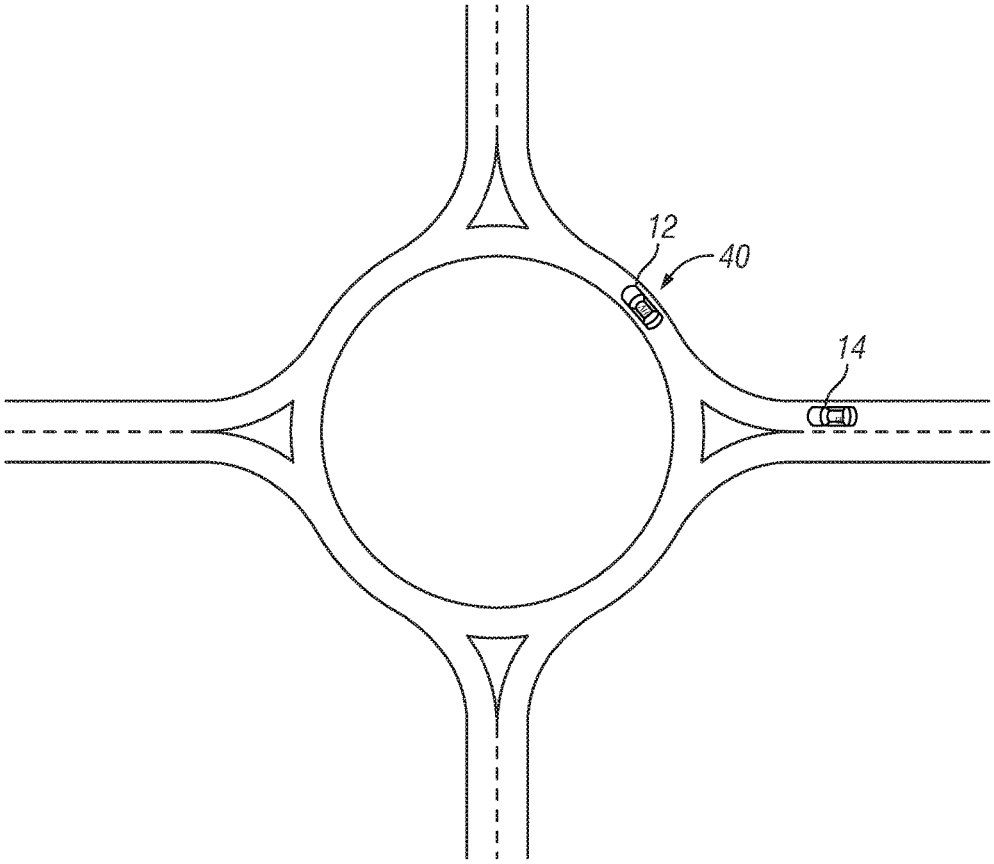
FIG. 8 is a diagrammatic view illustrating an example of a condition in which the host vehicle is in the traffic circle and is ahead of the remote vehicle after crossing the path of the remote vehicle.
Figure 9:
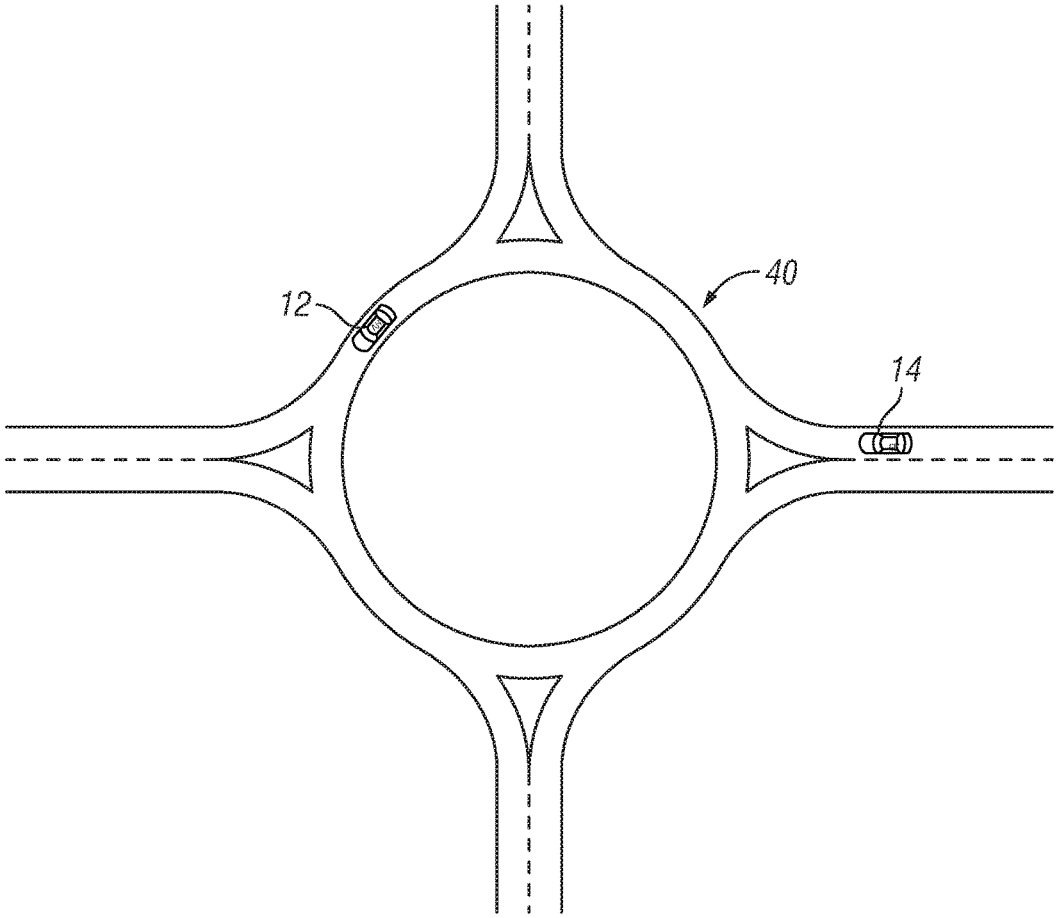
FIG. 9 is a diagrammatic view illustrating an example of a condition in which the host vehicle is in the traffic circle on the opposite side of the traffic circle from the remote vehicle and diverging from the remote vehicle.
Figure 10:
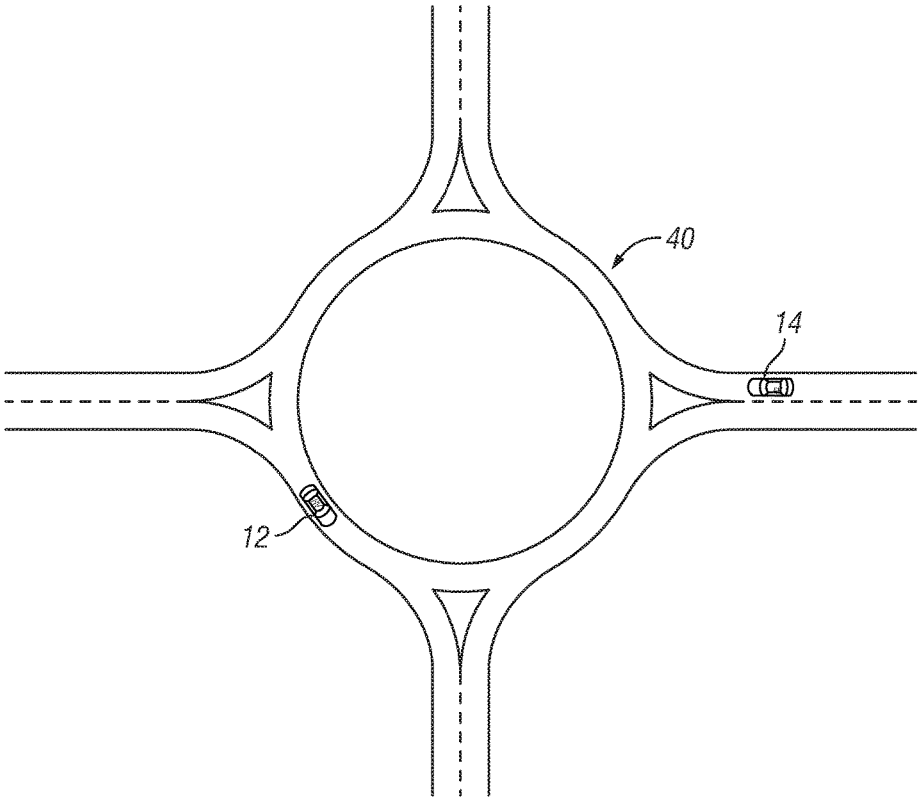
FIG. 10 is a diagrammatic view illustrating an example of a condition in which the host vehicle is in the traffic circle on the opposite side of the traffic circle 40 from the remote vehicle and converging with the remote vehicle.

However, FIG. 7 is a diagrammatic view illustrating an example of a condition in which the host vehicle 10 is in the traffic circle 40 and the remote vehicle 14 is approaching the traffic circle 40 and is about to cross the path of the host vehicle 10. Thus, a threat of contact between the host vehicle 10 and the remote vehicle 14 exists. In all other instances shown in FIGS. 8 through 10, the likelihood of contact between the host vehicle 10 and the remote vehicle 14 is extremely remote. For example, in FIG. 8 is a diagrammatic view illustrating an example of a condition in which the host vehicle 10 is in the traffic circle 40 and is ahead of the remote vehicle 14 after crossing the path of the remote vehicle 14. FIG. 9 is a diagrammatic view illustrating an example of a condition in which the host vehicle 10 is in the traffic circle 40 on the opposite side of the traffic circle 40 from the remote vehicle 14 and diverging from the remote vehicle 14. FIG. 10 is a diagrammatic view illustrating an example of a condition in which the host vehicle 10 is in the traffic circle 40 on the opposite side of the traffic circle 40 from the remote vehicle 14 and converging with the remote vehicle 14.

Figure 11:
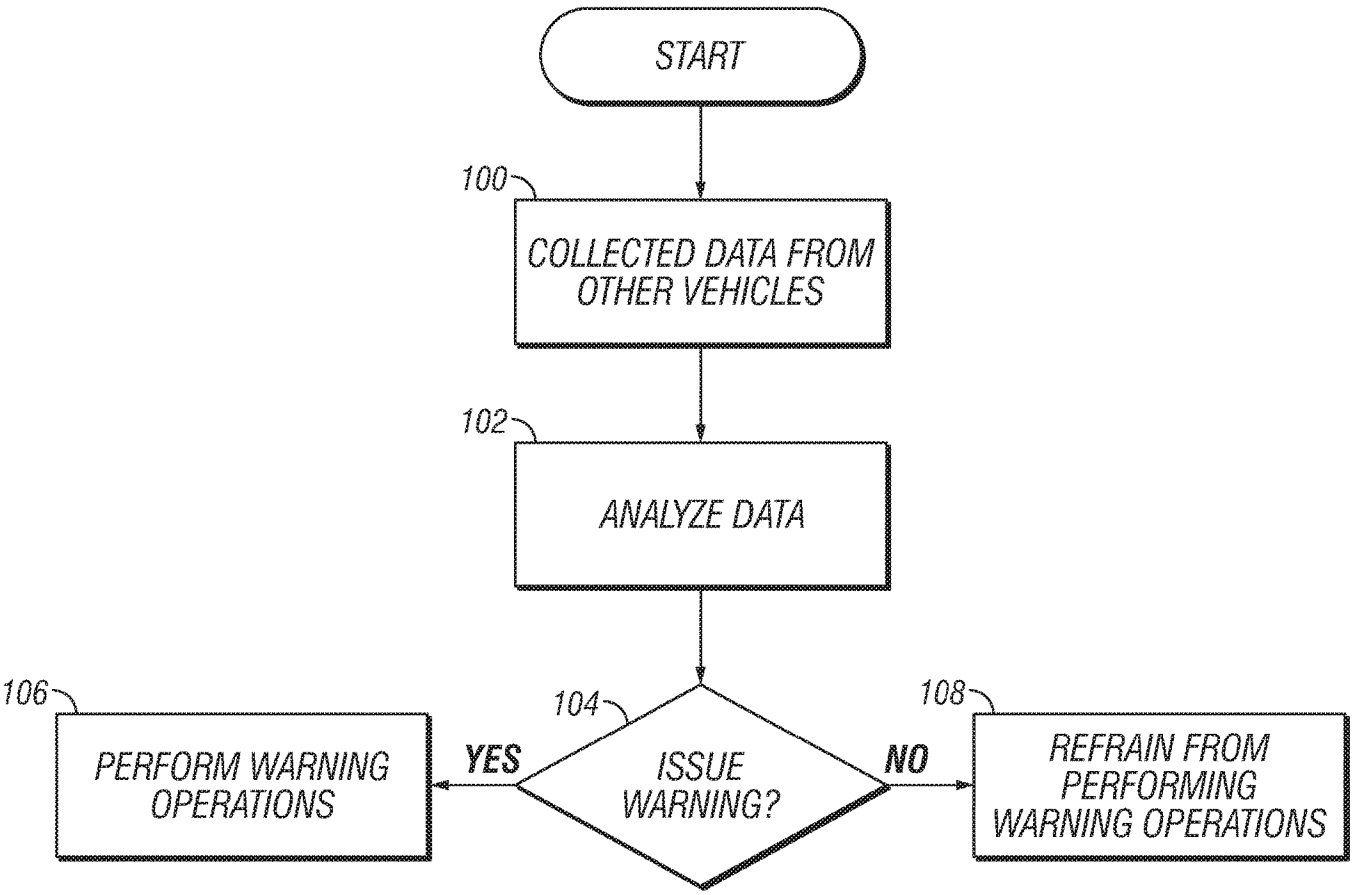
FIG. 11 is a flowchart illustrating an example of operations performed by the traffic circle warning system to determine whether a warning should be issued due to the location of the host vehicle and at least one remote vehicle with respect to the traffic circle.

FIG. 11 is a flowchart illustrating an example of operations performed by the traffic circle warning system 12 to determine whether a warning should be issued due to the location of the host vehicle 10 and at least one remote vehicle 14 with respect to the traffic circle 40. In Step 100, the traffic circle warning system 12 receives remote vehicle information from at least one remote vehicle 14. As discussed above, the remote vehicle information can include, for example, information representing the location (e.g., GPS location), speed, acceleration and heading of the remote vehicle 14 at each of a plurality of locations of the remote vehicle 14, information representing a respective turning radius of the remote vehicle 14 at each of the plurality of locations of the remote vehicle 14, turn signal activation at the remote vehicle 14 at each of the plurality of locations, and any other type of information suitable for representing a travel path of the remote vehicle 14. As also discussed above, the host vehicle 10 can exchange host vehicle information with the remote vehicle 14. This host vehicle information can include, for example, information representing the location (e.g., GPS location), speed, acceleration and heading of the host vehicle 10 at each of a plurality of locations of the host vehicle 10, information representing a respective turning radius of the host vehicle 10 at each of the plurality of locations of the host vehicle 10, turn signal activation at the host vehicle 10 at each of the plurality of locations, and any other type of information suitable for representing a travel path of the host vehicle 10. The host vehicle 10 and the remote vehicles 14 can exchange this type of host vehicle information and remote vehicle information with each other several times per second, or at any suitable time intervals.

In Step 102, the traffic circle warning system 12 can analyze the remote vehicle information to determine whether the traffic circle 40 exists, the diameter of the traffic circle 40, and the location of any remote vehicle 14 with respect to the host vehicle 10 and the traffic circle 40, without using or relying upon map data. For example, the traffic circle warning system 12 onboard the host vehicle 10 stores GPS position heading and speed information in the remote vehicle information received from the remote vehicle 14. The software being run by the controller 22 can include, for example, a software application onboard the host vehicle 12 to use this remote vehicle information to calculate the location of the remote vehicle 14 in relation to the host vehicle 10 and the traffic circle 40 as will now be described. For purposes of the description below, the host vehicle 10 is represented by "HV" and the remote vehicle 14 is represented by "RV" in the following equations, tables and graphs.

The controller 22 can define a series of mathematical expressions that provide specific information regarding the longitudinal, lateral, elevation and heading of a remote vehicle 14 relative to the host vehicle 10. These equations are used to determine the position of the remote vehicle 14 relative to the host vehicle 10 in order to determine if a threat condition exists.

The following exemplary equation is used to determine the longitudinal and lateral position of a remote vehicle 14 relative to the host vehicle 10. Using the coordinates of North, South, East and West with the host vehicle 10 being at the center purposes of these examples and equations, the processing performed by the controller 22 can divide the area surrounding the host vehicle 10 into quadrants Q1, Q2, Q3 and Q4 as will now be described. By performing these operations, the controller 22 is effectively identifying sections of the traffic circle 40 since depending upon the location of the host vehicle 10, at least some of the quadrants Q1, Q2, Q3 and Q4 can overlap with at least a portion of the traffic circle 40.

Figure 12:
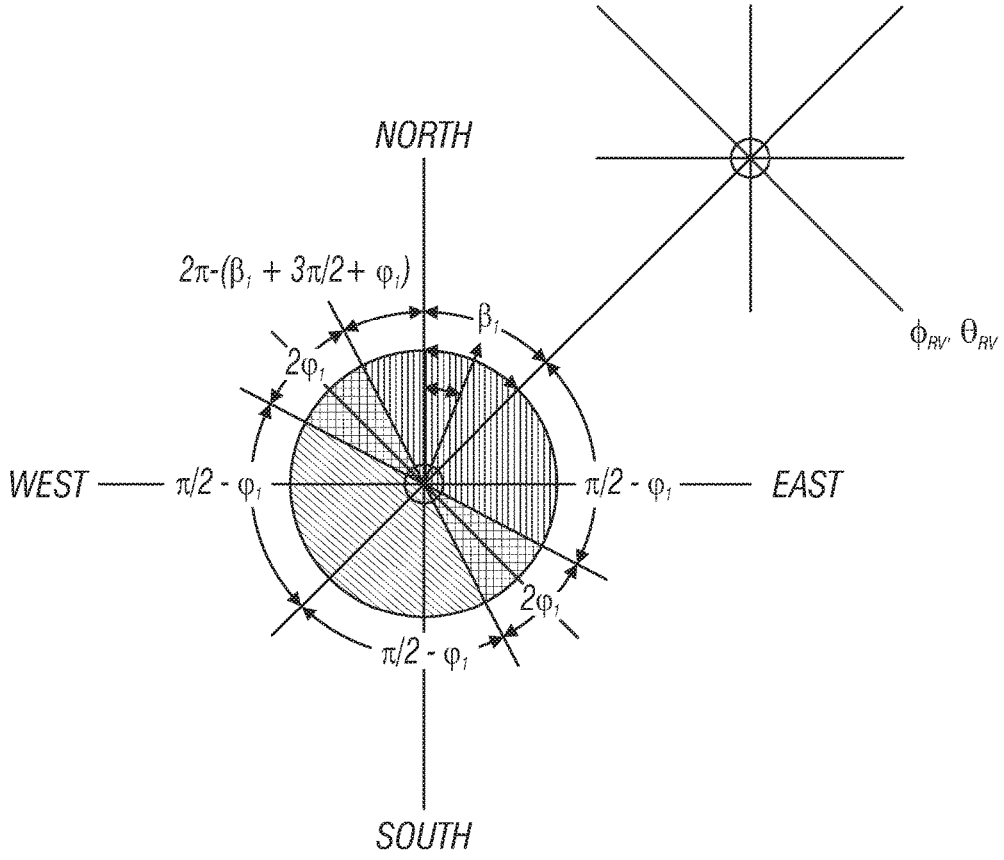
FIGS. 12-19 are graphical representations of a location of the host vehicle with respect to a remote vehicle as used in calculations performed by the traffic circle warning system during the operation of the flowchart of FIG. 11.
Figure 13:
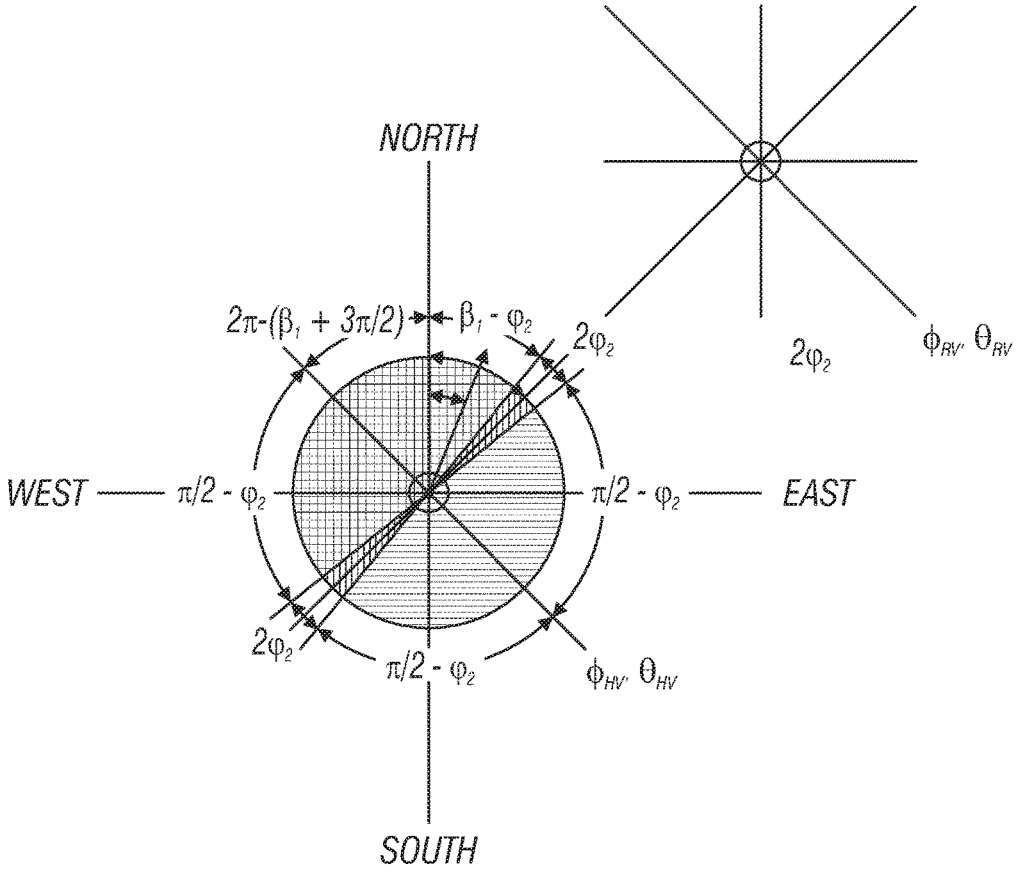

FIGS. 12 and 13 illustrate a condition in which the remote vehicle 14 is to the Northeast of the host vehicle 10, and thus is in quadrant Q1.

Q1: Remote Vehicle 14 is to the Northeast of the Host Vehicle 10

$$Q_1 = \frac{1}{4}\left[\frac{\phi_{RV} - \phi_{HV} - \sigma}{|\phi_{RV} - \phi_{HV}| + \sigma} + 1\right] \times \left[\frac{\theta_{RV} - \theta_{HV} + \sigma}{|\theta_{RV} - \theta_{HV}| + \sigma} + 1\right]$$

If the remote vehicle 14 is northeast of the host vehicle 10 as shown in FIGS. 12 and 13, both latitude and longitude for the remote vehicle 14 is greater than the latitude and longitude for the host vehicle 10. Under these conditions, the expression for $Q_1$ above will equal 1 otherwise it will equal 0.

Longitudinal Position (XW)

The remote vehicle 14 is ahead (XW=00) of the host vehicle 10 if:

$$0 \le \delta_{HV} < A_1, \text{ or } A_2 \le \delta_{HV} < 2\pi$$

where:

$A_1 = \beta_1 + \pi/2 - \varphi_1$ $A_4 = \beta_1 + 3\pi/2 + \varphi_1$ $\varphi_1$ is a threshold value that defines the angular range in which the remote vehicle 14 is defined to be adjacent to the host vehicle 10.

This region $\beta_1$ calculated by the following equation is identified by the vertical cross-hatching ⫽⫽ in FIG. 12.

$$\beta_1 = \pi\left[\frac{\theta_{HV} - \theta_{RV} - \sigma}{|\theta_{HV} - \theta_{RV}| + \sigma} + 1\right] - \cos^{-1}\left(\frac{(\phi_{RV} - \phi_{HV})}{\sqrt{(\theta_{RV} - \theta_{HV})^2 \cos^2\phi_{HV} + (\phi_{RV} - \phi_{HV})^2}}\right)\left[\frac{\theta_{HV} - \theta_{RV} - \sigma}{|\theta_{HV} - \theta_{RV}| + \sigma}\right]$$

and these conditions can be defined in one mathematical expression as:

$$P_{Q_1} = \frac{1}{4}\left[\frac{\delta_{HV} - 0 + \sigma}{|\delta_{HV} - 0| + \sigma} + 1\right] \times \left[\frac{A_1 - \delta_{HV} - \sigma}{|A_1 - \delta_{HV}| + \sigma} + 1\right] + \frac{1}{4}\left[\frac{\delta_{HV} - A_4 + \sigma}{|\delta_{HV} - A_4| + \sigma} + 1\right] \times \left[\frac{2\pi - \delta_{HV} - \sigma}{|2\pi - \delta_{HV}| + \sigma} + 1\right]$$

The remote vehicle 14 is adjacent (XW=01) to the host vehicle 10 if:

$$A_1 \leq \delta_{HV} < A_2 \text{ or } A_3 \leq \delta_{HV} < A_4$$

where:

$A_1 = \beta_1 + \pi/2 - \varphi_1$ $A_2 = \beta_1 + \pi/2 + \varphi_1$ $A_3 = \beta_1 + 3\pi/2 - \varphi_1$ $A_4 = \beta_1 + 3\pi/2 + \varphi_1$ These two specific angular ranges are identified by the checkered cross-hatching ⊥⊥ as shown in FIG. 12, which is also the interfaces between the area identified by the vertical cross-hatching ||||| as discussed above, and the area identified by the slanted cross-hatching ═ as discussed below. These conditions can be defined in one mathematical expression as:

$$A_{Q_1} = \frac{1}{4}\left[\frac{\delta_{HV} - A_1 + \sigma}{|\delta_{HV} - A_1| + \sigma} + 1\right] \times \left[\frac{A_2 - \delta_{HV} - \sigma}{|A_2 - \delta_{HV}| + \sigma} + 1\right] + \frac{1}{4}\left[\frac{\delta_{HV} - A_3 + \sigma}{|\delta_{HV} - A_3| + \sigma} + 1\right] \times \left[\frac{A_4 - \delta_{HV} - \sigma}{|A_4 - \delta_{HV}| + \sigma} + 1\right]$$

The remote vehicle 14 is behind (XW=10) the host vehicle 10 if:

$$A_2 \leq \delta_{HV} < A_3$$

where:

$A_2 = \beta_1 + \pi/2 + \varphi_1$ $A_3 = \beta_1 + 3\pi/2 - \varphi_1$ and this region is identified as by the slanted cross-hatching ⫽⫽ in FIG. 12. These conditions can be defined in one mathematical expression as:

$$B_{Q_1} = \frac{1}{4}\left[\frac{\delta_{HV} - A_2 + \sigma}{|\delta_{HV} - A_2| + \sigma} + 1\right] \times \left[\frac{A_3 - \delta_{HV} - \sigma}{|A_3 - \delta_{HV}| + \sigma} + 1\right]$$

Lateral Position (VU):

The remote vehicle 14 is in lane (VU=00) with the host vehicle 10 if:

$$A_5 \leq \delta_{HV} < A_6 \text{ or } A_7 \leq \delta_{HV} < A_8$$

where:

$A_5 = \beta_1 - \varphi_2$ $A_6 = \beta_1 + \varphi_2$ $A_7 = \beta_1 + \pi - \varphi_2$ $A_3 = \beta_1 + \pi + \varphi_2$ $\varphi_2$ is a threshold value that defines the angular range in which the remote vehicle 14 is defined to be in the same lane with the host vehicle 10.

These two specific angular ranges are identified by the vertical cross-hatching ||||| in FIG. 13, which is also the interfaces between the area identified by the checkered cross-hatching ⊥⊥ as shown in FIG. 13 and the area identified by the horizontal cross-hatching ═ in FIG. 13, as discussed below.

These conditions can be defined in one mathematical expression as:

$$I_{Q_1} = \frac{1}{4}\left[\frac{\delta_{HV} - A_5 + \sigma}{|\delta_{HV} - A_5| + \sigma} + 1\right] \times \left[\frac{A_6 - \delta_{HV} - \sigma}{|A_6 - \delta_{HV}| + \sigma} + 1\right] + \frac{1}{4}\left[\frac{\delta_{HV} - A_7 + \sigma}{|\delta_{HV} - A_8| + \sigma} + 1\right] \times \left[\frac{A_8 - \delta_{HV} - \sigma}{|A_8 - \delta_{HV}| + \sigma} + 1\right]$$

and the remote vehicle 14 is to the left (VU=01) of the host vehicle 10 if:

$$A_6 \leq \delta_{HV} < A_7$$

where:

$A_6 = \beta_1 + \varphi_2$ $A_7 = \beta_1 + \pi - \varphi_2$

This region is identified by the horizontal ═ cross-hatching in FIG. 13. These conditions can be defined in one mathematical expression as:

$$L_{Q_1} = \frac{1}{4}\left[\frac{\delta_{HV} - A_6 + \sigma}{|\delta_{HV} - A_6| + \sigma} + 1\right] \times \left[\frac{A_7 - \delta_{HV} - \sigma}{|A_7 - \delta_{HV}| + \sigma} + 1\right]$$

and the remote vehicle 14 is to the right (VU=10) of the host vehicle 10 if:

$$0 \leq \delta_{HV} < A_5 \text{ or } A_8 \leq \delta_{HV} < 2\pi$$

where:

$A_5 = \beta_1 - \varphi_2$ $A_8 = \beta_1 + \alpha + \varphi_2$

This region is identified by the checkered cross-hatching ═ as shown in FIG. 13. These conditions can be defined in one mathematical expression as:

$$R_{Q_1} = \frac{1}{4}\left[\frac{\delta_{HV} - 0 + \sigma}{|\delta_{HV} - 0| + \sigma} + 1\right] \times \left[\frac{A_5 - \delta_{HV} - \sigma}{|A_5 - \delta_{HV}| + \sigma} + 1\right] + \frac{1}{4}\left[\frac{\delta_{HV} - A_8 + \sigma}{|\delta_{HV} - A_8| + \sigma} + 1\right] \times \left[\frac{2\pi - \delta_{HV} - \sigma}{|2\pi - \delta_{HV}| + \sigma} + 1\right]$$

The expressions are then consolidated in the following matrix for the case when the remote vehicle 14 is to the northeast of the host vehicle 10.

| $Q_1$ | | | | | |
|---|---|---|---|---|---|
| | | | Lateral Position | | |
| | | RV in lane ($I_{Q_1}$) | RV Left ($L_{Q_1}$) | RV Right ($R_{Q_1}$) | Unused |
| Longitudinal Position | RV Ahead ($P_{Q_1}$) | $Q_1 \times P_{Q_1} \times I_{Q_1}$ | $Q_1 \times P_{Q_1} \times L_{Q_1}$ | $Q_1 \times P_{Q_1} \times R_{Q_1}$ | 0 |
| | RV Adjacent ($A_{Q_1}$) | $Q_1 \times A_{Q_1} \times I_{Q_1}$ | $Q_1 \times A_{Q_1} \times L_{Q_1}$ | $Q_1 \times A_{Q_1} \times R_{Q_1}$ | 0 |
| | RV Behind ($B_{Q_1}$) | $Q_1 \times B_{Q_1} \times I_{Q_1}$ | $Q_1 \times B_{Q_1} \times L_{Q_1}$ | $Q_1 \times B_{Q_1} \times R_{Q_1}$ | 0 |
| | Unused | 0 | 0 | 0 | 0 |

Figure 14:
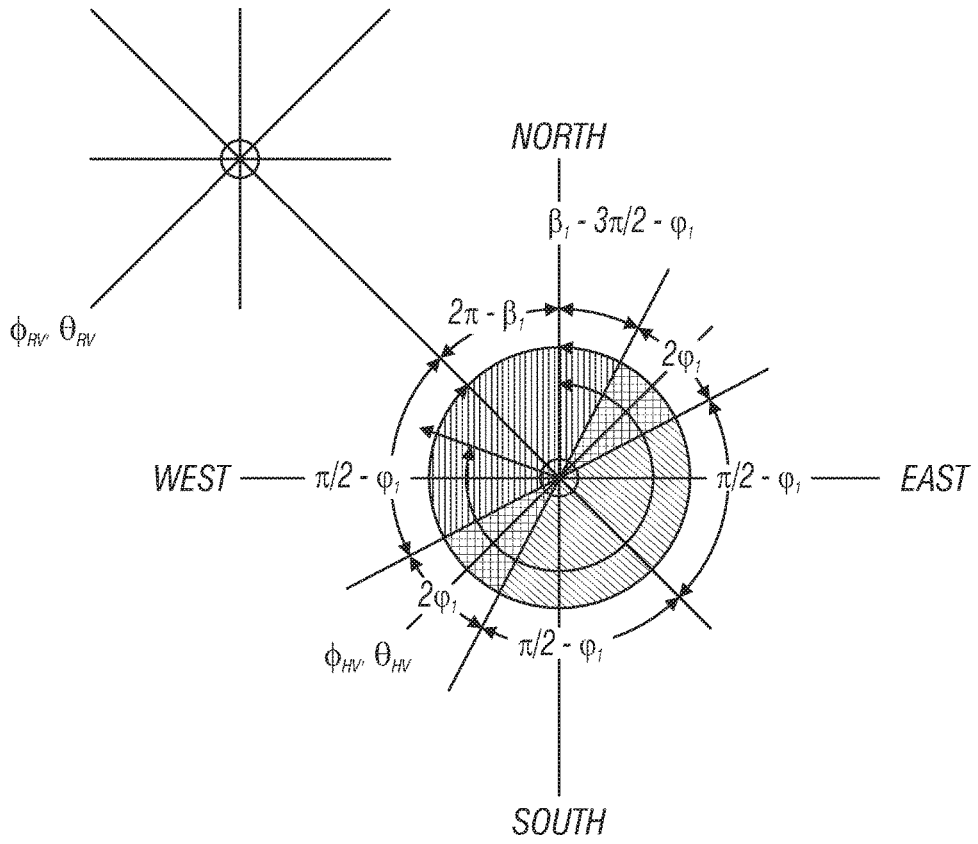
Figure 15:
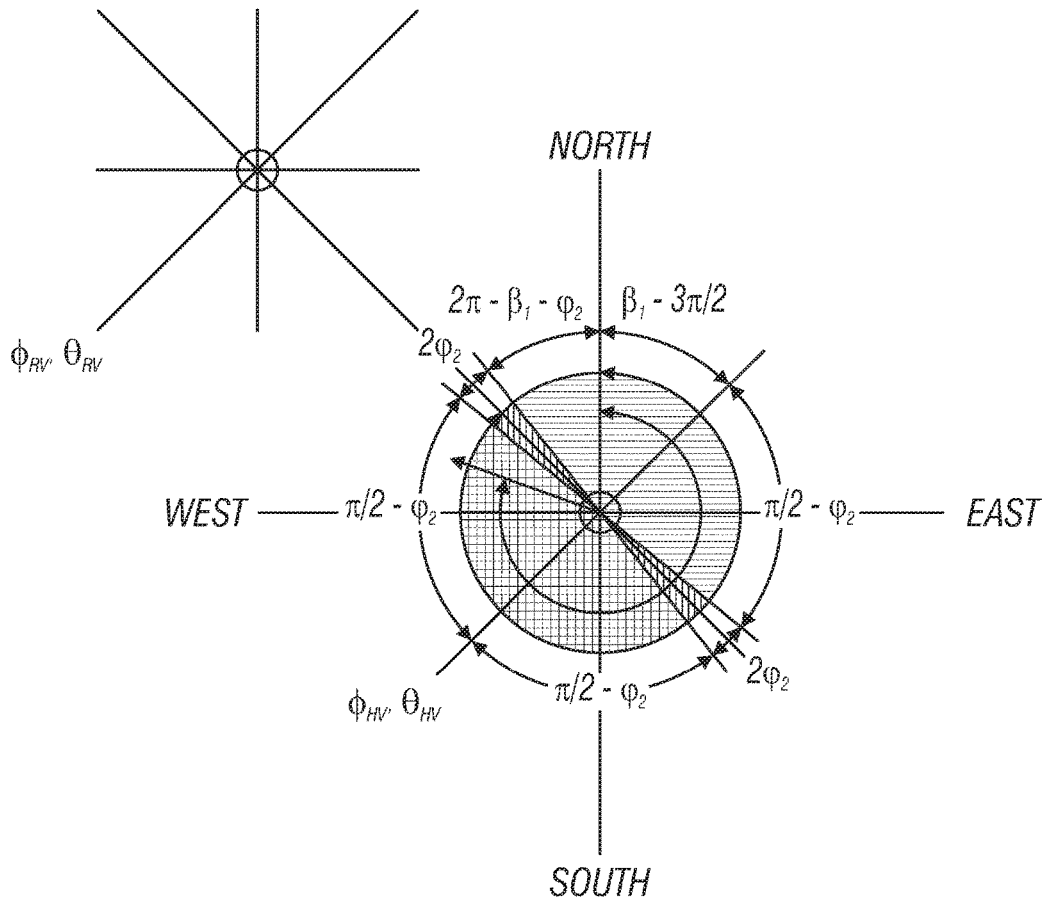

FIGS. 14 and 15 illustrate a condition in which the remote vehicle 14 is to the Northwest of the host vehicle 10, and is in quadrant Q2.

Q2: Remote Vehicle 14 is to the Northwest of the Host Vehicle 10

$$Q_2 = \frac{1}{4}\left[\frac{\phi_{RV} - \phi_{HV} + \sigma}{|\phi_{RV} - \phi_{HV}| + \sigma} + 1\right] \times \left[\frac{\theta_{HV} - \theta_{RV} - \sigma}{|\theta_{HV} - \theta_{RV}| + \sigma} + 1\right]$$

If the remote vehicle 14 is northwest of the host vehicle as shown in FIGS. 14 and 15, the latitude for the remote vehicle 14 is greater than the latitude of the host vehicle 10, but the longitude for the remote vehicle 14 is less than the longitude for the host vehicle 10. Under these conditions, the expression for Q2 above will equal 1 otherwise it will equal 0.

Longitudinal Position (XW)

The remove vehicle 14 is ahead (XW=00) of the host vehicle 10 if:

$$0 \le \delta_{HV} < A_9 \text{ or } A_{12} \le \delta_{HV} < 2\pi$$

where:

$A_9 = \beta_1 - 3\pi/2 - \varphi_1$ $A_{12} = \beta_1 - \pi/2 + \varphi_1$ $\varphi_1$ is a threshold value that defines the angular range in which the RV is defined to be adjacent to the HV.

This region $\beta_1$ calculated by the following equation is identified by the vertical cross-hatching ||||| in FIG. 14.

$$\beta_1 = \pi\left[\frac{\theta_{HV} - \theta_{RV} - \sigma}{|\theta_{HV} - \theta_{RV}| + \sigma} + 1\right] - \cos^{-1}\left(\frac{(\phi_{RV} - \phi_{HV})}{\sqrt{(\theta_{RV} - \theta_{HV})^2 \cos^2\phi_{HV} + (\phi_{RV} - \phi_{HV})^2}}\right)\left[\frac{\theta_{HV} - \theta_{RV} - \sigma}{|\theta_{HV} - \theta_{RV}| + \sigma}\right]$$

These conditions can be defined in one mathematical expression as:

$$P_{Q_1} = \frac{1}{4}\left[\frac{\delta_{HV} - 0 + \sigma}{|\delta_{HV} - 0| + \sigma} + 1\right] \times \left[\frac{A_9 - \delta_{HV} - \sigma}{|A_9 - \delta_{HV}| + \sigma} + 1\right] + \frac{1}{4}\left[\frac{\delta_{HV} - A_{12} + \sigma}{|\delta_{HV} - A_{12}| + \sigma} + 1\right] \times \left[\frac{2\pi - \delta_{HV} - \sigma}{|2\pi - \delta_{HV}| + \sigma} + 1\right]$$

and the remote vehicle 14 is adjacent (XW=01) to the host vehicle 10 if:

$$A_9 \le \delta_{HV} < A_{10} \text{ or } A_{11} \le \delta_{HV} < A_{12}$$

where:

$A_9 = \beta_1 - 3\pi/2 - \varphi_1$ $A_{10} = \beta_1 - 3\pi/2 + \varphi_1$ $A_{11} = \beta_1 - \pi/2 - \varphi_1$ $A_{12} = \beta_1 - \pi/2 + \varphi_1$ These two specific angular ranges are identified by the checkered cross-hatching ||||| as shown in FIG. 14 as the interfaces between the area identified by the vertical cross-hatching ⊥⊥ and the area identified by the slanted cross-hatching ═ in FIG. 14. These conditions can be defined in one mathematical expression as:

$$A_{Q_1} = \frac{1}{4}\left[\frac{\delta_{HV} - A_9 + \sigma}{|\delta_{HV} - A_9| + \sigma} + 1\right] \times \left[\frac{A_{10} - \delta_{HV} - \sigma}{|A_{10} - \delta_{HV}| + \sigma} + 1\right] + \frac{1}{4}\left[\frac{\delta_{HV} - A_{11} + \sigma}{|\delta_{HV} - A_{11}| + \sigma} + 1\right] \times \left[\frac{A_{12} - \delta_{HV} - \sigma}{|A_{12} - \delta_{HV}| + \sigma} + 1\right]$$

and the remote vehicle 14 is behind (XW=10) the host vehicle 12 if:

$$A_{10} \le \delta_{HV} < A_{11}$$

where:

$A_{10} = \beta_1 - 3\pi/2 + \varphi_1$ $A_{11} = \beta_1 - \pi/2 - \varphi_1$

This region is identified by the slanted cross-hatching \\\\ in FIG. 14. These conditions can be defined in one mathematical expression as:

$$B_{Q_2} = \frac{1}{4}\left[\frac{\delta_{HV} - A_{10} + \sigma}{|\delta_{HV} - A_{10}| + \sigma} + 1\right] \times \left[\frac{A_{11} - \delta_{HV} - \sigma}{|A_{11} - \delta_{HV}| + \sigma} + 1\right]$$

Lateral Position (VU)

The remote vehicle 14 is in lane (VU=00) with the host vehicle 10 if:

$$A_{13} \le \delta_{HV} < A_{14} \text{ or } A_{15} \le \delta_{HV} < A_{16}$$

where:

$A_{13} = \beta_1 - \pi\varphi_2$ $A_{14} = \beta_1 - \pi + \varphi_2$ $A_{15} = \beta_1 - \varphi_2$ $A_{16} = \beta_1 + \varphi_2$ $\varphi_2$ is a threshold value that defines the angular range in which the remote vehicle 14 is defined to be in the same lane with the host vehicle 10.

These two specific angular ranges are identified by the vertical cross-hatching ||||| as the interfaces between the area identified by the checkered cross-hatching ⊥⊥ and the area identified by the horizontal cross-hatching ═ in FIG. 15.

These conditions can be defined in one mathematical expression as:

$$I_{Q_2} = \frac{1}{4}\left[\frac{\delta_{HV} - A_{13} + \sigma}{|\delta_{HV} - A_{13}| + \sigma} + 1\right] \times \left[\frac{A_{14} - \delta_{HV} - \sigma}{|A_{14} - \delta_{HV}| + \sigma} + 1\right] +$$

-continued $$\frac{1}{4}\left[\frac{\delta_{HV}-A_{15}+\sigma}{|\delta_{HV}-A_{15}|+\sigma}+1\right]\times\left[\frac{A_{16}-\delta_{HV}-\sigma}{|A_{16}-\delta_{HV}|+\sigma}+1\right]$$

and the remote vehicle 14 is to the left (VU=01) of the host vehicle 10 if:

$$0\leq\delta_{HV}<A_{13} \text{ or } A_{16}\leq\delta_{HV}<2\pi$$

where:

$A_{13}=\beta_1-\pi-\varphi_2$ $A_{16}=\beta_1+\varphi_2$

This region is identified by the horizontal cross-hatching ═ FIG. 15. These conditions can be defined in one mathematical expression as:

$$L_{Q_2}=\frac{1}{4}\left[\frac{\delta_{HV}-0+\sigma}{|\delta_{HV}-0|+\sigma}+1\right]\times\left[\frac{A_{13}-\delta_{HV}-\sigma}{|A_{13}-\delta_{HV}|+\sigma}+1\right]+\frac{1}{4}\left[\frac{\delta_{HV}-A_{16}+\sigma}{|\delta_{HV}-A_{16}|+\sigma}+1\right]\times\left[\frac{2\pi-\delta_{HV}-\sigma}{|2\pi-\delta_{HV}|+\sigma}+1\right]$$

and the remote vehicle 14 is to the right (VU=10) of the host vehicle 10 if:

$$A_{14}\leq\delta_{HV}<A_{15}$$

where:

$A_{14}=\beta_1-\pi+\varphi_2$ $A_{15}=\beta_1-\varphi_2$

This region is identified by the checkered cross-hatching ||||| in FIG. 15. These conditions can be defined in one mathematical expression as:

$$R_{Q_2}=\frac{1}{4}\left[\frac{\delta_{HV}-A_{14}+\sigma}{|\delta_{HV}-A_{14}|+\sigma}+1\right]\times\left[\frac{A_{15}-\delta_{HV}-\sigma}{|A_{15}-\delta_{HV}|+\sigma}+1\right]$$

The expressions are then consolidated in the following matrix for the case when the remote vehicle 14 is to the northwest of the host vehicle 10.

| $Q_2$ | | | | | |
|---|---|---|---|---|---|
| | | | Lateral Position | | |
| | | RV in lane ($I_{Q_2}$) | RV Left ($L_{Q_2}$) | RV Right ($R_{Q_2}$) | Unused |
| Longitudinal Position | RV Ahead ($P_{Q2}$) | $Q_2\times P_{Q_2}\times I_{Q_2}$ | $Q_2\times P_{Q_2}\times L_{Q_2}$ | $Q_2\times P_{Q_2}\times R_{Q_2}$ | 0 |
| | RV Adjacent ($A_{Q2}$) | $Q_2\times A_{Q_2}\times I_{Q_2}$ | $Q_2\times A_{Q_2}\times L_{Q_2}$ | $Q_2\times A_{Q_2}\times R_{Q_2}$ | 0 |
| | RV Behind ($B_{Q2}$) | $Q_2\times B_{Q_2}\times I_{Q_2}$ | $Q_2\times B_{Q_2}\times L_{Q_2}$ | $Q_2\times B_{Q_2}\times R_{Q_2}$ | 0 |
| | Unused | 0 | 0 | 0 | 0 |

Figure 16:
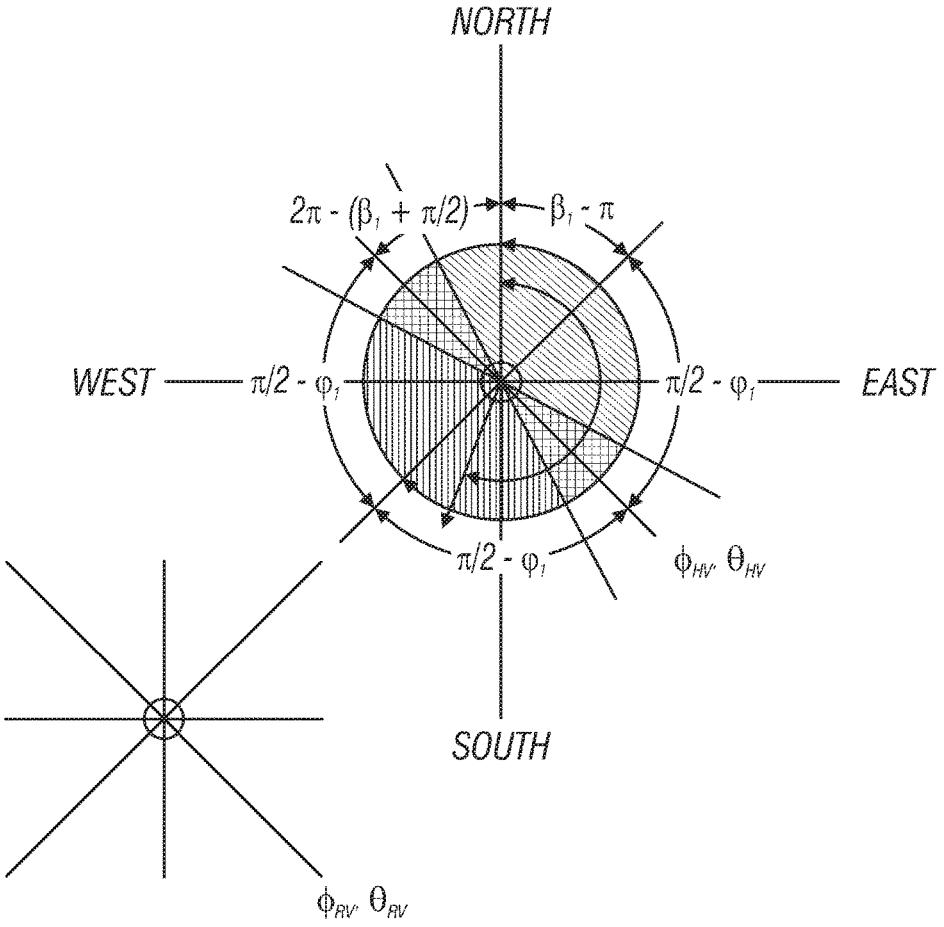
Figure 17:
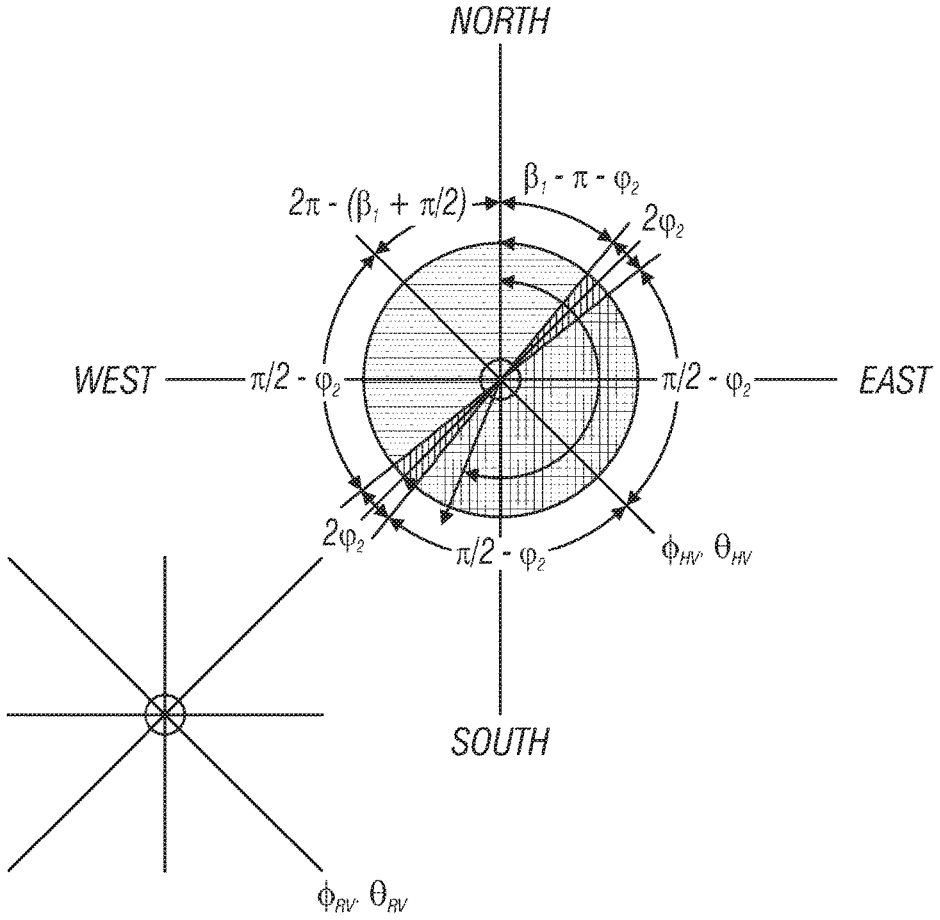

FIGS. 16 and 17 illustrate a condition in which the remote vehicle 14 is to the Northeast of the host vehicle 10, and is in quadrant Q3.

Q3: Remote Vehicle 14 is to the Southwest of the Host Vehicle 10

$$Q_3=\frac{1}{4}\left[\frac{\phi_{HV}-\phi_{RV}-\sigma}{|\phi_{HV}-\phi_{RV}|+\sigma}+1\right]\times\left[\frac{\theta_{HV}-\theta_{RV}+\sigma}{|\theta_{HV}-\theta_{RV}|+\sigma}+1\right]$$

If the remote vehicle 14 is southwest of the host vehicle 10 as shown in FIGS. 16 and 17, both latitude and longitude for the remote vehicle 14 is less than the latitude and longitude for the host vehicle 10. Under these conditions, the expression for Q3 above will equal 1 otherwise it will equal 0.

Longitudinal Position (XW)

The remote vehicle 14 is ahead (XW=00) of the host vehicle 10 if:

$$A_{12}\leq\delta_{HV}<A_1$$

where:

$A_{12}=\beta_1\pi/2+\varphi_1$ $A_1=\beta_1+\pi2-\varphi_1$ $\varphi_1$ is a threshold value that defines the angular range in which the remote vehicle 14 is defined to be adjacent to the host vehicle 10.

This region $\beta_1$ calculated by the following equation is identified by the vertical cross-hatching ||||| in FIG. 16.

$$\beta_1=\pi\left[\frac{\theta_{HV}-\theta_{RV}-\sigma}{|\theta_{HV}-\theta_{RV}|+\sigma}+1\right]-\cos^{-1}\left(\frac{(\phi_{RV}-\phi_{HV})}{\sqrt{(\theta_{RV}-\theta_{HV})^2\cos^2\phi_{HV}+(\phi_{RV}-\phi_{HV})^2}}\right)\left[\frac{\theta_{HV}-\theta_{RV}-\sigma}{|\theta_{HV}-\theta_{RV}|+\sigma}\right]$$

These conditions can be defined in one mathematical expression as:

$$P_{Q_3}=\frac{1}{4}\left[\frac{\delta_{HV}-A_{12}+\sigma}{|\delta_{HV}-A_{12}|+\sigma}+1\right]\times\left[\frac{A_1-\delta_{HV}-\sigma}{|A_1-\delta_{HV}|+\sigma}+1\right]$$

and the remote vehicle 14 is adjacent (XW=01) to the host vehicle 10 if:

$$A_1\leq\delta_{HV}<A_2 \text{ or } A_{11}\leq\delta_{HV}<A_{12}$$

where:

$A_1=\beta_1+\pi/2+_{\varphi}\mathbf{1}$ $A_2=\beta_1+\pi/2+\varphi_1$ $A_{11}=\beta_1-\pi/2-\varphi_1$ $A_{12}=\beta_1-\pi/2+\varphi_1$ These two specific angular ranges are identified by the checkered cross-hatching ⊥⊥ as the interfaces between the area identified by the vertical cross-hatching ||||| and the area identified by the slanted cross-hatching \\\ in FIG. 16.

These conditions can be defined in one mathematical expression as:

$$A_{Q_3}=\frac{1}{4}\left[\frac{\delta_{HV}-A_1+\sigma}{|\delta_{HV}-A_1|+\sigma}+1\right]\times\left[\frac{A_2-\delta_{HV}-\sigma}{|A_2-\delta_{HV}|+\sigma}+1\right]+\frac{1}{4}\left[\frac{\delta_{HV}-A_{11}+\sigma}{|\delta_{HV}-A_{11}|+\sigma}+1\right]\times\left[\frac{A_{12}-\delta_{HV}-\sigma}{|A_{12}-\delta_{HV}|+\sigma}+1\right]$$

and the remote vehicle 14 is behind (XW=10) the host vehicle 10 if:

$$0 \le \delta_{HV} < A_{11} \text{ or } A_2 \le \delta_{HV} < 2\pi$$

where:

$A_2 = \beta_1 + \pi/2 + \varphi_1$ $A_{11} = \beta_2 - \pi/2 - \varphi_1$

This region is identified by the slanted cross-hatching \\\\ in FIG. 16. These conditions can be defined in one mathematical expression as:

$$B_{Q_3} = \frac{1}{4}\left[\frac{\delta_{HV} - 0 + \sigma}{|\delta_{HV} - 0| + \sigma} + 1\right] \times \left[\frac{A_{11} - \delta_{HV} - \sigma}{|A_{11} - \delta_{HV}| + \sigma} + 1\right] + \frac{1}{4}\left[\frac{\delta_{HV} - A_2 + \sigma}{|\delta_{HV} - A_2| + \sigma} + 1\right] \times \left[\frac{2\pi - \delta_{HV} - \sigma}{|2\pi - \delta_{HV}| + \sigma} + 1\right]$$

Lateral Position (VU)

The remote vehicle 14 is in lane (VU=00) with the host vehicle 10 if:

$$A_{13} \le \delta_{HV} \le A_{14} \text{ or } A_{15} \le \delta_{HV} < A_{16}$$

where:

$A_{13} = \beta_1 - \pi - \varphi_2$ $A_{14} = \beta_1 - \pi + \varphi_2$ $A_{15} = \beta_1 - \varphi_2$ $A_{16} = \beta_1 + \varphi_2$ $\varphi_2$ on is a threshold value that defines the angular range in which the RV is defined to be in the same lane with the HV.

These two specific angular ranges are identified by the vertical cross-hatching ||||| as the interfaces between area identified by the checkered cross-hatching ⊥⊥ and the area identified by the horizontal cross-hatching ═ FIG. 17. These conditions can be defined in one mathematical expression as:

$$I_{Q_3} = \frac{1}{4}\left[\frac{\delta_{HV} - A_{13} + \sigma}{|\delta_{HV} - A_{13}| + \sigma} + 1\right] \times \left[\frac{A_{14} - \delta_{HV} - \sigma}{|A_{14} - \delta_{HV}| + \sigma} + 1\right] + \frac{1}{4}\left[\frac{\delta_{HV} - A_{15} + \sigma}{|\delta_{HV} - A_{15}| + \sigma} + 1\right] \times \left[\frac{A_{16} - \delta_{HV} - \sigma}{|A_{16} - \delta_{HV}| + \sigma} + 1\right]$$

and the remote vehicle 14 is to the left (VU=01) of the host vehicle 10 if:

$$0 \le \delta_{HV} < A_{13} \text{ or } A_{16} \le \delta_{HV} < 2\pi$$

$A_{13} = \beta_1 - \pi - \varphi_2$ $A_{16} = \beta_1 + \varphi_2$

This region is identified by the horizontal cross-hatching ═ FIG. 17. These conditions can be defined in one mathematical expression as:

$$L_{Q_3} = \frac{1}{4}\left[\frac{\delta_{HV} - 0 + \sigma}{|\delta_{HV} - 0| + \sigma} + 1\right] \times \left[\frac{A_{13} - \delta_{HV} - \sigma}{|A_{13} - \delta_{HV}| + \sigma} + 1\right] + \frac{1}{4}\left[\frac{\delta_{HV} - A_{16} + \sigma}{|\delta_{HV} - A_{16}| + \sigma} + 1\right] \times \left[\frac{2\pi - \delta_{HV} - \sigma}{|2\pi - \delta_{HV}| + \sigma} + 1\right]$$

and the remote vehicle 14 is to the right (VU=10) of the host vehicle 10 if:

$$A_{14} \le \delta_{HV} < A_{15}$$

where:

$A_{14} = \beta_1 - \pi + \varphi_2$ $A_{15} = \beta_1 - \varphi_2$

This region is identified by the checkered cross-hatching ⊥⊥ in FIG. 17. These conditions can be defined in one mathematical expression as:

$$R_{Q_3} = \frac{1}{4}\left[\frac{\delta_{HV} - A_{14} + \sigma}{|\delta_{HV} - A_{14}| + \sigma} + 1\right] \times \left[\frac{A_{15} - \delta_{HV} - \sigma}{|A_{15} - \delta_{HV}| + \sigma} + 1\right]$$

The expressions are then consolidated in the following matrix for the case when the remote vehicle 14 is to the southwest of the host vehicle 10.

| $Q_3$ | | | | | |
|---|---|---|---|---|---|
| | | | Lateral Position | | |
| | | RV in lane ($I_{Q_3}$) | RV Left ($L_{Q_3}$) | RV Right ($R_{Q_3}$) | Unused |
| Longitudinal Position | RV Ahead ($P_{Q_3}$) | $Q_3 \times P_{Q_3} \times I_{Q_3}$ | $Q_3 \times P_{Q_3} \times L_{Q_3}$ | $Q_3 \times P_{Q_3} \times R_{Q_3}$ | 0 |
| | RV Adjacent ($A_{Q_3}$) | $Q_3 \times A_{Q_3} \times I_{Q_3}$ | $Q_3 \times A_{Q_3} \times L_{Q_3}$ | $Q_3 \times A_{Q_3} \times R_{Q_3}$ | 0 |
| | RV Behind ($B_{Q_3}$) | $Q_3 \times B_{Q_3} \times I_{Q_3}$ | $Q_3 \times B_{Q_3} \times L_{Q_3}$ | $Q_3 \times B_{Q_3} \times R_{Q_3}$ | 0 |
| | Unused | 0 | 0 | 0 | 0 |

Figure 18:
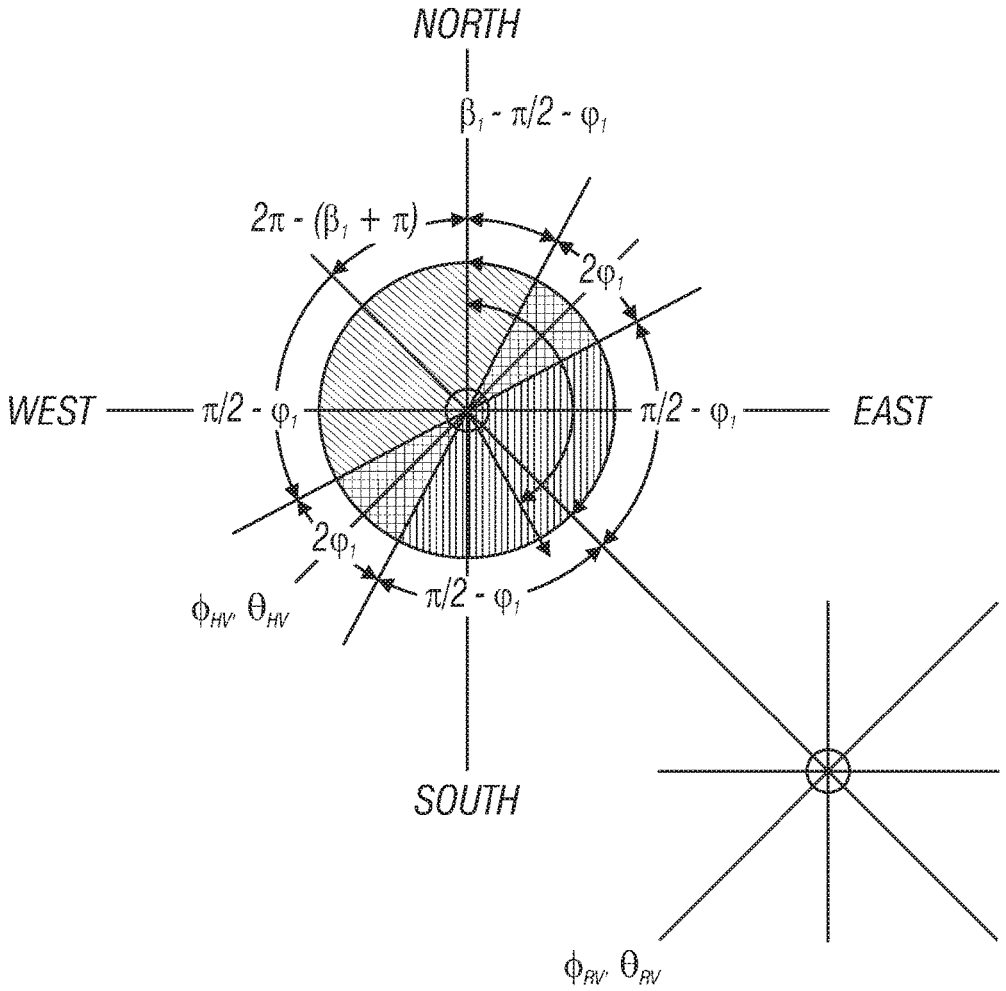
Figure 19:
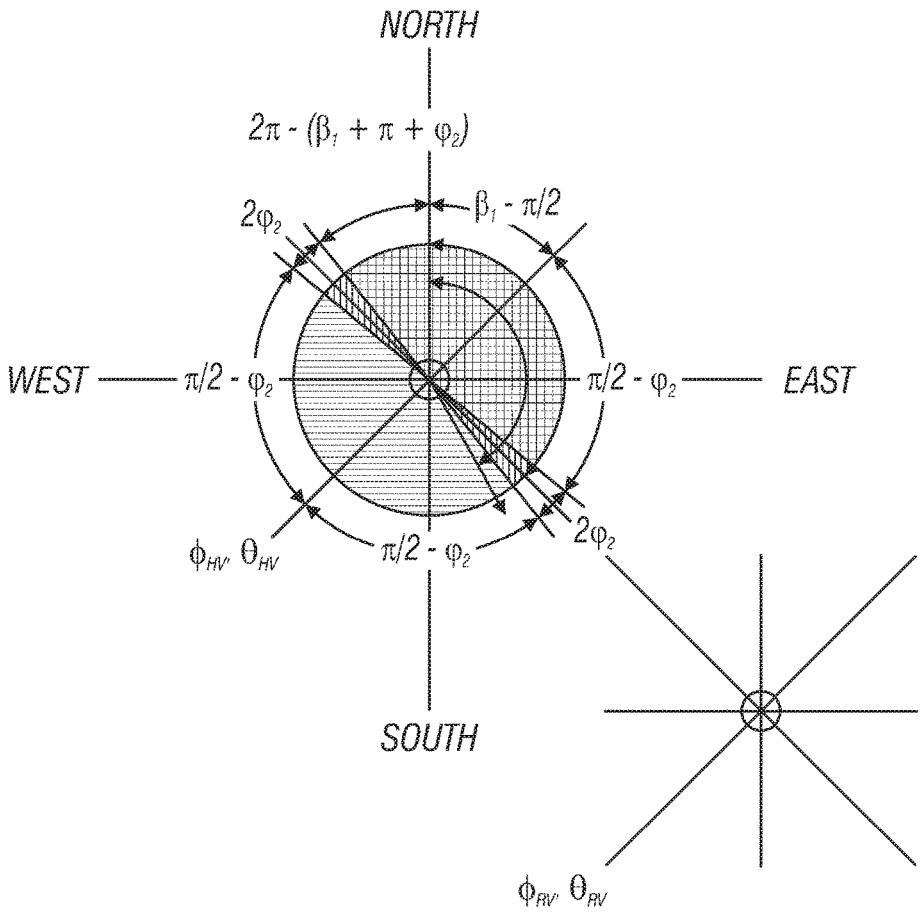
Figure 20:
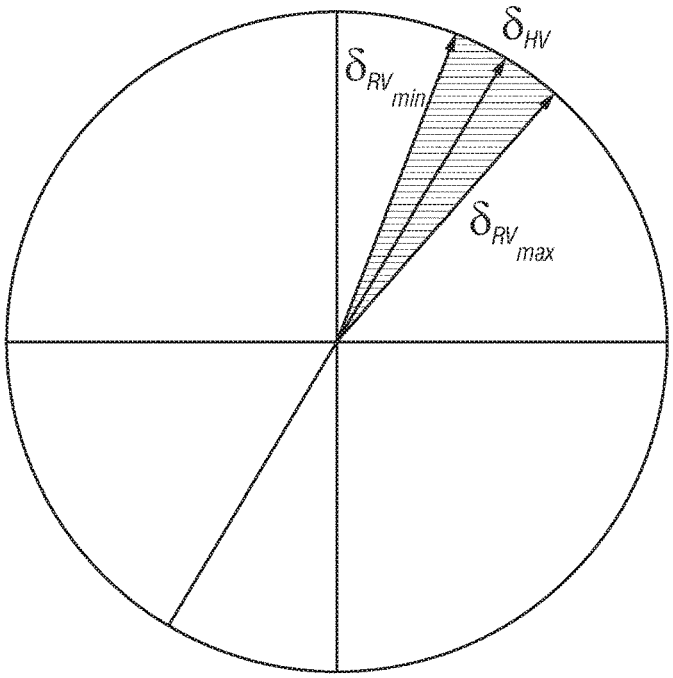
FIGS. 20-43 are graphical representations of heading angles of the host vehicle and the remote vehicle in relation to each other as used in calculations performed by the traffic circle warning system during the operation of the flowchart of FIG. 11.
Figure 21:
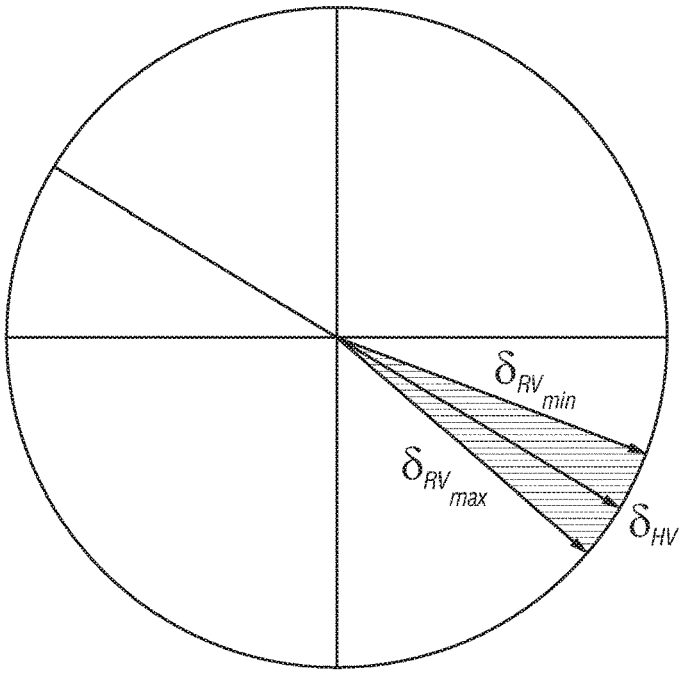
Figure 22:
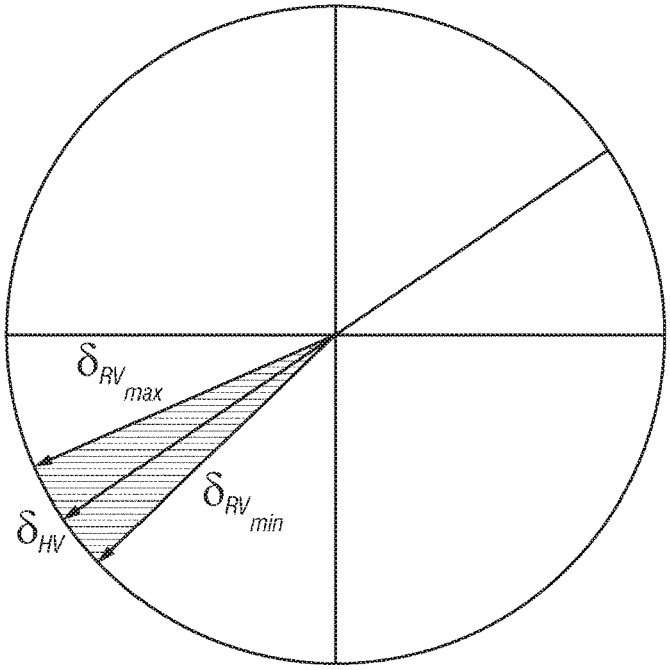
Figure 23:
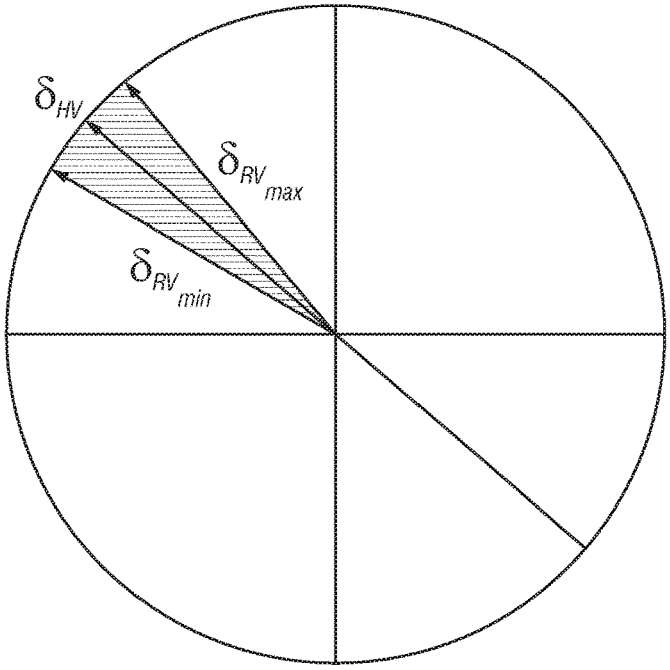

FIGS. 18 and 19 illustrate a condition in which the remote vehicle 14 is to the Southeast of the host vehicle 10, and is in quadrant Q4.

Q4: Remote Vehicle 14 is to the Southeast of the Host Vehicle 10

$$Q_4 = \frac{1}{4}\left[\frac{\phi_{HV} - \phi_{RV} + \sigma}{|\phi_{HV} - \phi_{RV}| + \sigma} + 1\right] \times \left[\frac{\theta_{RV} - \phi_{HV} - \sigma}{|\theta_{RV} - \theta_{HV}| + \sigma} + 1\right]$$

If the remote vehicle 14 is southeast of the host vehicle 10 as shown in the FIGS. 18 and 19, the latitude for the remote vehicle 14 is less than the latitude of the host vehicle 10 but the longitude for the remote vehicle 14 is greater than the longitude for the host vehicle 10. Under these conditions, the expression for Q4 above will equal 1 otherwise it will equal 0.

Longitudinal Position (XW)

The remote vehicle 14 is ahead (XW=00) of the host vehicle 10 if:

$$A_{12} \le \delta_{HV} < A_1$$

where:

$A_1 = \beta_1 + \pi/2 - \varphi_1$ $A_{12} = \beta_1 - \pi/2 + \varphi_1$ $\varphi_1$ is a threshold value that defines the angular range in which the remote vehicle 14 is defined to be adjacent to the host vehicle 10.

This region $\beta_1$ calculated by the following equation is identified by the vertical cross-hatching ||||| in FIG. 18.

$$\beta_1 = \pi\left[\frac{\theta_{HV} - \theta_{RV} - \sigma}{|\theta_{HV} - \theta_{RV}| + \sigma} + 1\right] - \cos^{-1}\left(\frac{(\phi_{RV} - \phi_{HV})}{\sqrt{(\theta_{RV} - \theta_{HV})^2 \cos^2\phi_{HV} + (\phi_{RV} - \phi_{HV})^2}}\right)\left[\frac{\theta_{HV} - \theta_{RV} - \sigma}{|\theta_{HV} - \theta_{RV}| + \sigma}\right]$$

These conditions can be defined in one mathematical expression as:

$$P_{Q_4} = \frac{1}{4}\left[\frac{\delta_{HV} - A_{12} + \sigma}{|\delta_{HV} - A_{12}| + \sigma} + 1\right] \times \left[\frac{A_1 - \delta_{HV} - \sigma}{|A_1 - \delta_{HV}| + \sigma} + 1\right]$$

and the remote vehicle 14 is adjacent (XW=01) to the host vehicle 10 if:

$$A_1 \leq \delta_{HV} < A_2 \text{ or } A_{11} \leq \delta_{HV} < A_{12}$$

where:

$A_1 = \beta_1 + \pi/2 - \varphi_1$ $A_2 = \beta_1 + \pi/2 + \varphi_1$ $A_{11} = \beta_1 - \pi/2 - \varphi_1$ $A_{12} = \beta_1 - \pi/2 + \varphi_1$ These two specific angular ranges are identified by the checkered cross-hatching ⊥⊥ as the interfaces between area identified by the vertical cross-hatching ||||| and the slanted cross-hatching \\\\ in FIG. 18. These conditions can be defined in one mathematical expression as:

$$A_{Q_4} = \frac{1}{4}\left[\frac{\delta_{HV} - A_1 + \sigma}{|\delta_{HV} - A_1| + \sigma} + 1\right] \times \left[\frac{A_2 - \delta_{HV} - \sigma}{|A_2 - \delta_{HV}| + \sigma} + 1\right] + \frac{1}{4}\left[\frac{\delta_{HV} - A_{11} + \sigma}{|\delta_{HV} - A_{11}| + \sigma} + 1\right] \times \left[\frac{A_{12} - \delta_{HV} - \sigma}{|A_{12} - \delta_{HV}| + \sigma} + 1\right]$$

and the remote vehicle 14 is behind (XW=10) the host vehicle 10 if:

$$A_2 \leq \delta_{HV} < 2\pi \text{ or } 0 \leq \delta_{HV} < A_{11}$$

where:

$A_2 = \beta_1 + \pi/2 + \varphi_1$ $A_{11} = \beta_1 - \pi/2 - \varphi_1$

This region is identified by the slanted cross-hatching \\\\ in FIG. 18. These conditions can be defined in one mathematical expression as:

$$B_{Q_4} = \frac{1}{4}\left[\frac{\delta_{HV} - 0 + \sigma}{|\delta_{HV} - 0| + \sigma} + 1\right] \times \left[\frac{A_{11} - \delta_{HV} - \sigma}{|A_{11} - \delta_{HV}| + \sigma} + 1\right] + \frac{1}{4}\left[\frac{\delta_{HV} - A_2 + \sigma}{|\delta_{HV} - A_2| + \sigma} + 1\right] \times \left[\frac{2\pi - \delta_{HV} - \sigma}{|2\pi - \delta_{HV}| + \sigma} + 1\right]$$

Lateral Position (VU)

The remote vehicle 14 is in lane (VU=00) with the host vehicle 10 if:

$$A_5 \leq \delta_{HV} < A_6 \text{ or } A_7 \leq \delta_{HV} < A_8$$

where:

$A_5 = \beta_1 - \varphi_2$ $A_6 = \beta_1 + \varphi_2$ $A_7 = \beta_1 + \pi + \varphi_2$ $A_8 = \beta_1 + \pi + \varphi_2$ $\varphi_2$ is a threshold value that defines the angular range in which the remote vehicle 14 is defined to be in the same lane with the host vehicle 10.

These two specific angular ranges are identified by the vertical cross-hatching 11111 as the interfaces between area identified by the checkered cross-hatching ⊥⊥ and the horizontal cross-hatching ═ in FIG. 19. These conditions can be defined in one mathematical expression as:

$$I_{Q_4} = \frac{1}{4}\left[\frac{\delta_{HV} - A_5 + \sigma}{|\delta_{HV} - A_5| + \sigma} + 1\right] \times \left[\frac{A_6 - \delta_{HV} - \sigma}{|A_6 - \delta_{HV}| + \sigma} + 1\right] + \frac{1}{4}\left[\frac{\delta_{HV} - A_7 + \sigma}{|\delta_{HV} - A_7| + \sigma} + 1\right] \times \left[\frac{A_8 - \delta_{HV} - \sigma}{|A_8 - \delta_{HV}| + \sigma} + 1\right]$$

and the remote vehicle 14 is to the left (VU=01) of the host vehicle 10 if:

$$A_6 \leq \delta_{HV} < A_7$$

where:

$A_6 = \beta_1 + \varphi_2$ $A_7 = \beta_1 + \pi -_2$

This region is identified as the horizontal cross-hatching ═ in FIG. 19. These conditions can be defined in one mathematical expression as:

$$L_{Q_4} = \frac{1}{4}\left[\frac{\delta_{HV} - A_6 + \sigma}{|\delta_{HV} - A_6| + \sigma} + 1\right] \times \left[\frac{A_7 - \delta_{HV} - \sigma}{|A_7 - \delta_{HV}| + \sigma} + 1\right]$$

and the remote vehicle 14 is to the right (VU=10) of the host vehicle 10 if:

$$0 \leq \delta_{HV} < A_5 \text{ or } A_8 \leq \delta_{HV} < 2\pi$$

where:

$A_5 = \beta_1 - \varphi_2$ $A_8 = \beta_1 + \pi + \varphi_2$

This region is identified by the checkered cross-hatching ⊥⊥ in FIG. 19. These conditions can be defined in one mathematical expression as:

$$R_{Q_4} = \frac{1}{4}\left[\frac{\delta_{HV} - 0 + \sigma}{|\delta_{HV} - 0| + \sigma} + 1\right] \times \left[\frac{A_5 - \delta_{HV} - \sigma}{|A_5 - \delta_{HV}| + \sigma} + 1\right] + \frac{1}{4}\left[\frac{\delta_{HV} - A_8 + \sigma}{|\delta_{HV} - A_8| + \sigma} + 1\right] \times \left[\frac{2\pi - \delta_{HV} - \sigma}{|2\pi - \delta_{HV}| + \sigma} + 1\right]$$

The expressions are then consolidated in the following matrix for the case when the remote vehicle 14 is to the southwest of the host vehicle 10.

| | | $Q_4$ | | | |
|---|---|---|---|---|---|
| | | | Lateral Position | | |
| | | RV in lane ($I_{Q_4}$) | RV Left ($L_{Q_4}$) | RV Right ($R_{Q_4}$) | Unused |
| Longitudinal Position | RV Ahead ($P_{Q_4}$) | $Q_4 \times P_{Q_4} \times I_{Q_4}$ | $Q_4 \times P_{Q_4} \times L_{Q_4}$ | $Q_4 \times P_{Q_4} \times R_{Q_4}$ | 0 |
| | RV Adjacent ($A_{Q_4}$) | $Q_4 \times A_{Q_4} \times I_{Q_4}$ | $Q_4 \times A_{Q_4} \times L_{Q_4}$ | $Q_4 \times A_{Q_4} \times R_{Q_4}$ | 0 |

-continued

| $Q_4$ | | | | | |
|---|---|---|---|---|---|
| | | | Lateral Position | | |
| | | RV in lane ($I_{Q4}$) | RV Left ($L_{Q4}$) | RV Right ($R_{Q4}$) | Unused |
| | RV Behind ($B_{Q4}$) | $Q_4 \times B_{Q4} \times I_{Q4}$ | $Q_4 \times B_{Q4} \times L_{Q4}$ | $Q_4 \times B_{Q4} \times R_{Q4}$ | 0 |
| | Unused | 0 | 0 | 0 | 0 |

The following is a Summary for the four Quadrants Q1 through Q4:

| $Q_1$ | | | | | |
|---|---|---|---|---|---|
| | | | Lateral Position | | |
| | | RV in lane ($I_{Q1}$) | RV Left ($L_{Q1}$) | RV Right ($R_{Q1}$) | Unused |
| Longitudinal Position | RV Ahead ($P_{Q1}$) | $Q_1 \times P_{Q1} \times I_{Q1}$ | $Q_1 \times P_{Q1} \times L_{Q1}$ | $Q_1 \times P_{Q1} \times R_{Q1}$ | 0 |
| | RV Adjacent ($A_{Q1}$) | $Q_1 \times A_{Q1} \times I_{Q1}$ | $Q_1 \times A_{Q1} \times L_{Q1}$ | $Q_1 \times A_{Q1} \times R_{Q1}$ | 0 |
| | RV Behind ($B_{Q1}$) | $Q_1 \times B_{Q1} \times I_{Q1}$ | $Q_1 \times B_{Q1} \times L_{Q1}$ | $Q_1 \times B_{Q1} \times R_{Q1}$ | 0 |
| | Unused | 0 | 0 | 0 | 0 |

| $Q_2$ | | | | | |
|---|---|---|---|---|---|
| | | | Lateral Position | | |
| | | RV in lane ($I_{Q2}$) | RV Left ($L_{Q2}$) | RV Right ($R_{Q2}$) | Unused |
| Longitudinal Position | RV Ahead ($P_{Q2}$) | $Q_2 \times P_{Q2} \times I_{Q2}$ | $Q_2 \times P_{Q2} \times L_{Q2}$ | $Q_2 \times P_{Q2} \times R_{Q2}$ | 0 |
| | RV Adjacent ($A_{Q2}$) | $Q_2 \times A_{Q2} \times I_{Q2}$ | $Q_2 \times A_{Q2} \times L_{Q2}$ | $Q_2 \times A_{Q2} \times R_{Q2}$ | 0 |
| | RV Behind ($B_{Q2}$) | $Q_2 \times B_{Q2} \times I_{Q2}$ | $Q_2 \times B_{Q2} \times L_{Q2}$ | $Q_2 \times B_{Q2} \times R_{Q2}$ | 0 |
| | Unused | 0 | 0 | 0 | 0 |

| $Q_3$ | | | | | |
|---|---|---|---|---|---|
| | | | Lateral Position | | |
| | | RV in lane ($I_{Q3}$) | RV Left ($L_{Q3}$) | RV Right ($R_{Q3}$) | Unused |
| Longitudinal Position | RV Ahead ($P_{Q3}$) | $Q_3 \times P_{Q3} \times I_{Q3}$ | $Q_3 \times P_{Q3} \times L_{Q3}$ | $Q_3 \times P_{Q3} \times R_{Q3}$ | 0 |
| | RV Adjacent ($A_{Q3}$) | $Q_3 \times A_{Q3} \times I_{Q3}$ | $Q_3 \times A_{Q3} \times L_{Q3}$ | $Q_3 \times A_{Q3} \times R_{Q3}$ | 0 |
| | RV Behind ($B_{Q3}$) | $Q_3 \times B_{Q3} \times I_{Q3}$ | $Q_3 \times B_{Q3} \times L_{Q3}$ | $Q_3 \times B_{Q3} \times R_{Q3}$ | 0 |
| | Unused | 0 | 0 | 0 | 0 |

| $Q_4$ | | | | | |
|---|---|---|---|---|---|
| | | | Lateral Position | | |
| | | RV in lane ($I_{Q4}$) | RV Left ($L_{Q4}$) | RV Right ($R_{Q4}$) | Unused |
| Longitudinal Position | RV Ahead ($P_{Q4}$) | $Q_4 \times P_{Q4} \times I_{Q4}$ | $Q_4 \times P_{Q4} \times L_{Q4}$ | $Q_4 \times P_{Q4} \times R_{Q4}$ | 0 |
| | RV Adjacent ($A_{Q4}$) | $Q_4 \times A_{Q4} \times I_{Q4}$ | $Q_4 \times A_{Q4} \times L_{Q4}$ | $Q_4 \times A_{Q4} \times R_{Q4}$ | 0 |
| | RV Behind ($B_{Q4}$) | $Q_4 \times B_{Q4} \times I_{Q4}$ | $Q_4 \times B_{Q4} \times L_{Q4}$ | $Q_4 \times B_{Q4} \times R_{Q4}$ | 0 |
| | Unused | 0 | 0 | 0 | 0 |

The longitudinal relative position bits XW and the lateral relative position bits VU for the relative position code are defined as follows:

| | | VU | | | |
|---|---|---|---|---|---|
| | | 00 | 01 | 10 | 11 |
| XW | 00 | 0000 | 0001 | 0010 | 0011 |
| | 01 | 0100 | 0101 | 0110 | 0111 |
| | 10 | 1000 | 1001 | 1010 | 1011 |
| | 11 | 1100 | 1101 | 1110 | 1111 |

Bits X through U are generated using the following array of expressions.

| X | w | v | u |
|---|---|---|---|
| $x_1 = 0$ | $w_1 = 0$ | $v_1 = 0$ | $u_1 = 0$ |
| $x_2 = 0$ | $w_2 = 0$ | $v_2 = 0$ | $u_2 = \sum_{i=1}^{4} Q_i \times P_{Q_i} \times L_{Q_i} \times 1$ |
| $x_3 = 0$ | $w_3 = 0$ | $v_3 = \sum_{i=1}^{4} Q_i \times P_{Q_i} \times R_{Q_i} \times 1$ | $u_3 = 0$ |
| $x_4 = 0$ | $w_4 = \sum_{i=1}^{4} Q_i \times A_{Q_i} \times I_{Q_i} \times 1$ | $v_4 = 0$ | $u_4 = 0$ |
| $x_5 = 0$ | $w_5 = \sum_{i=1}^{4} Q_i \times A_{Q_i} \times L_{Q_i} \times 1$ | $v_5 = 0$ | $u_5 = \sum_{i=1}^{4} Q_i \times A_{Q_i} \times L_{Q_i} \times 1$ |
| $x_6 = 0$ | $w_6 = \sum_{i=1}^{4} Q_i \times A_{Q_i} \times R_{Q_i} \times 1$ | $v_6 = \sum_{i=1}^{4} Q_i \times A_{Q_i} \times R_{Q_i} \times 1$ | $u_6 = 0$ |
| $x_7 = \sum_{i=1}^{4} Q_i \times B_{Q_i} \times I_{Q_i} \times 1$ | $w_7 = 0$ | $v_7 = 0$ | $u_7 = 0$ |
| $x_8 = \sum_{i=1}^{4} Q_i \times B_{Q_i} \times I_{Q_i} \times 1$ | $w_8 = 0$ | $v_8 =$ | $u_8 = \sum_{i=1}^{4} Q_i \times B_{Q_i} \times L_{Q_i} \times 1$ |
| $x_9 = \sum_{i=1}^{4} Q_i \times B_{Q_i} \times R_{Q_i} \times 1$ | $w_9 = 0$ | $v_9 = \sum_{i=1}^{4} Q_i \times B_{Q_i} \times R_{Q_i} \times 1$ | $u_9 = 0$ |

$$X = \sum_{i=1}^{9} x_i$$

$$W = \sum_{i=1}^{9} w_i$$

$$V = \sum_{i=1}^{9} v_i$$

$$U = \sum_{i=1}^{9} u_i$$

Elevation

The elevation component of relative position is provided by the following three expressions.

If the host vehicle 10 and the remote vehicle 14 are at the same elevation, $$Z_1 = \frac{1}{4}\left[\frac{\varepsilon - (z_{HV} - z_{RV}) + \sigma}{|\varepsilon - (z_{HV} - z_{RV})| + \sigma} + 1\right] \times \left[\frac{\varepsilon - (z_{RV} - z_{HV}) - \sigma}{|\varepsilon - (z_{RV} - z_{HV})| + \sigma} + 1\right] = 1(TS = 00)$$

If the *HV* is lower, $$Z_2 = \frac{1}{2}\left[\frac{(z_{RV} - z_{HV}) - \varepsilon - \sigma}{|(z_{RV} - z_{HV}) - \varepsilon| + \sigma} + 1\right] = 1(TS = 01)$$

If the host vehicle 10 is higher, $$Z_3 = \frac{1}{2}\left[\frac{(z_{HV} - z_{RV}) - \varepsilon - \sigma}{|(z_{HV} - z_{RV}) - \varepsilon| + \sigma} + 1\right] = 1(TS = 10)$$

where:

$z_{HV}$=HV elevation $z_{RV}$=RV elevation

ε=a defined threshold value of distance such as 4 m.

Bits T and S are generated using the following array of expressions.

| t | s |
|---|---|
| $t_1 = Z_1 \times 0$ | $s_1 = Z_1 \times 0$ |
| $t_2 = Z_2 \times 0$ | $s_2 = Z_2 \times 1$ |
| $t_3 = z_3 \times 1$ | $s_3 = Z_3 \times 0$ |

$$T = \sum_{i=1}^{3} t_i$$

$$S = \sum_{i=1}^{3} s_i$$

Remote Vehicle Position Relative to Host Vehicle (Heading)

HV and RV traveling in same direction (RQ=01)

Remote Vehicle Heading angle as a function of Host Vehicle heading angle for the case of following vehicles can be defined as follows:

$$\delta_{RV}=\delta_{HV}$$

However, narrowly defining $\delta_{RV}$ to be exactly the same as $\delta_{HV}$ would result in a condition where the two vehicles would almost never be classified as heading in the same direction when in reality this condition is a very common occurrence. In order to account for small differences in heading angles, a variable $\varphi_2$ is used to define a range of heading angles for the RV in which the RV would be considered to be heading in the same direction as the HV. To define this range, the following expressions are defined:

Minimum RV heading angle

If $\sigma_{RV}-\varphi_2<0$ then $\delta_{RV_{min}}{}^{01}=2\pi+\delta_{RV}-\varphi_2$ If $\delta_{RV}-\varphi_2\geq 0$ then $\delta_{RV_{min}}{}^{01}=\delta_{RV}-\varphi_2$ These conditions can be combined into one mathematical expression as:

$$\delta_{RV_{min}}{}^{01}=\zeta_{min_1}\times(2\pi+\delta_{RV}-\varphi_2)+\zeta_{min_1}\times(\delta_{RV}-\varphi_2)$$

where:

$$\zeta_{min_1}=\frac{1}{2}\left[\frac{0-(\delta_{RV}-\varphi_2)-\sigma}{|0-(\delta_{RV}-\varphi_2)|+\sigma}+1\right]$$

$$\zeta_{min_2}=\frac{1}{2}\left[\frac{(\delta_{RV}-\varphi)-0+\sigma}{|(\delta_{RV}-\varphi)-0|+\sigma}+1\right]$$

These expressions have two values, 0 or 1 depending on the value of $\delta_{RV}$ and can be thought of as filtering functions that ensure the appropriate expression is used to calculate the value of $\delta_{RV_{min}}{}^{01}$.

Maximum RV heading angle

If $\delta_{RV}+\varphi<2\pi$ then $\delta_{RV_{max}}{}^{01}=\delta_{RV}+\varphi_2$ If $\delta_{RV}+\varphi\geq 2\pi$ then $\delta_{RV_{max}}{}^{01}=\delta_{RV}+\varphi_2-2\pi$ These conditions can be combined into one mathematical expression as:

$$\delta_{RV_{max}}{}^{01}=\zeta_{max_1}\times(\delta_{RV}+\varphi_2)+\zeta_{max_2}\times(\delta_{RV}+\varphi_2-2\pi)$$

where:

$$\zeta_{max_1}=\frac{1}{2}\left[\frac{2\pi-(\delta_{RV}+\varphi_2)-\sigma}{|2\pi-(\delta_{RV}+\varphi_2)|+\sigma}+1\right]$$

$$\zeta_{max_2}=\frac{1}{2}\left[\frac{(\delta_{RV}+\varphi_2)-2\pi+\sigma}{|(\delta_{RV}+\varphi_2)-2\pi|+\sigma}+1\right]$$

These expressions have two values, 0 or 1 depending on the value of $\delta_{RV}$ and can be thought of as filtering functions that ensure the appropriate expression is used to calculate the value of $\delta_{RV_{max}}{}^{01}$.

The remote vehicle 14 is considered to be traveling in the same direction as the host vehicle 10 when the heading angle of the remote vehicle 14, $\delta_{RV}$ falls within the range $\delta_{RV_{min}}{}^{01}$ and $\delta_{RV_{max}}{}^{01}$ therefore in most cases, the heading angle of the host vehicle 10, $\delta_{HV}$ will be greater than or equal to $\delta_{RV_{min}}{}^{01}$ and less than or equal to $\delta_{RV_{max}}{}^{01}$ otherwise the remote vehicle 14 will be considered to be traveling in a direction other than the same direction of the HV as shown in FIGS. 20-23 which represented $\delta_{RV_{min}}{}^{01}\leq\delta_{HV}<\delta_{RV_{max}}{}^{01}$.

Figure 24:
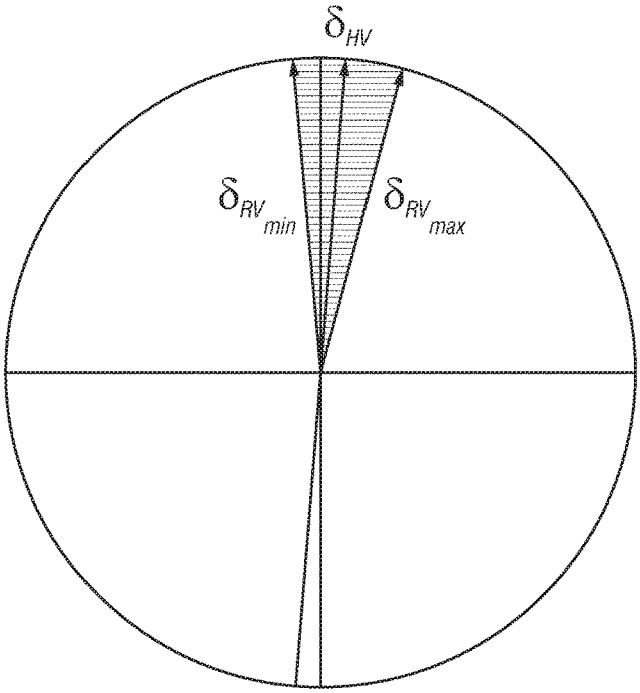
Figure 25:
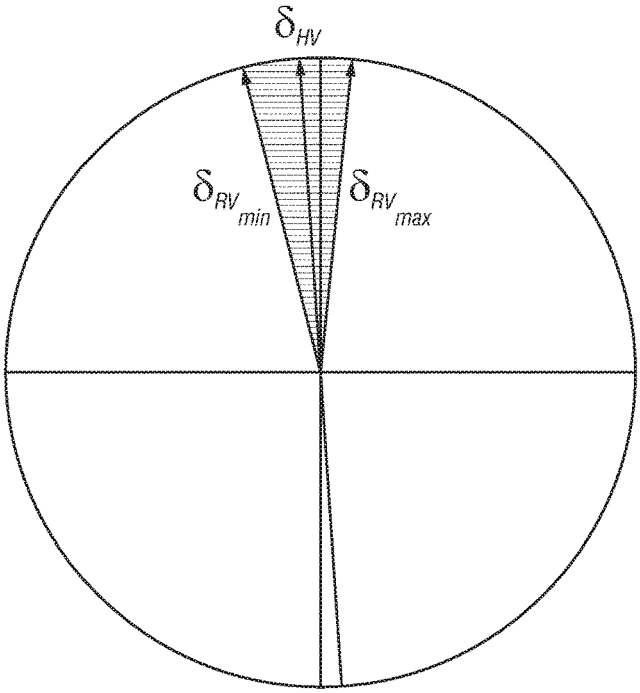

However, because of the fixed reference used where North=0°, there are cases where $\delta_{HV}$ will be less than or equal to $\delta_{RV_{min}}{}^{01}$ and less than or equal to $\delta_{RV_{max}}{}^{01}$ or cases where $\delta_{HV}$ will be greater than or equal to $\delta_{RV_{min}}{}^{01}$ and greater than or equal to $\delta_{RV_{max}}{}^{01}$ such as shown in FIGS. 24 and 25. In FIG. 24, $\delta_{HV}$ less than $\delta_{RV_{min}}{}^{01}$ and less than $\delta_{RV_{max}}{}^{01}$. In FIG. 25, $\delta_{HV}$ greater than $\delta_{RV_{min}}{}^{01}$ and greater than $\delta_{RV_{max}}{}^{01}$.

Consider the following expressions for $H_1$ and $H_2$:

$H_1=\delta_{HV}-\delta_{RV_{min}}{}^{01}$ $H_2=\delta_{HV}-\delta_{RV_{max}}{}^{01}$ For any value of $\delta_{HV}$, the values for $H_1$ and $H_2$ fall within three distinct categories:

1: $H_1$ is negative, $H_2$ is negative and $H_1<H_2$ ($\delta_{HV}<\delta_{RV_{min}}{}^{01}$ and $\delta_{HV}<\delta_{RV_{max}}{}^{01}$)

2: $H_1$ is positive, $H_2$ is negative and $H_1>H_2$ ($\delta_{HV}>\delta_{RV_{min}}{}^{01}$ and $\delta_{HV}<\delta_{RV_{max}}{}^{01}$)

3: $H_1$ is positive, $H_2$ is positive and $H_1<H_2$ ($\delta_{HV}>\delta_{RV_{min}}{}^{01}$ and $\delta_{RV_{max}}{}^{01}$)

From these three conditions, it can be shown that for any combination of $\delta_{HV}$ and $\delta_{RV}$, where $0\leq\delta_{HV}<2\pi$ and $0\leq\delta_{RV}<2\pi$ the following expressions can be used to identify if the HV and RV are traveling in the same direction.

$$\Delta_1^{01}=\frac{1}{8}\left[\frac{\delta_{RV_{min}}^{01}-\delta_{RV}+\sigma}{|\delta_{RV_{min}}^{01}-\delta_{RV}|+\sigma}+1\right]\times\left[\frac{\delta_{RV_{max}}^{01}-\delta_{RV}+\sigma}{|\delta_{RV_{max}}^{01}-\delta_{RV}|+\sigma}+1\right]\times\left[1-\frac{H_1-H_2-\sigma}{|H_1-H_2|+\sigma}\right]$$

If $H_1<H_2$, $\delta_{RV}\leq\Delta_{RV_{min}}^{01}$ and $\delta_{RV}\leq\delta_{RV_{max}}^{01}\Delta_1^{01}=1$ otherwise $\Delta_1^{01}=0$ $$\Delta_2^{01}=\frac{1}{8}\left[\frac{\delta_{RV}-\delta_{RV_{min}}^{01}+\sigma}{|\delta_{RV}-\delta_{RV_{min}}^{01}|+\sigma}+1\right]\times\left[\frac{\delta_{RV_{max}}^{01}-\delta_{RV}+\sigma}{|\delta_{RV_{max}}^{01}-\delta_{RV}|+\sigma}+1\right]\times\left[\frac{H_1-H_2-\sigma}{|H_1-H_2|+\sigma}+1\right]$$

If $H_1>H_2$ and $\delta_{RV_{min}}^{01}\leq\delta_{RV}\leq_{RV_{max}}^{01}$, $\Delta_2^{01}=1$ otherwise $\Delta_2^{01}=0$ $$\Delta_3^{01}=\frac{1}{8}\left[\frac{\delta_{RV}-\delta_{RV_{min}}^{01}+\sigma}{|\delta_{RV}-\delta_{RV_{min}}^{01}|+\sigma}+1\right]\times\left[\frac{\delta_{RV}-\delta_{RV_{max}}^{01}+\sigma}{|\delta_{RV}-\delta_{RV_{max}}^{01}|+\sigma}+1\right]\times\left[1-\frac{H_1-H_2-\sigma}{|H_1-H_2|+\sigma}\right]$$

If $H_1<H_2$ and $\delta_{RV_{min}}{}^{01}\leq\delta_{RV}$ and $\delta_{RV_{max}}{}^{01}\leq\delta_{RV}$ $\Delta_1{}^{01}=1$ otherwise $\Delta_1{}^{01}=0$ Also, it is advantageous to define the difference of $H_1$ and $H_2$ as follows:

$$H_1-H_2=\delta_{RV}-\delta_{RV_{min}}{}^{01}-(\delta_{HV}-\delta_{RV_{max}}{}^{01})$$

$$H_1-H_2=\delta_{HV}-\delta_{RV_{min}}{}^{01}-\delta_{HV}+\delta_{RV_{max}}{}^{01}$$

$$H_1-H_2=\delta_{HV}-\delta_{RV_{min}}{}^{01}-\delta_{HV}+\delta_{RV_{max}}{}^{01}$$

$$H_1-H_2=\delta_{RV_{max}}{}^{01}-\delta_{RV_{min}}{}^{01}$$

Then the previous expressions can be expressed as:

$$\Delta_1^{01}=\frac{1}{8}\left[\frac{\delta_{RV_{min}}^{01}-\delta_{RV}+\sigma}{|\delta_{RV_{min}}^{01}-\delta_{RV}|+\sigma}+1\right]\times\left[\frac{\delta_{RV_{max}}^{01}-\delta_{RV}+\sigma}{|\delta_{RV_{max}}^{01}-\delta_{RV}|+\sigma}+1\right]\times\left[1-\frac{\delta_{RV_{max}}^{01}-\delta_{RV_{\min}}^{01}-\sigma}{|\delta_{RV_{max}}^{01}-\delta_{RV_{\min}}^{01}|+\sigma}\right]$$

$$\Delta_2^{01}=\frac{1}{8}\left[\frac{\delta_{RV}-\delta_{RV_{\min}}^{01}+\sigma}{|\delta_{RV}-\delta_{RV_{min}}^{01}|+\sigma}+1\right]\times$$

-continued $$\left[\frac{\delta^{01}_{RV_{max}} - \delta_{RV} + \sigma}{|\delta^{01}_{RV_{max}} - \delta_{RV}| + \sigma} + 1\right] \times \left[\frac{\delta^{01}_{RV_{max}} - \delta^{01}_{RV_{\min}} - \sigma}{|\delta^{01}_{RV_{max}} - \delta^{01}_{RV_{\min}}| + \sigma} + 1\right]$$

$$\Delta^{01}_3 = \frac{1}{8}\left[\frac{\delta_{RV} - \delta^{01}_{RV_{\min}} + \sigma}{|\delta_{RV} - \delta^{01}_{RV_{min}}| + \sigma} + 1\right] \times \left[\frac{\delta_{RV} - \delta^{01}_{RV_{max}} + \sigma}{|\delta_{RV} - \delta^{01}_{RV_{max}}| + \sigma} + 1\right] \times \left[-1\frac{\delta^{01}_{RV_{max}} - \delta^{01}_{RV_{\min}} - \sigma}{|\delta^{01}_{RV_{max}} - \delta^{01}_{RV_{\min}}| + \sigma}\right]$$

If the sum of these three expressions is equal to 1, the host vehicle 10 and the remote vehicle 14 are traveling in the same direction. This condition is expressed mathematically as:

$$\sum_{i=1}^{3} \Delta^{01}_i = 1(RQ = 01)$$

thus:

$$r_1 = \sum_{i=1}^{3} \Delta^{01}_i \times 0$$

$$q_1 = \sum_{i=1}^{3} \Delta^{01}_i \times 1$$

Host Vehicle and Remote Vehicle approaching either other from opposite directions (RQ=10):

Remote Vehicle Heading angle as a function of Host Vehicle heading angle for the case of on-coming vehicles can be defined as follows:

$$\delta_{RV} = \frac{1}{2}\left[\frac{\delta_{HV} - \pi - \sigma}{|\delta_{HV} - \pi| + \sigma} + 1\right] \times (\delta_{HV} - \pi) + \frac{1}{2}\left[\frac{\pi - \delta_{HV} - \sigma}{|\pi - \delta_{HV}| + \sigma} + 1\right] \times (\delta_{HV} + \pi)$$

However, narrowly defining $\delta_{RV}$ to be exactly opposite of $\delta_{HV}$ would result in a condition where the two vehicles would almost never be classified as heading in opposite direction when in reality this condition is a very common occurrence. In order to account for small differences in heading angles, the variable $\varphi_2$ is used to define a range a range of heading angles for the RV in which the RV would be considered to be heading in the opposite direction of the HV. To define this range, the following expressions are defined:

Minimum RV heading angle:

If $\delta_{RV}-\varphi_2<0$ then $\delta_{RV_{min}}{}^{10}=2\pi+\delta_{RV}-\varphi_2$ If $\delta_{RV}-\varphi_2\geq 0$ then $\delta_{RV_{min}}{}^{10}=\delta_{RV}-\varphi_2$ These conditions can be combined into one mathematical expression as:

$$\delta_{RV_{min}}{}^{10}=\zeta_{min_1}\times(2\pi-\delta_{RV}-\varphi_2)+\zeta_{min_1}\times(\delta_{RV}-\varphi_2)$$

where:

$$\zeta_{min_1} = \frac{1}{2}\left[\frac{0 - (\delta_{RV} - \varphi_2) - \sigma}{|0 - (\delta_{RV} - \varphi_2)| + \sigma} + 1\right]$$

$$\zeta_{min_2} = \frac{1}{2}\left[\frac{(\delta_{RV} - \varphi_2) - 0 + \sigma}{|(\delta_{RV} - \varphi_2) - 0| + \sigma} + 1\right]$$

These expressions have two values, 0 or 1 depending on the value of $\delta_{RV}$ and can be thought of as filtering functions that ensure the appropriate expression is used to calculate the value of $\delta_{RV_{min}}{}^{10}$.

Maximum RV heading angle

If $\delta_{RV}+\varphi_2<2\pi$ then $\delta_{RV_{min}}{}^{10}=\delta_{RV}+\varphi_2$ If $\delta_{RV}+\varphi_2\geq 2\pi$ then $\delta_{RV_{max}}{}^{10}=\delta_{RV}+\varphi_2-2\pi$ These conditions can be combined into one mathematical expression as:

$$\delta_{RV_{max}}{}^{10}=\zeta_{max_1}\times(\delta_{RV}+\varphi_2)+\zeta_{max_2}\times(\delta_{RV}+\varphi_2-2\pi$$

where:

$$\zeta_{max_1} = \frac{1}{2}\left[\frac{2\pi - (\delta_{RV} + \varphi_2) - \sigma}{|2\pi - (\delta_{RV} + \varphi_2)| + \sigma} + 1\right]$$

$$\zeta_{max_2} = \frac{1}{2}\left[\frac{(\delta_{RV} + \varphi_2) - 2\pi + \sigma}{|(\delta_{RV} + \varphi_2) - 2\pi| + \sigma} + 1\right]$$

These expressions have two values, 0 or 1 depending on the value of $\delta_{RV}$ and can be thought of as filtering functions that ensure the appropriate expression is used to calculate the value of $\delta_{RV_{max}}{}^{10}$.

Figure 26:
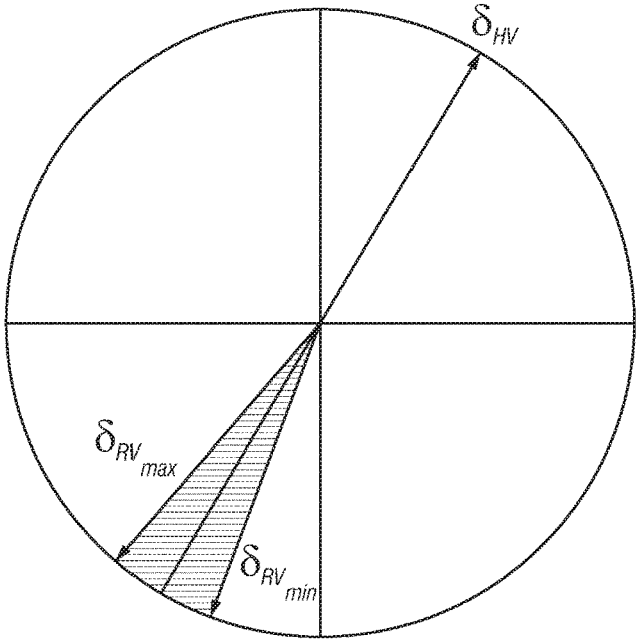
Figure 27:
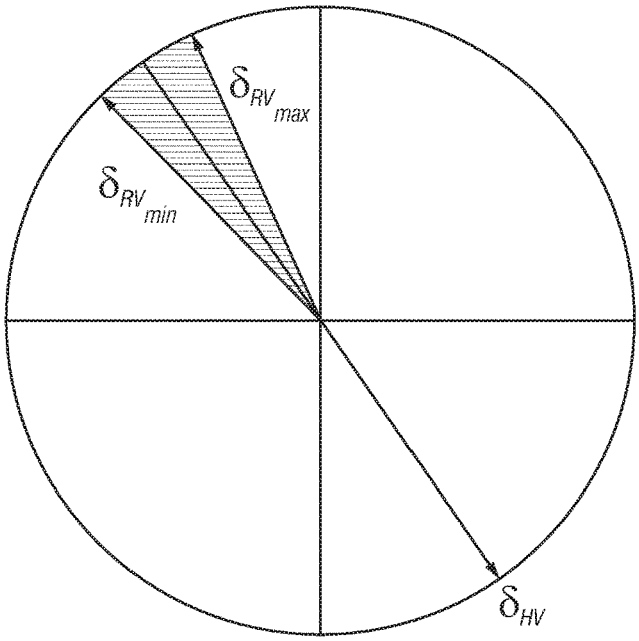

The remote vehicle 14 is considered to be traveling in the direction opposite of the host vehicle 10 when the heading angle of the remote vehicle 14, $\delta_{RV}$ falls within the range $\delta_{RV_{min}}{}^{10}$ and $\delta_{RV_{max}}{}^{10}$ therefore cases exist where the heading angle of the host vehicle 10, $\delta_{HV}$ will be less than $\delta_{RV_{min}}{}^{10}$ and less than $\delta_{RV_{min}}{}^{10}$ when $\delta_{HV}$ is less than $\pi$ as shown in FIGS. 26 and 27 where $\delta_{HV}$ less than $\pi$ and less than $\delta_{RV_{min}}{}^{10}$ and $\delta_{RV_{max}}{}^{10}$.

Figure 28:
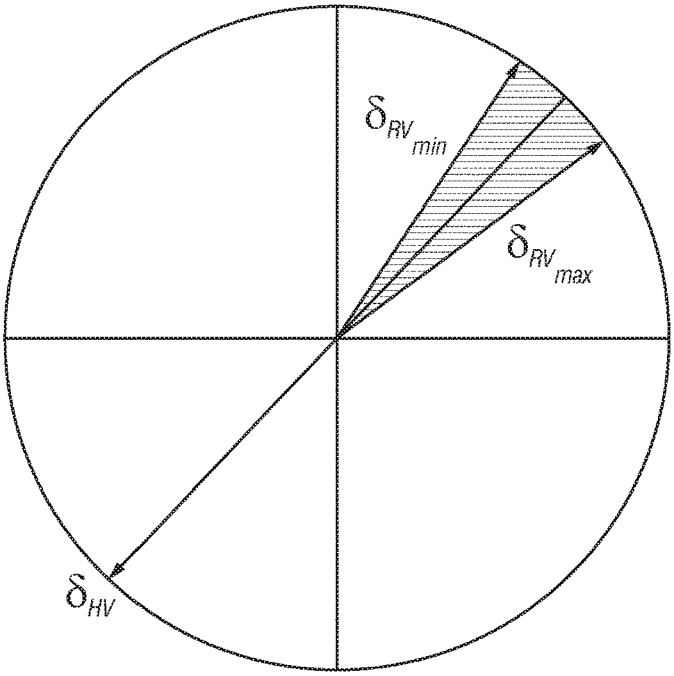
Figure 29:
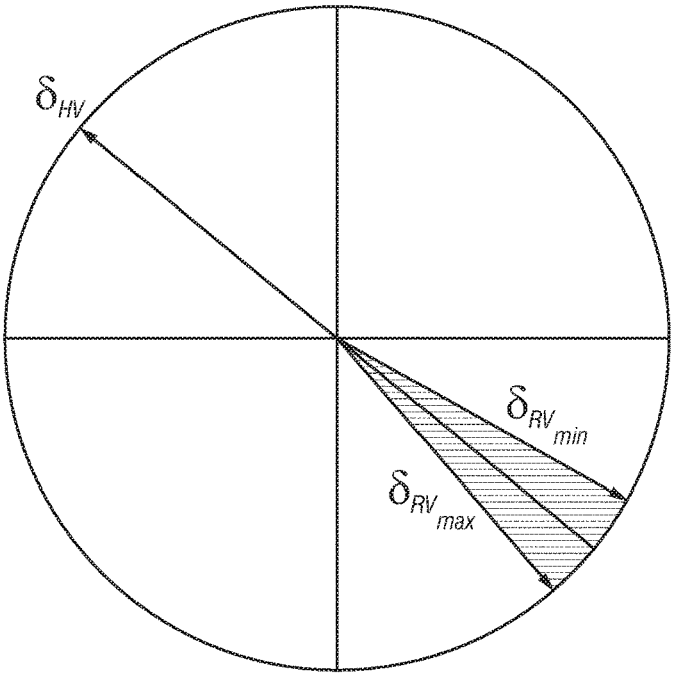

There also exist cases where $\delta_{HV}$ will be greater than $\delta_{RV_{min}}{}^{10}$ and greater than $\delta_{RV_{max}}{}^{10}$ when $\delta_{HV}$ is greater than $\pi$ otherwise the RV will be considered to be traveling in a direction other than the opposite direction of the HV as shown in FIGS. 28 and 29 where $\delta_{HV}$ greater than $\pi$ and greater than SRS and $\delta_{RV_{min}}{}^{10}$ and $\delta_{RV_{max}}{}^{10}$.

Figure 30:
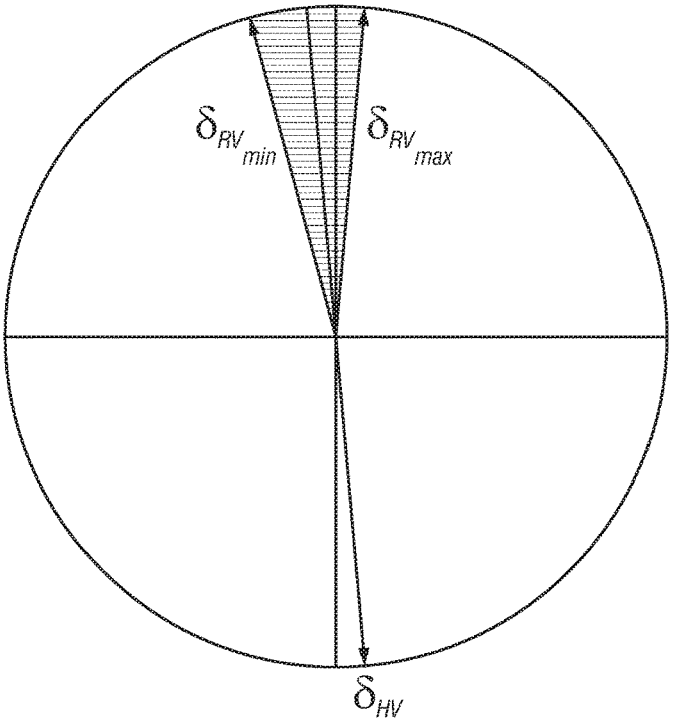
Figure 31:
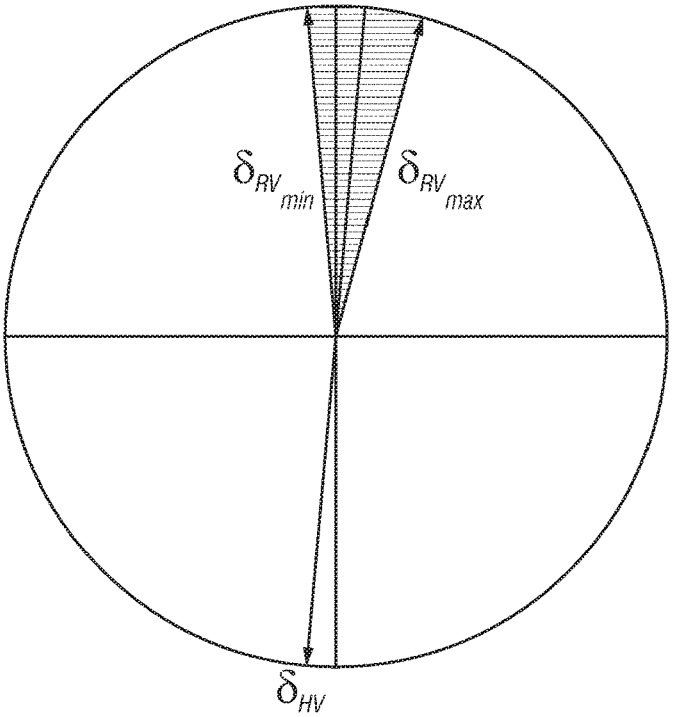

However, because of the fixed reference used where North=0°, there are cases where $\delta_{HV}$ will be less than $\delta_{RV_{min}}{}^{10}$ and greater than $\delta_{RV_{max}}{}^{10}$ when $\delta_{HV}$ is less than or greater than $\pi$ such as shown in FIGS. 30 and 31. FIG. 30, $\delta_{HV}<\pi$ and $\delta_{RV_{max}}{}^{10}<\delta_{HV}<\delta_{HV}<\delta_{RV_{min}}{}^{10}$ and in FIG. 31, $\delta_{HV}>\pi$ and $\delta_{RV_{max}}{}^{10}<\delta_{HV}<\delta_{RV_{min}}{}^{10}$.

Consider the following expressions for $H_1$ and $H_2$.

$H_1=\delta_{HV}-\delta_{RV_{min}}{}^{10}$ $H_2=\delta_{HV}-\delta_{RV_{max}}{}^{10}$ For any value of $\delta_{HV}$, the values for $H_1$ and $H_2$ fall within three distinct categories:

1: $H_1$ is negative, $H_2$ is negative and $H_1>H_2$ ($\delta_{HV}<\delta_{RV_{min}}{}^{10}$ and $\delta_{HV}<\delta_{RV_{max}}{}^{10}$)

2: $H_1$ is negative, $H_2$ is positive and $H_1<H_2$ ($\delta_{HV}<\delta_{RV_{min}}{}^{10}$ and $\delta_{HV}>\delta_{RV_{max}}{}^{10}$)

3: $H_1$ is positive, $H_2$ is positive and $H_1>H_2$ ($\delta_{HV}>\delta_{RV_{min}}{}^{1}$ and $\delta_{HV}>\delta_{RV_{max}}{}^{10}$)

From these three conditions, it can be shown that for any combination of $\delta_{HV}$ and $\delta_{RV}$, where $0\leq\delta_{HV}<2\pi$ and $0\leq\delta_{RV}<2\pi$ the following expressions can be used to identify if the host vehicle 10 and the remote vehicle 14 are traveling in opposite directions.

$$\Delta^{10}_1 = \frac{1}{8}\left[\frac{\delta_{RV} - \delta^{10}_{RV_{min}} + \sigma}{|\delta_{RV} - \delta^{10}_{RV_{min}}| + \sigma} + 1\right] \times$$

-continued $$\left[\frac{\delta^{10}_{RV_{max}}-\delta_{RV}+\sigma}{|\delta^{10}_{RV_{max}}-\delta_{RV}|+\sigma}+1\right]\times\left[\frac{H_1-H_2-\sigma}{|H_1-H_2|+\sigma}+1\right]$$

If $H_1 > H_2$ and $\delta^{10}_{RV_{min}} \le \delta_{RV} \le \delta^{10}_{RV_{max}}$, $\Delta^{10}_1 = 1$ otherwise $\Delta^{10}_1 = 0$ $$\Delta^{10}_2 = \frac{1}{8}\left[\frac{\delta_{RV}-\delta^{10}_{RV_{min}}+\sigma}{|\delta_{RV}-\delta^{10}_{RV_{min}}|+\sigma}+1\right]\times\left[\frac{\delta_{RV}-\delta^{10}_{RV_{max}}+\sigma}{|\delta_{RV}-\delta^{10}_{RV_{max}}|+\sigma}+1\right]\times\left[1-\frac{H_1-H_2-\sigma}{|H_1-H_2|+\sigma}\right]$$

If $H_1 < H_2$, $\delta^{10}_{RV_{min}} \le \delta_{RV}$ and $\delta^{10}_{RV_{max}} \le \delta_{RV}$, $\Delta^{10}_2 = 1$ otherwise $\Delta^{10}_2 = 0$ $$\Delta^{10}_3 = \frac{1}{8}\left[\frac{\delta^{10}_{RV_{min}}-\delta_{RV}+\sigma}{|\delta^{10}_{RV_{min}}-\delta_{RV}|+\sigma}+1\right]\times\left[\frac{\delta^{10}_{RV_{max}}-\delta_{RV}+\sigma}{|\delta^{10}_{RV_{max}}-\delta_{RV}|+\sigma}+1\right]\times\left[1-\frac{H_1-H_2-\sigma}{|H_1-H_2|+\sigma}\right]$$

If $H_1 < H_2$, $\delta_{RV} \le \delta^{10}_{RV_{min}}$ and $\delta_{RV} \le \delta^{10}_{RV_{max}}$, $\Delta^{10}_3 = 1$ otherwise $\Delta^{10}_3 = 0$ Also, it is advantageous to define the difference of $H_1$ and $H_2$ as follows:

$$H_1-H_2=\delta_{HV}-\delta_{RV_{min}}{}^{10}-(\delta_{HV}-\delta_{RV_{max}}{}^{10})$$

$$H_1-H_2=\delta_{HV}-\delta_{RV_{min}}{}^{10}-\delta_{HV}+\delta_{RV_{max}}{}^{10}$$

$$H_1-H_2=\delta_{HV}-\delta_{RV_{min}}{}^{10}-\delta_{HV}+\delta_{RV_{max}}{}^{10}$$

$$H_1-H_2=\delta_{RV_{max}}{}^{10}-\delta_{RV_{min}}{}^{10}$$

Then the previous expressions can be expressed as:

$$\Delta^{10}_1 = \frac{1}{8}\left[\frac{\delta_{RV}-\delta^{10}_{RV_{min}}+\sigma}{|\delta_{RV}-\delta^{10}_{RV_{min}}|+\sigma}+1\right]\times\left[\frac{\delta^{10}_{RV_{max}}-\delta_{RV}+\sigma}{|\delta^{10}_{RV_{max}}-\delta_{RV}|+\sigma}+1\right]\times\left[\frac{\delta^{10}_{RV_{max}}-\delta^{10}_{RV_{min}}-\sigma}{|\delta^{10}_{RV_{max}}-\delta^{10}_{RV_{min}}|+\sigma}+1\right]$$

$$\Delta^{10}_2 = \frac{1}{8}\left[\frac{\delta_{RV}-\delta^{10}_{RV_{min}}+\sigma}{|\delta_{RV}-\delta^{10}_{RV_{min}}|+\sigma}+1\right]\times\left[\frac{\delta_{RV}-\delta^{10}_{RV_{max}}+\sigma}{|\delta_{RV}-\delta^{10}_{RV_{max}}|+\sigma}+1\right]\times\left[1-\frac{\delta^{10}_{RV_{max}}-\delta^{10}_{RV_{min}}-\sigma}{|\delta^{10}_{RV_{max}}-\delta^{10}_{RV_{min}}|+\sigma}\right]$$

$$\Delta^{10}_3 = \frac{1}{8}\left[\frac{\delta^{10}_{RV_{min}}-\delta_{RV}+\sigma}{|\delta^{10}_{RV_{min}}-\delta_{RV}|+\sigma}+1\right]\times\left[\frac{\delta^{10}_{RV_{max}}-\delta_{RV}+\sigma}{|\delta^{10}_{RV_{max}}-\delta_{RV}|+\sigma}+1\right]\times\left[1-\frac{\delta^{10}_{RV_{max}}-\delta^{10}_{RV_{min}}-\sigma}{|\delta^{10}_{RV_{max}}-\delta^{10}_{RV_{min}}|+\sigma}\right]$$

By summing these three expressions, it can be determined that the host vehicle 10 and the remote vehicle 14 are approaching each other from opposite directions if:

$$\sum_{i=1}^{3}\Delta^{10}_i = 1(RQ = 10)$$

Thus:

$$r_2 = \sum_{i=1}^{3}\Delta^{10}_i \times 1$$

-continued $$q_2 = \sum_{i=1}^{3}\Delta^{10}_i \times 0$$

Host Vehicle and Remote Vehicle approaching from crossing directions (RQ=11)

When the remote vehicle 14 and the host vehicle 10 approach each other from directions that result in a crossing path, the remove vehicle heading angle, $\delta_{RV}$ can be defined as a function of host vehicle heading angle, $\delta_{HV}$ according to the following expressions. Since a crossing path can occur if the remote vehicle 14 approaches from the left or right, a total of four angles must be defined; minimum and maximum angles for the left and minimum and maximum angle for the right. If $\delta_{RV}$ falls within the two ranges, a crossing path exists.

Remote Vehicle Heading angle as a function of Host Vehicle heading angle for the case of vehicles crossing paths can be defined as follows:

Minimum RV heading angle $$\delta^{11}_{RV_{min\ L}} = \frac{1}{4}\left[\frac{\delta_{HV}-0+\sigma}{|\delta_{HV}-0|+\sigma}+1\right]\times\left[\frac{\varphi_6-\delta_{HV}-\sigma}{|\varphi_6-\delta_{HV}|+\sigma}+1\right]\times(\delta_{HV}+\varphi_3)+\frac{1}{4}\left[\frac{\delta_{HV}-\varphi_6+\sigma}{|\delta_{HV}-\varphi_6|+\sigma}\right]\times\left[\frac{2\pi-\delta_{HV}-\sigma}{|2\pi-\delta_{HV}|+\sigma}+1\right]\times(\delta_{HV}-\varphi_6)$$

$$\delta^{11}_{RV_{min\ R}} = \frac{1}{4}\left[\frac{\delta_{HV}-0+\sigma}{|\delta_{HV}-0|+\sigma}+1\right]\times\left[\frac{\varphi_4-\delta_{HV}-\sigma}{|\varphi_4-\delta_{HV}|+\sigma}+1\right]\times(\delta_{HV}+\varphi_5)+\frac{1}{4}\left[\frac{\delta_{HV}-\varphi_4+\sigma}{|\delta_{HV}-\varphi_4|+\sigma}\right]\times\left[\frac{2\pi-\delta_{HV}-\sigma}{|2\pi-\delta_{HV}|+\sigma}+1\right]\times(\delta_{HV}-\varphi_4)$$

Maximum RV heading angle $$\delta^{11}_{RV_{max\ L}} = \frac{1}{4}\left[\frac{\delta_{HV}-0+\sigma}{|\delta_{HV}-0|+\sigma}+1\right]\times\left[\frac{\varphi_5-\delta_{HV}-\sigma}{|\varphi_5-\delta_{HV}|+\sigma}+1\right]\times(\delta_{HV}+\varphi_4)+\frac{1}{4}\left[\frac{\delta_{HV}-\varphi_5+\sigma}{|\delta_{HV}-\varphi_5|+\sigma}\right]\times\left[\frac{2\pi-\delta_{HV}-\sigma}{|2\pi-\delta_{HV}|+\sigma}+1\right]\times(\delta_{HV}-\varphi_5)$$

$$\delta^{11}_{RV_{max\ R}} = \frac{1}{4}\left[\frac{\delta_{HV}-0+\sigma}{|\delta_{HV}-0|+\sigma}+1\right]\times\left[\frac{\varphi_3-\delta_{HV}-\sigma}{|\varphi_3-\delta_{HV}|+\sigma}+1\right]\times(\delta_{HV}+\varphi_6)+\frac{1}{4}\left[\frac{\delta_{HV}-\varphi_3+\sigma}{|\delta_{HV}-\varphi_3|+\sigma}\right]\times\left[\frac{2\pi-\delta_{HV}-\sigma}{|2\pi-\delta_{HV}|+\sigma}+1\right]\times(\delta_{HV}-\varphi_3)$$

where:

$\varphi_3=\pi/2-\varphi_L$ $\varphi_4=\pi/2+\varphi_L$ $\varphi_5=3\pi/2-\varphi_R$ $\varphi_6=3\pi/2+\varphi_R$ $\varphi_L$ and $\varphi_R$ are threshold values that defines the angular range in which the remote vehicle 14 is defined to be in a crossing path with the host vehicle 10.

These variables define the minimum and maximum boundaries for the range of $\delta_{RV}$ with respect to $\delta_{HV}$ for crossing paths values of $\delta_{RV}$ that fall outside these ranges are considered to be another condition such as in-path, opposite path or diverging path. The direction, left or right from which the RV is approaching is immaterial but a single equation for $\delta_{RV_{min}}{}^{11}$ and $\delta_{RV_{max}}{}^{11}$ is desired. This can be achieved by the following two equations:

$$\delta^{11}_{RV_{min}} = \delta^{11}_{RV_{min\,L}} \times \frac{1}{2}\left[\frac{L_{Q_1}+L_{Q_2}-\sigma}{|L_{Q_1}+L_{Q_2}|+\sigma}+1\right] + \delta^{11}_{RV_{min\,R}} \times \frac{1}{2}\left[\frac{R_{Q_1}+R_{Q_2}-\sigma}{|R_{Q_1}+R_{Q_2}|+\sigma}+1\right]$$

$$\delta^{11}_{RV_{max}} = \delta^{11}_{RV_{max\,L}} \times \frac{1}{2}\left[\frac{L_{Q_1}+L_{Q_2}-\sigma}{|L_{Q_1}+L_{Q_2}|+\sigma}+1\right] + \delta^{11}_{RV_{max\,R}} \times \frac{1}{2}\left[\frac{R_{Q_1}+R_{Q_2}-\sigma}{|R_{Q_1}+R_{Q_2}|+\sigma}+1\right]$$

where $$L_{Q_1} = L_{Q_4} = \frac{1}{4}\left[\frac{\delta_{HV}-A_6+\sigma}{|\delta_{HV}-A_6|+\sigma}+1\right]\times\left[\frac{A_7-\delta_{HV}-\sigma}{|A_7-\delta_{HV}|+\sigma}+1\right]$$

$$L_{Q_2} = L_{Q_3} = \frac{1}{4}\left[\frac{\delta_{HV}-0+\sigma}{|\delta_{HV}-0|+\sigma}+1\right]\times\left[\frac{A_{13}-\delta_{HV}-\sigma}{|A_{13}-\delta_{HV}|+\sigma}+1\right] + \frac{1}{4}\left[\frac{\delta_{HV}-A_{16}+\sigma}{|\delta_{HV}-A_{16}|+\sigma}+1\right]\times\left[\frac{2\pi-\delta_{HV}-\sigma}{|2\pi-\delta_{HV}|+\sigma}+1\right]$$

$$R_{Q_1} = L_{Q_4} = \frac{1}{4}\left[\frac{\delta_{HV}-0+\sigma}{|\delta_{HV}-0|+\sigma}+1\right]\times\left[\frac{A_5-\delta_{HV}-\sigma}{|A_5-\delta_{HV}|+\sigma}+1\right] + \frac{1}{4}\left[\frac{\delta_{HV}-A_8+\sigma}{|\delta_{HV}-A_8|+\sigma}+1\right]\times\left[\frac{2\pi-\delta_{HV}-\sigma}{|2\pi-\delta_{HV}|+\sigma}+1\right]$$

$$R_{Q_2} = R_{Q_3} = \frac{1}{4}\left[\frac{\delta_{HV}-A_{14}+\sigma}{|\delta_{HV}-A_{14}|+\sigma}+1\right]\times\left[\frac{A_{15}-\delta_{HV}-\sigma}{|A_{15}-\delta_{HV}|+\sigma}+1\right]$$

and:

$A_5=\beta_1-\varphi_2$ $A_6=\beta_1+\varphi_2$ $A_7=\beta_1+\pi-\varphi_2$ $A_8=\beta_1+\pi+\varphi_2$ $A_{13}=\beta_1-\pi-\varphi_2$ $A_{14}=\beta_1-\pi+\varphi_2$ $A_{15}=\beta_1-\varphi_2$ $A_{16}=\beta_1+\varphi_2$ The remote vehicle 14 is considered to be in a crossing path with the host vehicle 10 when the heading angle of the remote vehicle 14, $\delta_{RV}$ falls within the range $\delta_{RV_{min}}{}^{11}$ and $\delta_{RV_{max}}{}^{11}$ as defined above. When the remote vehicle 14 is approaching from the left, there are three regions that need to be considered:

$$0 \le \delta_{HV} < \frac{3\pi}{2}-\varphi_L \rightarrow \begin{cases}\delta_{HV} < \delta^{11}_{RV_{min}}\\ \delta_{HV} < \delta^{11}_{RV_{max}}\end{cases}$$

$$\frac{3\pi}{2}-\varphi_L \le \delta_{HV} < \frac{3\pi}{2}+\varphi_L \rightarrow \begin{cases}\delta_{HV} < \delta^{11}_{RV_{min}}\\ \delta_{HV} > \delta^{11}_{RV_{max}}\end{cases}$$

$$\frac{3\pi}{2}+\varphi_L \le \delta_{HV} < 2\pi \rightarrow \begin{cases}\delta_{HV} > \delta^{11}_{RV_{min}}\\ \delta_{HV} > \delta^{11}_{RV_{max}}\end{cases}$$

Figure 32:
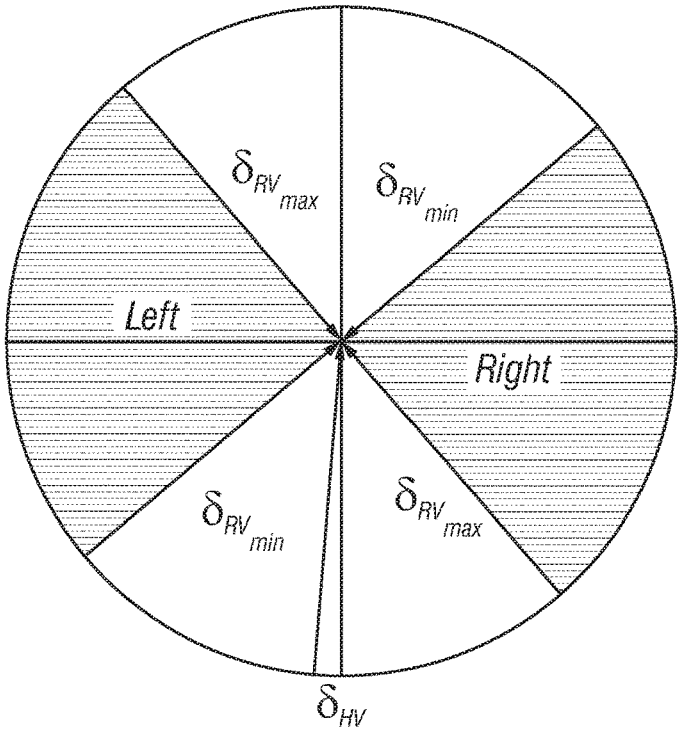
Figure 33:
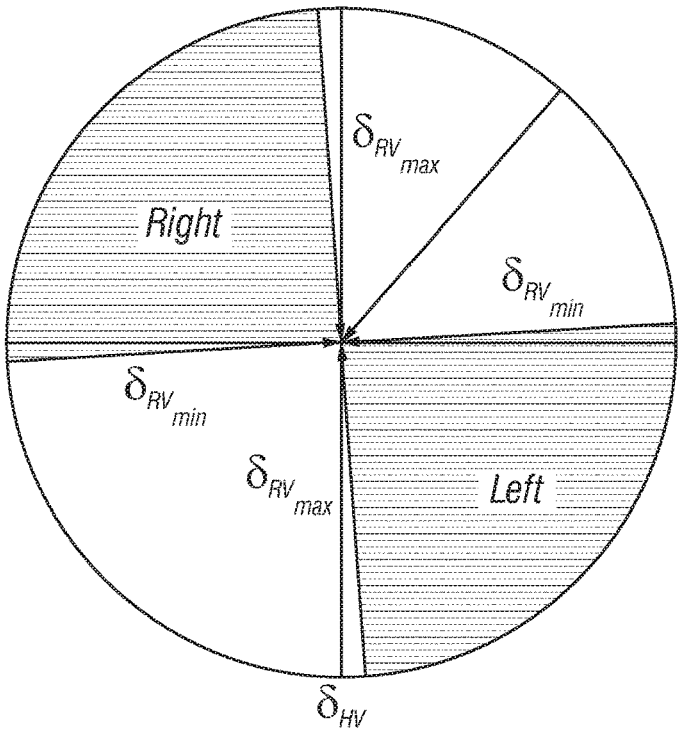
Figure 34:
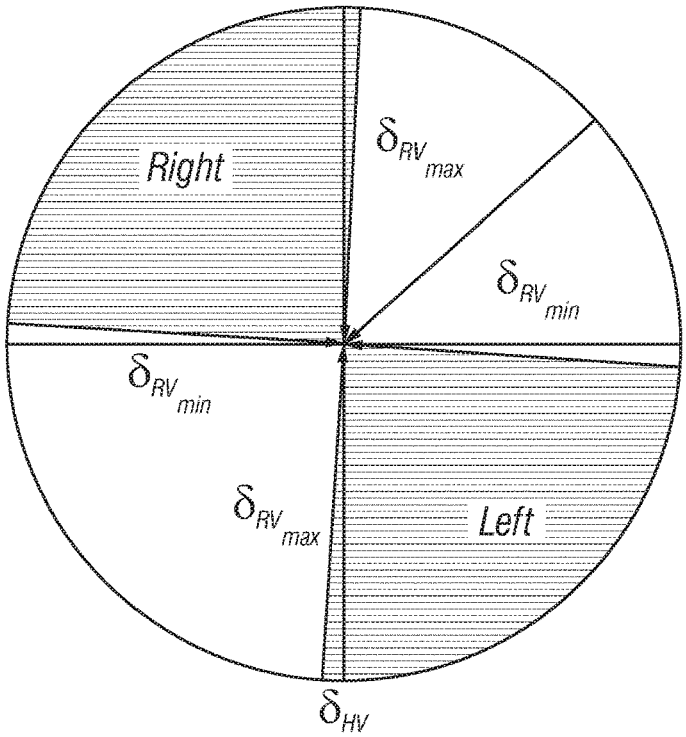
Figure 35:
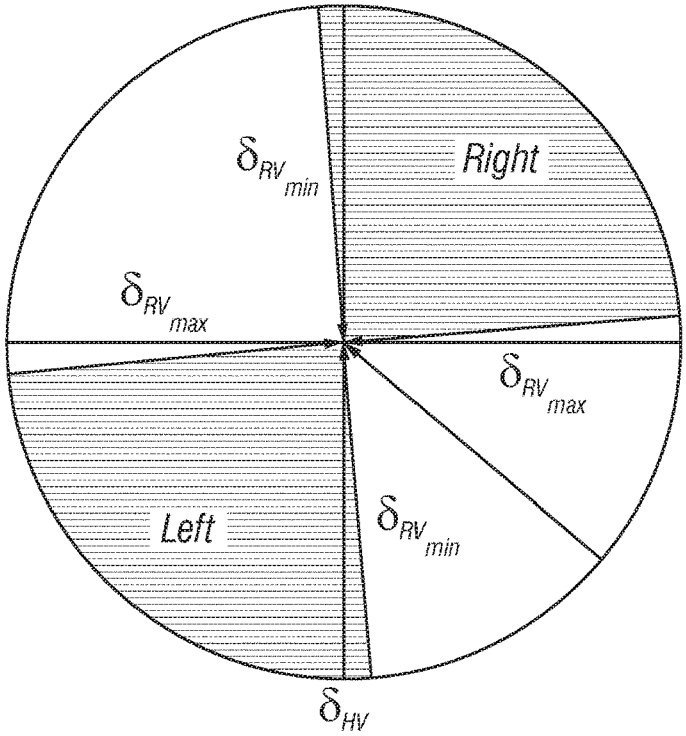
Figure 36:
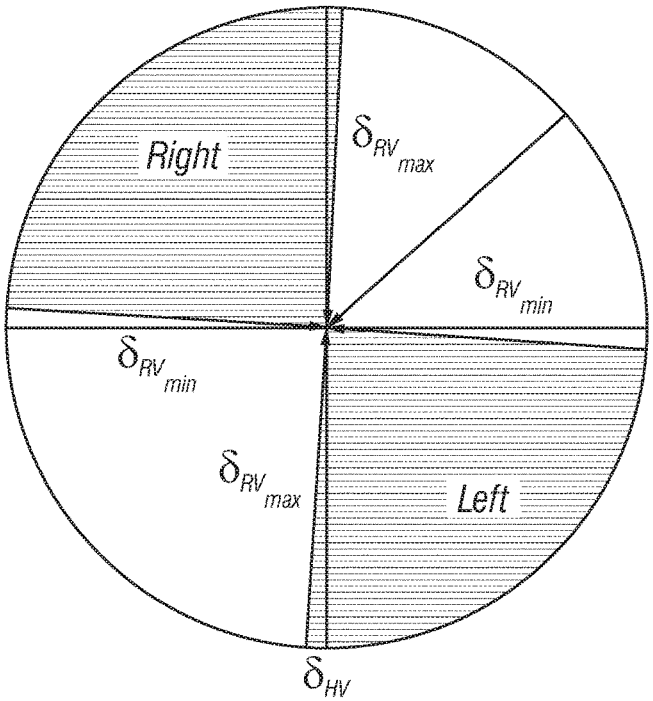
Figure 37:
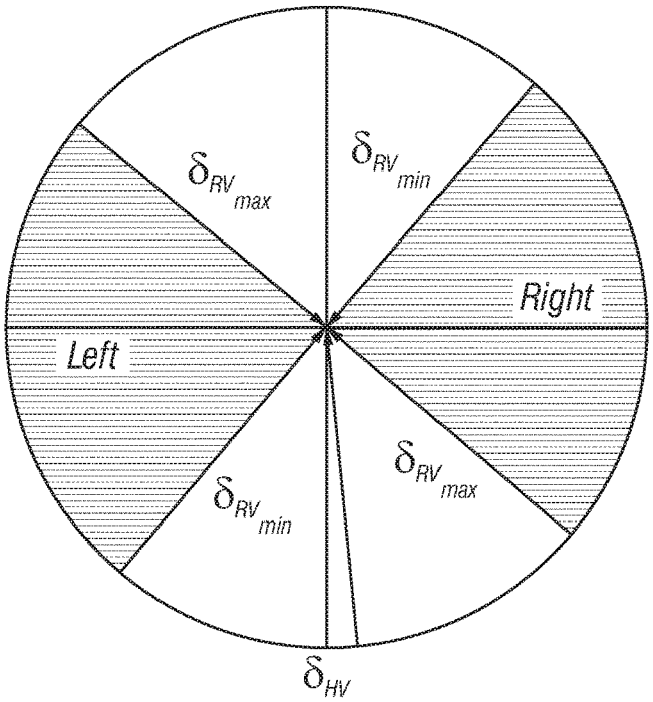

These regions are illustrated in FIGS. 32 and 33, where $0\le\delta_{HV}<3\pi/2-\varphi_L$, in FIGS. 34 and 35 where $3\pi/2-\varphi_L\le\delta_{HV}<3\pi/2+\varphi_L$, and in FIGS. 36 and 37 where $3\pi/2=\varphi_L\le\delta_{HV}<2\pi$.

Similarly, when the remote vehicle 14 is approaching from the right, there are three regions that need to be considered:

$$0 \le \delta_{HV} < \frac{\pi}{2}-\varphi_R \rightarrow \begin{cases}\delta_{HV} < \delta^{11}_{RV_{min}}\\ \delta_{HV} < \delta^{11}_{RV_{max}}\end{cases}$$

$$\frac{\pi}{2}-\varphi_R \le \delta_{HV} < \frac{\pi}{2}+\varphi_R \rightarrow \begin{cases}\delta_{HV} < \delta^{11}_{RV_{min}}\\ \delta_{HV} > \delta^{11}_{RV_{max}}\end{cases}$$

$$\frac{\pi}{2}+\varphi_R \le \delta_{HV} < 2\pi \rightarrow \begin{cases}\delta_{HV} > \delta^{11}_{RV_{min}}\\ \delta_{HV} > \delta^{11}_{RV_{max}}\end{cases}$$

Figure 38:
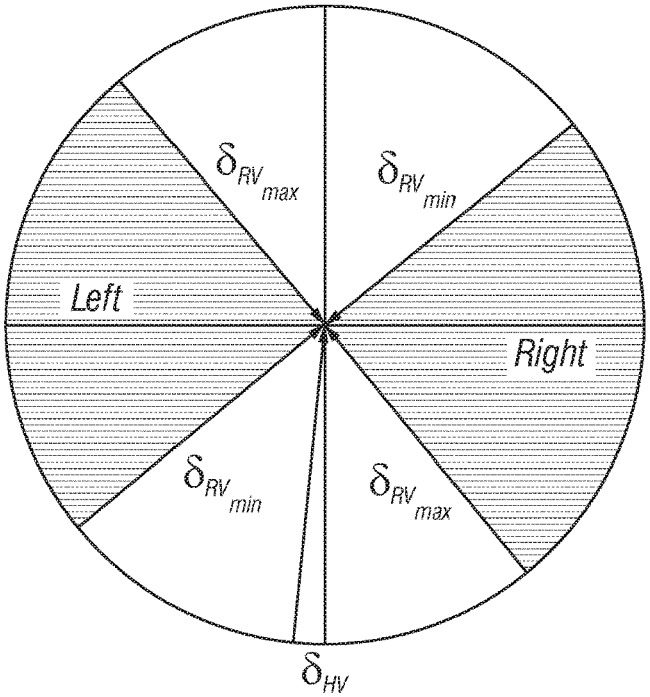
Figure 39:
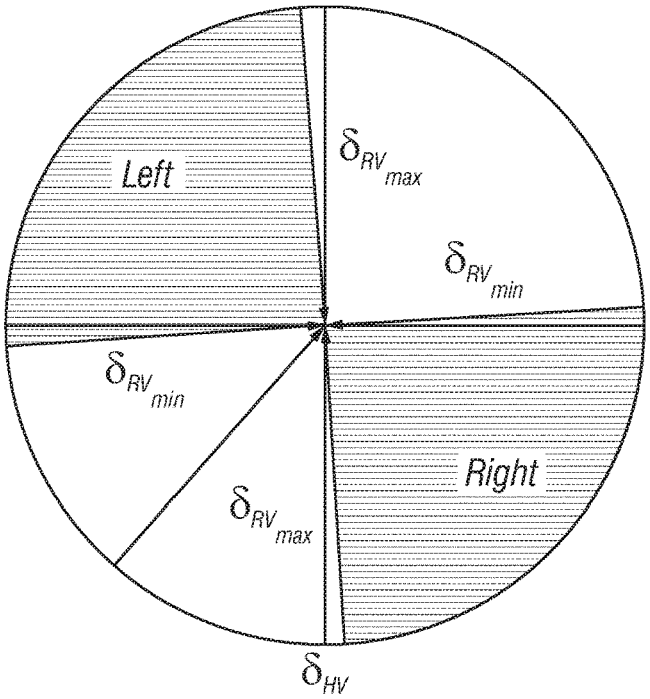
Figure 40:
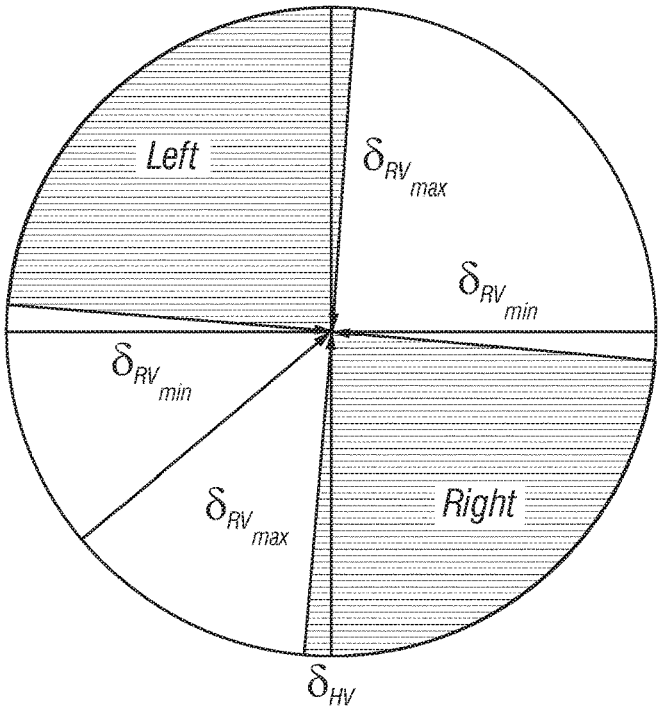
Figure 41:
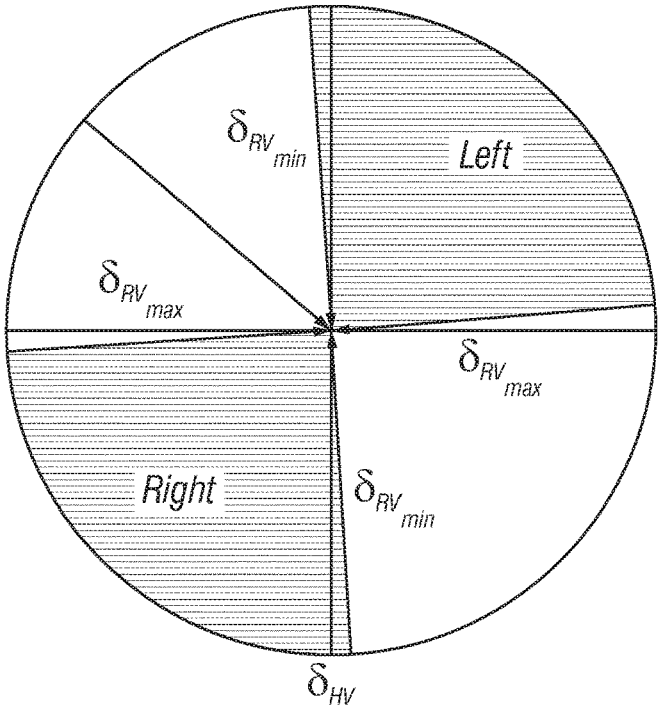
Figure 42:
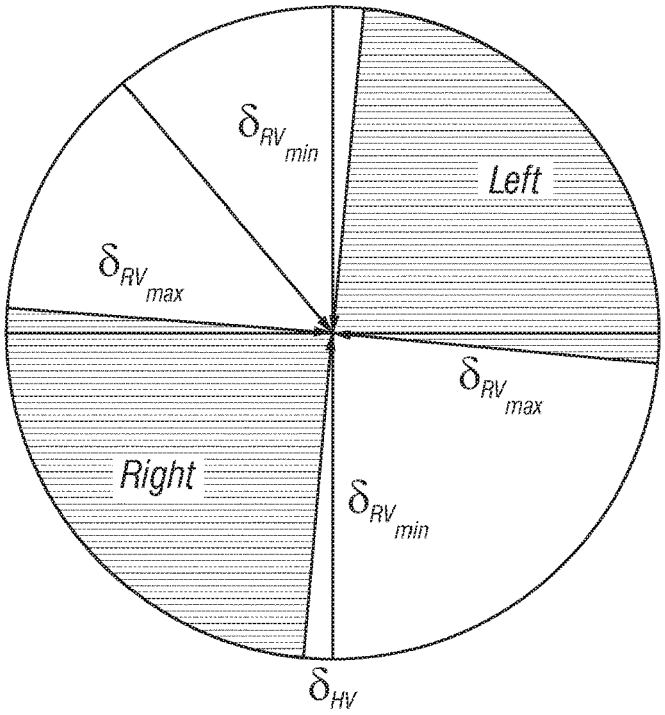
Figure 43:
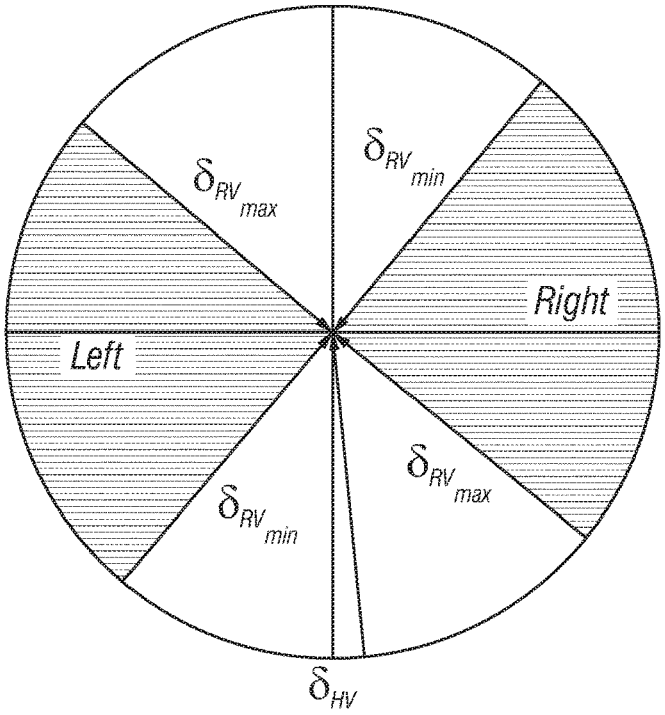

These regions are illustrated in FIGS. 38 and 39 as $0\le\delta_{HV}<\pi/2-\varphi_R$, in FIGS. 40 and 41 as $\pi/2-\varphi_R\le\delta_{HV}<\pi2+\varphi_R$, and in FIGS. 42 and 43 as $\pi/2+\varphi_R\le\delta_{HV}<2\pi$.

Consider the following expressions for $H_1$ and $H_2$.

$$H_1=\delta_{HV}-\delta_{RV_{min}}{}^{11}$$

$$H_2=\delta_{HV}-\delta_{RV_{max}}{}^{11}$$

For any value of $\delta_{HV}$, the values for $H_1$ and $H_2$ fall within three distinct categories:

1: $H_1$ is negative, $H_2$ is negative and $H_1>H_2$

2: $H_1$ is negative, $H_2$ is positive and $H_1<H_2$

3: $H_1$ is positive, $H_2$ is positive and $H_1>H_2$

From these three conditions, it can be shown that for any combination of $\delta_{HV}$ and $\delta_{RV}$, where $0\le\delta_{HV}<2\pi$ and $0\le\delta_{RV}<2\pi$ the following expressions can be used to identify if the host vehicle 10 and the remote vehicle 10 are crossing paths.

$$\Delta^{11}_1 = \frac{1}{8}\left[\frac{\delta_{RV}-\delta^{11}_{RV_{min}}+\sigma}{|\delta_{RV}-\delta^{11}_{RV_{min}}|+\sigma}+1\right]\times\left[\frac{\delta^{11}_{RV_{max}}-\delta_{RV}+\sigma}{|\delta^{11}_{RV_{max}}-\delta_{RV}|+\sigma}+1\right]\times\left[\frac{H_1-H_2-\sigma}{|H_1-H_2|+\sigma}+1\right]$$

If $H_1 > H_2$, $\delta^{11}_{RV_{min}} \le \delta_{RV} < \delta^{11}_{RV_{max}}$, $\Delta^{11}_1 = 1$ otherwise $\Delta^{11}_1 = 0$ $$\Delta^{11}_2 = \frac{1}{8}\left[\frac{\delta^{11}_{RV_{min}}-\delta_{RV}+\sigma}{|\delta^{11}_{RV_{min}}-\delta_{RV}|+\sigma}+1\right]\times\left[\frac{\delta^{11}_{RV_{max}}-\delta_{RV}+\sigma}{|\delta^{11}_{RV_{max}}-\delta_{RV}|+\sigma}+1\right]\times\left[1-\frac{H_1-H_2+\sigma}{|H_1-H_2|+\sigma}\right]$$

If $H_1 < H_2$, $\delta^{11}_{RV_{min}} \le \delta_{RV}$ and $\delta^{11}_{RV_{max}} \le \delta_{RV}$, $\Delta^{11}_2 = 1$ otherwise $\Delta^{11}_2 = 0$ $$\Delta^{11}_3 = \frac{1}{8}\left[\frac{\delta_{RV}-\delta^{11}_{RV_{min}}+\sigma}{|\delta_{RV}-\delta^{11}_{RV_{min}}|+\sigma}+1\right]\times\left[\frac{\delta_{RV}-\delta^{11}_{RV_{max}}+\sigma}{|\delta_{RV}-\delta^{11}_{RV_{max}}|+\sigma}+1\right]\times\left[1-\frac{H_1-H_2+\sigma}{|H_1-H_2|+\sigma}\right]$$

If $H_1 < H_2$, $\delta^{11}_{RV_{min}} \le \delta_{RV}$ and $\delta^{11}_{RV_{max}} \le \delta_{RV}$, $\Delta^{11}_3 = 1$ otherwise $\Delta^{11}_3 = 0$ If $H_1<H_2$, $\delta_{RV_{min}}{}^{11}\le\delta_{RV}$ and $\delta_{RV_{min}}{}^{11}\le\delta_{RV}$, $\Delta_3{}^{11}=1$ otherwise $\Delta_3{}^{11}=0$ Also, it is advantageous to define the difference of $H_1$ and $H_2$ as follows:

$$H_1-H_2\delta_{HV}-\delta_{RV_{min}}{}^{11}-(\delta H_V-\delta_{RV_{max}}{}^{11})$$

$$H_1-H_2\delta_{HV}-\delta_{RV_{min}}{}^{1}-\delta H_V-\delta_{RV_{max}}{}^{11}$$

$$H_1-H_2\delta_{HV}-\delta_{RV_{min}}{}^{1}-\delta H_V-\delta_{RV_{max}}{}^{11}$$

$$H_1-H_2=\delta_{RV_{max}}{}^{11}-\delta_{RV_{min}}{}^{11}$$

Then the expressions above can be expressed as:

$$\Delta_1^{11} = \frac{1}{8}\left[\frac{\delta_{RV} - \delta_{RV_{min}}^{11} + \sigma}{|\delta_{RV} - \delta_{RV_{min}}^{11}| + \sigma} + 1\right] \times \left[\frac{\delta_{RV_{max}}^{11} - \delta_{RV} + \sigma}{|\delta_{RV_{max}}^{11} - \delta_{RV}| + \sigma} + 1\right] \times \left[\frac{\delta_{RV_{max}}^{11} - \delta_{RV_{min}}^{11} - \sigma}{|\delta_{RV_{max}}^{11} - \delta_{RV_{min}}^{11}| + \sigma} + 1\right]$$

$$\Delta_2^{11} = \frac{1}{8}\left[\frac{\delta_{RV_{min}}^{11} - \delta_{RV} + \sigma}{|\delta_{RV_{min}}^{11} - \delta_{RV}| + \sigma} + 1\right] \times \left[\frac{\delta_{RV_{max}}^{11} - \delta_{RV} + \sigma}{|\delta_{RV_{max}}^{11} - \delta_{RV}| + \sigma} + 1\right] \times \left[1 - \frac{\delta_{RV_{max}}^{11} - \delta_{RV_{min}}^{11} + \sigma}{|\delta_{RV_{max}}^{11} - \delta_{RV_{min}}^{11}| + \sigma}\right]$$

$$\Delta_3^{11} = \frac{1}{8}\left[\frac{\delta_{RV} - \delta_{RV_{min}}^{11} + \sigma}{|\delta_{RV} - \delta_{RV_{min}}^{11}| + \sigma} + 1\right] \times \left[\frac{\delta_{RV} - \delta_{RV_{max}}^{11} + \sigma}{|\delta_{RV} - \delta_{RV_{max}}^{11}| + \sigma} + 1\right] \times \left[1 - \frac{\delta_{RV_{max}}^{11} - \delta_{RV_{min}}^{11} + \sigma}{|\delta_{RV_{max}}^{11} - \delta_{RV_{min}}^{11}| + \sigma}\right]$$

By summing these three expressions, it can be determined that the host vehicle 10 and the remote vehicle 14 are crossing paths if:

$$\sum_{i=1}^{3} \Delta_i^{11} = 1(RQ = 11)$$

thus:

$$r_3 = \sum_{i=1}^{3} \Delta_i^{11} \times 1$$

$$q_3 = \sum_{i=1}^{3} \Delta_i^{11} \times 1$$

and finally:

$$R = \sum_{i=1}^{3} r_i$$

$$Q = \sum_{i=1}^{3} q_i$$

If R=Q=0 the paths of the RV and HV are considered to be diverging away from each other.

Figure 44:
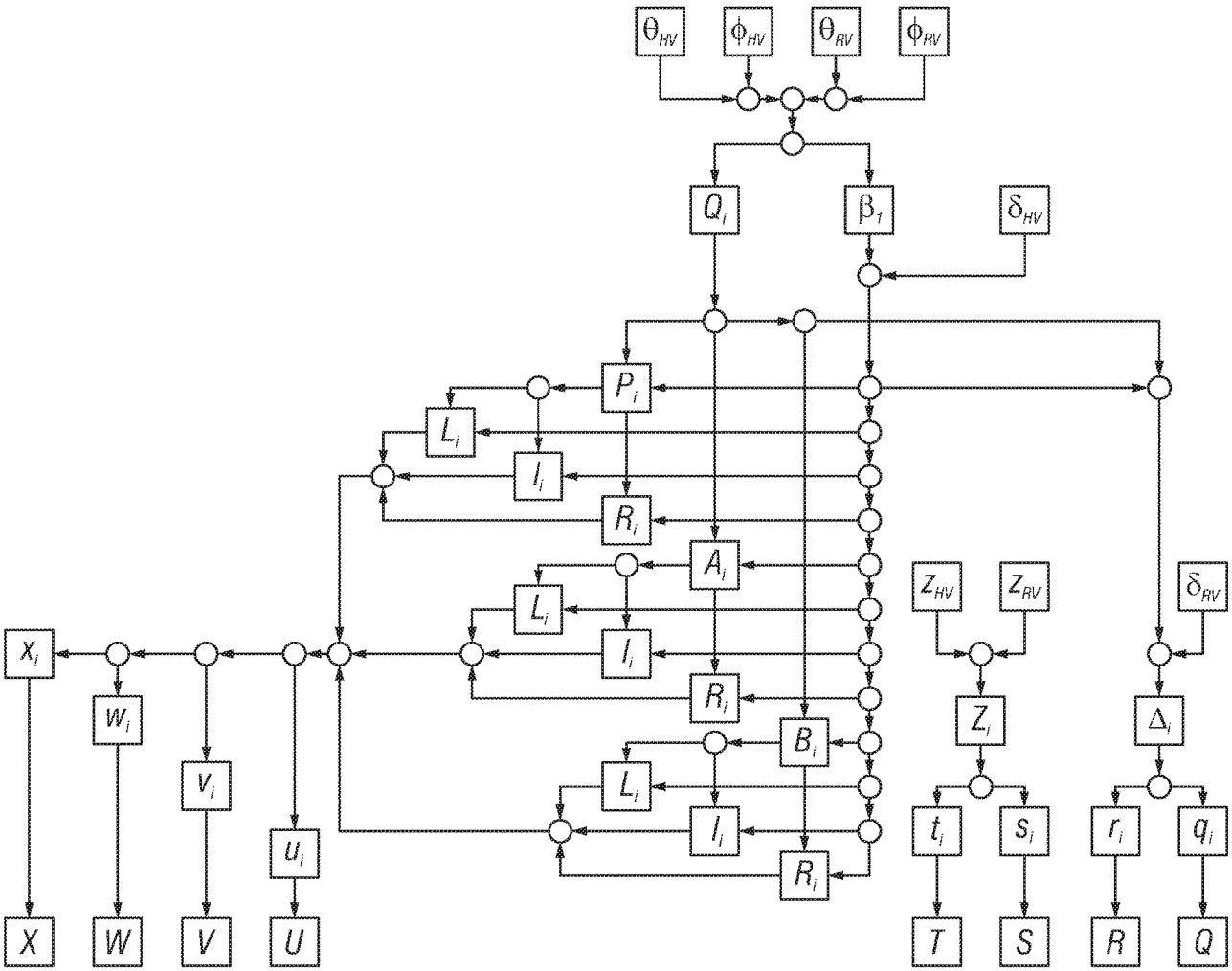
FIG. 44 is a diagrammatic representation of an example of the calculations performed by the traffic circle warning system during the operation of the flowchart of FIG. 11 to determine whether a warning should be issued.

FIG. 44 identifies the interdependencies of the source data and expressions that are used to determine the values of the digits X through Q according to the equations discussed above.

Turning back to the flowchart in FIG. 11, in Step 102, the traffic circle warning system 12 analyzes the relative position code XWVUTSRQ obtained by the calculations described above to determine in Step 104 whether a warning should be issued. A warning is issued in the following two circumstances.

Host vehicle 10 is approaching traffic circle 40 when the remote vehicle 14 is traveling in traffic circle:

Under these conditions, the software application running on the controller 22 looks for a relative position code where XWVUTSRQ equals 00010011. According to the calculations of this code as discussed above, the remote vehicle 14 is ahead (XW=00) of the host vehicle 10, the remote vehicle 14 is to the left (VU=01) of the host vehicle 10, the host vehicle 10 and the remote vehicle 14 are at the same elevation (TS=00), and the host vehicle 10 and the remote vehicle 14 are crossing paths (RQ=11). Thus, this condition represents the condition shown in, for example, FIG. 3. If this condition is true, a threat exists and in Step 106, the controller 22 controls the traffic circle warning system 12 to issue a warning according to, for example, the warning logic described with regard to FIG. 45 below. However, if this condition is not true, the controller 22 controls the traffic circle warning system 12 in Step 108 to refrain from issuing a warning.

Host vehicle 10 is traveling in traffic circle 40 as remote vehicle 14 approaches the traffic circle 40:

Under these conditions, the host vehicle 10 first ascertains whether the host vehicle 10 is traveling in the traffic circle 40. The computer 22 on the host vehicle 10 can determine this by using information from similarly equipped remote vehicles 10 that have passed through the traffic circle 40 to determine the existence of the traffic circle 40 and calculate the radius of the traffic circle 40. In the absence of such information, the software application operating on controller 22 can determine that the host vehicle 10 is traveling in a traffic circle 40 according to a similar method used to determine the existence of a traffic circle 40 using information received from remote vehicles 14 only in the absence of remote vehicles 14 in the traffic circle 14, and the host vehicle 10 can use its own GPS position and heading to determine that the host vehicle 10 is traveling in the traffic circle 40.

Once the software application running on the controller 22 in the host vehicle 10 determines that the host vehicle 10 is in the traffic circle 40, the controller 22 looks for a relative position code where XWVUTSRQ equals 00100011. According to the calculations of this code as discussed above, the remote vehicle 14 is ahead (XW=00) of the host vehicle 10, the remote vehicle 14 is to the right (VU=10) of the host vehicle 10, the host vehicle 10 and the remote vehicle 14 are at the same elevation (TS=00), and the host vehicle 10 and the remote vehicle 14 are crossing paths (RQ=11). Thus, this condition represents the condition shown in, for example, FIG. 7. If this condition is true, a threat exists and in Step 106, the controller 22 controls the traffic circle warning system 12 to issue a warning according to, for example, the warning logic described with regard to FIG. 45 below. However, if this condition is not true, the controller 22 controls the traffic circle warning system 12 in Step 108 to refrain from issuing a warning.

As can be appreciated from FIG. 2, such as warning can be a displayed warning on the screen display 32A, an audio warning via the audio speaker 32B, a tactile warning, or any other suitable type of warning as understood in the art. The traffic circle warning system 12 can also provide an audio indication of the approaching circle via the audio speaker 32B, a tactile indication, or any other suitable type of warning.

Figure 45:
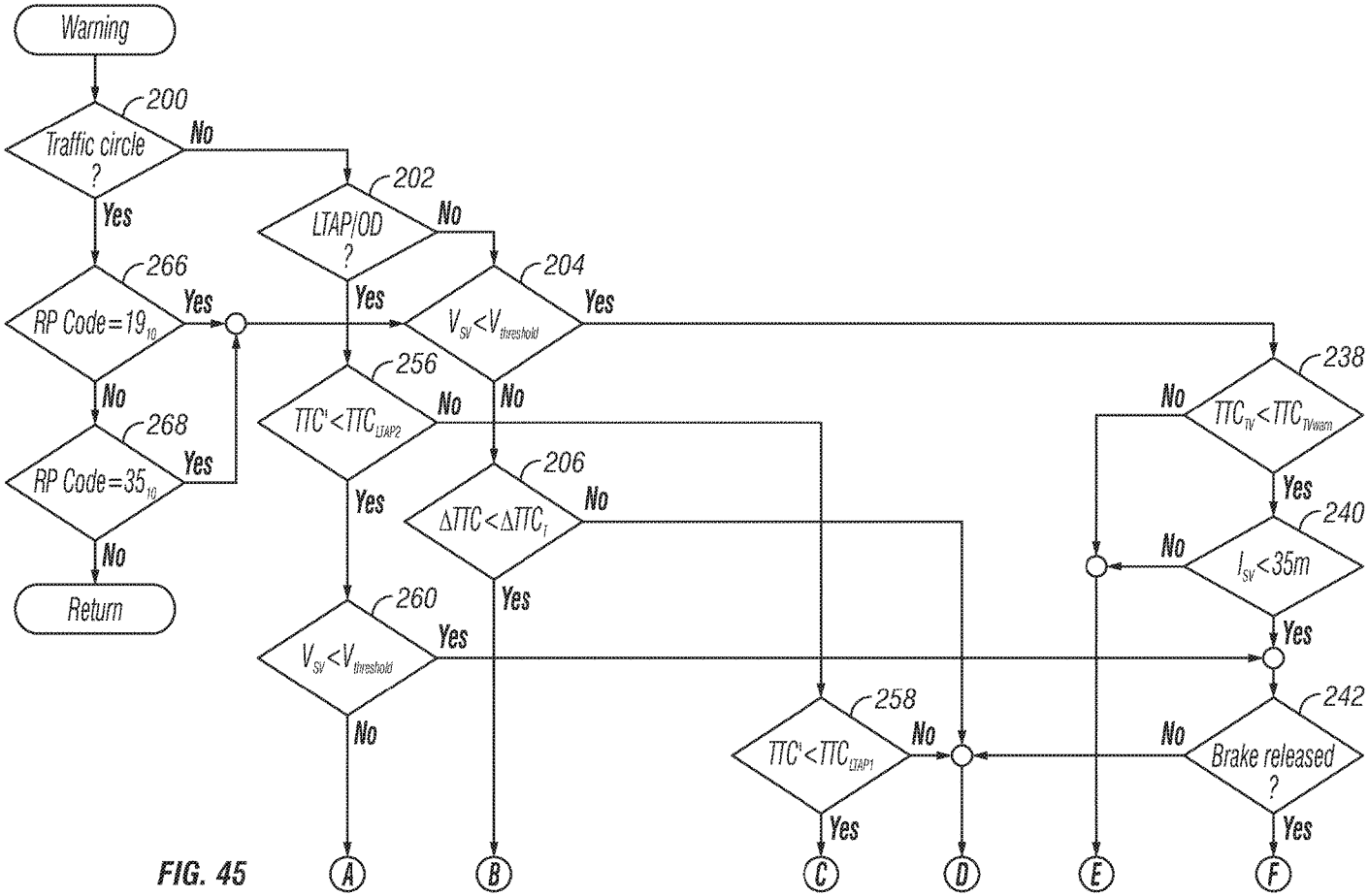
FIG. 45 is a flowchart illustrating an example of operations performed by the traffic circle warning system to issue a warning.
Figure 45:
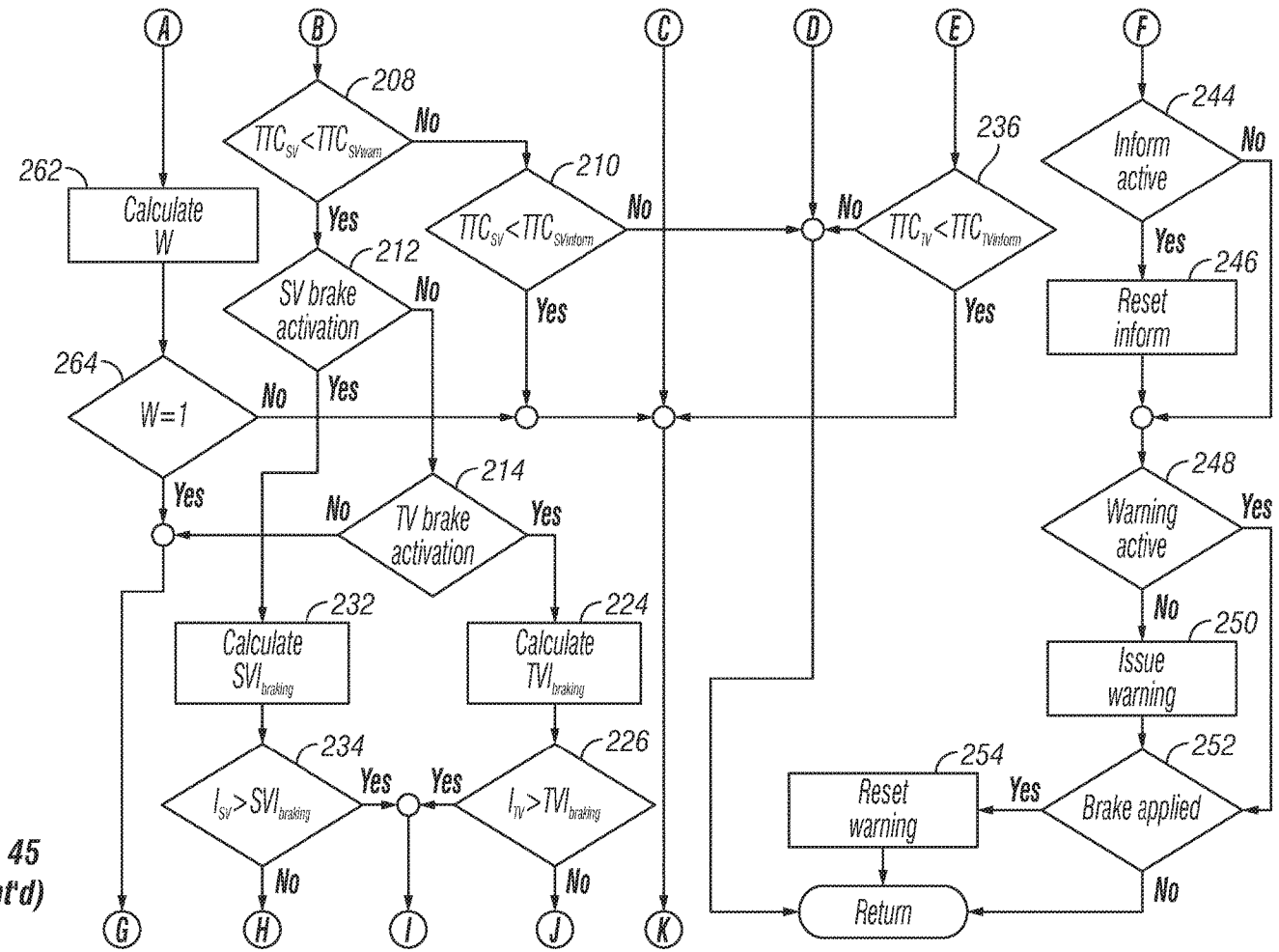
Figure 45:
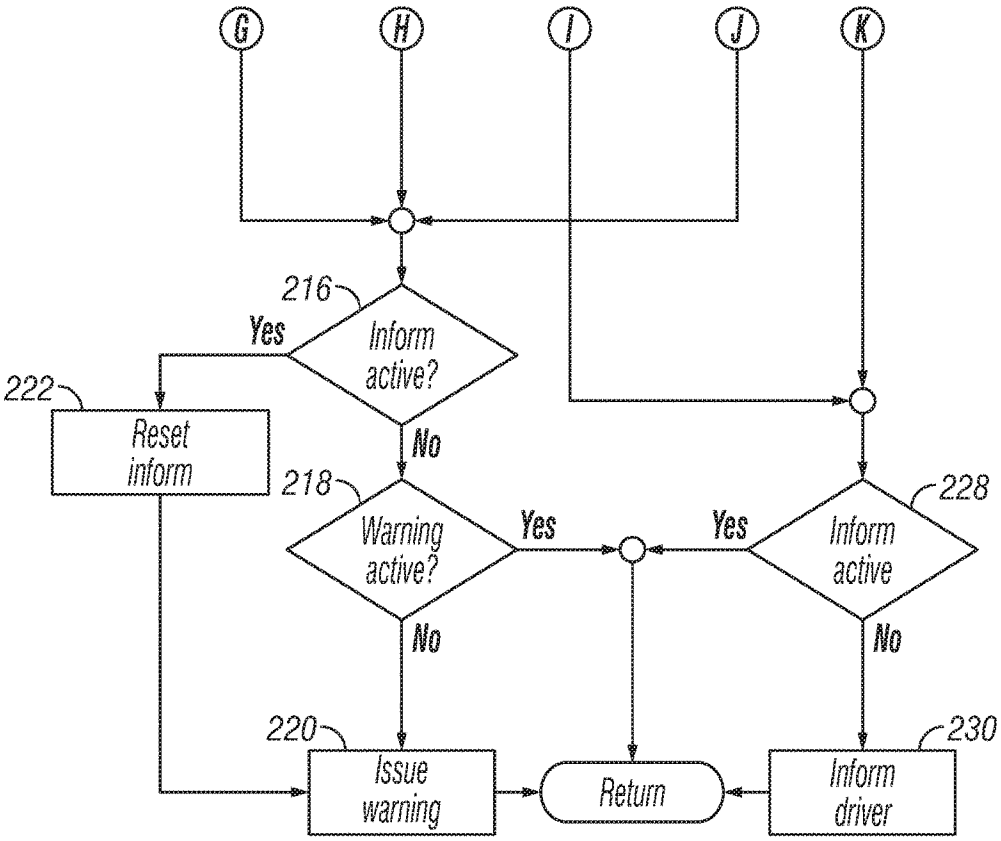

FIG. 45 is a flowchart illustrating an example of operations performed by, for example, the controller 22 to control the traffic circle warning system 12 to issue a warning. For purposes of this flowchart the host vehicle 10 is referred to as the subject vehicle SV, and the remote vehicle 14 is referred to at the threat vehicle TV. In Step 200, the controller 22 determines whether a traffic circle 40 exists in any suitable manner as discussed herein. For example, the controller can determine whether a traffic circle 40 exists according to the processes described in U.S. patent application Ser. No. 15/477,827, entitled "Traffic Circle Identification System and Method," referenced above. If the controller 22 determines that a traffic circle 40 does not exist, the processing continues to Step 202, where the controller 22 determines whether the remote vehicle 14 is making a left turn across path from the opposite direction (LTAP/OD). If the remote vehicle 14 is not making such a left turn, the processing continues to Step 204 when the controller 22 determines whether the velocity $V_{SV}$ of the host vehicle 10 (e.g., in meters per second) is below a suitable threshold $V_{threshold}$, which is speed threshold value, in meters per second (e.g., 2 meters per second), related to the host vehicle speed. Naturally, the threshold value can be $V_{threshold}$ any suitable speed as understood in the art.

If the controller 22 determines in Step 204 that the velocity $V_{SV}$ of the host vehicle 10 is not below the threshold $V_{threshold}$, the controller 22 determines in Step 206 whether the value of ΔTTC is less than the time threshold value of $\Delta TTC_T$. For purposes of the description herein, the value of ΔTTC represents the difference, in seconds, between $TTC_{SV}$ and $TTC_{TV}$. $TTC_{SV}$ represents the time, in seconds, the host vehicle 10 is from the calculated point of intersection of the paths of the host vehicle 10 and the remote (or target) vehicle 14. $TTC_{TV}$ represents the time, in seconds, that the remote vehicle 14 is from the calculated point of intersection of the paths of the host vehicle 10 and the remote (or target) vehicle 14. $\Delta TTC_T$ represents a time threshold value, in seconds (e.g., 2 seconds or any suitable value), related to the difference between $TTC_{SV}$ and $TTC_{TV}$.

If the controller 22 determines in Step 206 that value of ΔTTC is not less than the time threshold value of $\Delta TTC_T$, the processing returns to the beginning. However, if the value of ΔTTC is less than the time threshold value of $\Delta TTC_T$, the controller 22 determines in Step 208 whether the value of $TTC_{SV}$ is less than a value for $TTC_{SVwarn}$. $TTC_{SVwarn}$ represents a time threshold value, in seconds (e.g., 3 seconds or any suitable value), related to how many seconds that the host vehicle 10 is from the calculated point of intersection of the paths of the host vehicle 10 and the remote (or target) vehicle 14. Thus, $TTC_{SVwarn}$ defines when a warning should be issued to the driver of the host vehicle 10, and is applicable when both host vehicle 10 and the remote vehicle 14 are in motion. If the processor determines in Step 208 that the value of $TTC_{SV}$ is not less than a value for $TTC_{SVwarn}$, the processing determines in Step 210 whether value of $TTC_{SV}$ is less than a value for $TTC_{SVinform}$. $TTC_{SVinform}$ represents a time threshold value, in seconds (e.g., 6 seconds or any suitable value), related to how many seconds that the host vehicle 10 is from the calculated point of intersection of the paths of the host vehicle 10 and the remote (or target) vehicle 14. $TTC_{SVinform}$ defines when an informative advisory should be issued to the driver of the host vehicle 10, and is applicable when both host vehicle 10 and the remote vehicle 14 are in motion. If the controller 22 determines in Step 210 that value of $TTC_{SV}$ is not less than a value for $TTC_{SVinform}$, the processing returns to the beginning.

However, if the controller 22 determines in Step 208 that the value of $TTC_{SV}$ is less than a value for $TTC_{SVwarn}$, the controller 22 determines in Step 212 whether the host vehicle 10 has activated its brakes. If not, the controller 22 determines in Step 214 whether the remote vehicle 14 has activated its brakes based on, for example, the received remote vehicle information. If not, the controller 22 determines in Step 216 whether the informing by the controller 22 is active. If not, the controller 22 determines in Step 218 whether the warning is active. If not, the controller 22 controls the traffic circle warning system 12 to issue a warning as discussed above in Step 220. The processing then returns to the beginning. However, if the controller 22 determines in Step 218 that the warning is active, the processing returns to the beginning. Also, if the controller 22 determines in Step 216 that the informing is active, the controller 22 resets the informing in Step 222, issues the warning in Step 220, and returns to the beginning.

Looking back at Step 214, if the controller 22 determines that the remote vehicle 14 has activated its brakes, the controller calculates the remote vehicle braking in Step 224, namely, the value $TVl_{braking}$ which represents the stopping distance, in meters, for the remote vehicle 14. The controller 22 determines in Step 226 whether the value $TVl_{braking}$ is less than $l_{TV}$ which represents the distance, in meters, between the remote vehicle 14 and the point of intersection between the paths of the host vehicle 10 and the remote vehicle 14. If the value $TVl_{braking}$ is less than $l_{TV}$, the controller 22 determines in Step 228 whether the informing is active. If so, the processing returns to the beginning. However, if the informing is not active, the controller 22 controls the traffic circle warning system 10 to inform the driver of the remote vehicle 14 in Step 230, and the processing returns to the beginning. However, if the controller 22 determines in Step 226 that the value $TVl_{braking}$ is not less than $l_{TV}$, the controller 22 processing continues to Step 216 and proceeds as discussed above.

Looking back at Step 212, if the controller 22 determines that the host vehicle 10 has activated its brakes, the processing continues to Step 232 where the controller 22 calculates $SVl_{braking}$ which represents the stopping distance, in meters, for the host vehicle 10. The controller 22 then determines in Step 234 whether $SVl_{braking}$ is less than $l_{SV}$ which represents the distance, in meters, between the host vehicle 10 and the point of intersection between the paths of the host vehicle 10 and the remote vehicle 14. If $SVl_{braking}$ is not less than $l_{SV}$, the processing continues to Step 216 and proceeds as discussed above. However, if $SVl_{braking}$ is less than $l_{SV}$, the processing continues to Step 228 and proceeds as discussed above.

Looking back at Step 210, if the controller determines in Step 210 that $TTC_{SV}$ is less than a value for $TTC_{SVinform}$, the processing continues to Step 226 and proceeds as discussed above.

Looking back at Step 204, if the controller 22 determines that the velocity $V_{SV}$ of the host vehicle 10 is below the threshold $V_{threshold}$, the processing continues to Step 238 where the controller 22 determines whether the value of $TTC_{TV}$ is less than a value for $TTC_{TVwarn}$. $TTC_{TVwarn}$ represents a time threshold value, in seconds (e.g., 3 seconds or any suitable value), related to how many seconds the remote vehicle 14 (or target vehicle 10) is from the calculated point of intersection of the paths of the host vehicle 10 and the remote vehicle 14. $TTC_{TVwarn}$ defines when a warning should be issued to the driver of the host vehicle 10, and is applicable when host vehicle 10 is stationary and remote vehicle 14 is in motion.

If the controller 22 determines in Step 238 that the value of $TTC_{TV}$ is not less than the value for $TTC_{TVwarn}$, the controller 22 determines in Step 236 whether $TTC_{TV}$ of the remote vehicle 14 is less than a value for $TTC_{TVinform}$. $TTC_{TVinform}$ represents a time threshold value, in seconds (e.g., 6 seconds or any suitable value), related to how many seconds the host vehicle 10 is from the calculated point of intersection of the paths of the host vehicle 10 and the remote (or target) vehicle 14. $TTC_{TVinform}$ defines when an informative advisory should be issued to the driver of the host vehicle 10, and is applicable when host vehicle 10 is stationary and the remote vehicle 14 is in motion. If $TTC_{TV}$ is not less than a value for $TTC_{TVinform}$, the processing returns to the beginning. However, if $TTC_{T}v$ is less than a value for $TTC_{TVinform}$, the processing continues to Step 228 and proceeds as discussed above.

However, if the controller 22 determines in Step 238 that the value of $TTC_{TV}$ is less than the value for $TTC_{TVwarn}$, the processing continues to Step 240 where the controller 22 determines whether $l_{SV}$ is less than a suitable value, which in this example is 35 m. If not, the processing continues to Step 236 and proceeds as discussed above. However, if the value is less, the processing continues to Step 242 where the controller 22 determines if the brake of the remote vehicle 14 is released. If the brake is not released, the processing returns to the beginning.

However, if the brake is released, the processing continues to Step 244 where the controller 22 determines whether the informing in active. If the informing is active, the controller 22 resets the informing in Step 246 and continues to Step 248. If the informing is not active, the controller 22 continues to Step 248. In Step 248, the controller 22 determines whether the warning is active. If the warning is not active, the controller 22 controls the traffic circle warning system 12 to issue the warning in Step 250 as discussed above, and proceeds to Step 252. However, if the warning is active, the processing proceeds to Step 252. In Step 252, the controller 22 determines whether the brake of the host vehicle 10 is applied. If not, the processing returns to the beginning. However, if the brake is applied, the controller 22 resets the warning in Step 254 and the processing returns to the beginning.

Looking back at Step 202, if the controller determines that the remote vehicle 14 is making a left turn across path from the opposite direction, the controller determines in Step 256 whether a value of TTC' is less than a value of $TTC_{LTAP2}$. TTC' represents a time threshold, in seconds, between the host vehicle 10 and the remote vehicle 14 when the remote vehicle 14 is approaching the host vehicle 10 from the opposite direction. $TTC_{LTAP2}$ represents a time threshold, value in seconds (e.g., 3 sec or any suitable value), related to how many seconds that the remote (or target) vehicle 14 is from the plane perpendicular to the front of the host vehicle 10. $TTC_{LTAP2}$ defines when a warning should be issued to the driver of the host vehicle 10.

If the controller determines in Step 256 that TTC' is not less than a value of $TTC_{LTAP2}$, the processing continues to Step 258 where the controller 22 determines whether a value of TTC' is less than a value of $TTC_{LTAP1}$. $TTC_{LTAP1}$ a time threshold value, in seconds (e.g., 6 seconds or any suitable value), related to how many seconds that the remote (or target) vehicle 14 is from the plane perpendicular to the front of the host vehicle 10. $TTC_{LTAP1}$ defines when an informative advisory should be issued to the driver of the host vehicle 10. If the controller determines in Step 258 that TTC' is not less than a value of $TTC_{LTAP1}$, the processing returns to the beginning. However, if the value is less, the processing continues to Step 228 and proceeds as discussed above.

If the controller 22 determines in Step 256 that TTC' is less than the value of $TTC_{LTAP2}$, the processing continues to Step 260 where the controller 22 determines whether the velocity $V_{SV}$ of the host vehicle 10 is below the threshold $V_{threshold}$. If the value is less, the processing continues to Step 242 and proceeds as discussed above. However, if the value is not less, the controller 22 calculates a value for a warning variable W in Step 262, and determines if a value for a warning variable W is equal to 1 in Step 264. If the value is not equal to 1, the processing continues to Step 228 and proceeds as discussed above. However, if the value is equal to 1, the processing continues to Step 216 and proceeds as discussed above.

Looking back at Step 200, if the controller 22 determines that the traffic circle 40 exists, the controller 22 determines in Step 266 whether the RP code XWVUTSRQ is the decimal value 19, which corresponds to the binary value 00010011 as discussed above. If so, the processing continues to Step 204 and proceeds as discussed above. However, if the value of the RP code is not decimal value 19, the controller 22 determines in Step 268 whether the RP code XWVUTSRQ is the decimal value 35, which corresponds to the binary value 00100011 as discussed above. If so, the processing continues to Step 204 and proceeds as discussed above. However, if the value of the RP code is not decimal value 35, then the processing returns to the beginning, and the controller 22 controls the traffic circle warning system 12 to refrain from issuing a warning.

While only selected embodiments have been chosen to illustrate the present invention, it will be apparent to those skilled in the art from this disclosure that various changes and modifications can be made herein without departing from the scope of the invention as defined in the appended claims. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A traffic circle warning system comprising:

an electronic controller configured to determine whether a traffic circle exists along a current travel path of the host vehicle based on remote vehicle information representing a travel condition of at least one remote vehicle and, upon determining that the traffic circle exists, evaluate a travel condition of the host vehicle relative to the traffic circle and the travel condition of the remote vehicle to determine whether to control a warning system onboard the host vehicle to issue a warning, the travel condition of the at least one remote vehicle indicating an arcuate path of the at least one remote vehicle.

2. The traffic circle warning system according to claim 1, wherein the electronic controller is configured to control the warning system to issue the warning upon determining based on the travel condition of the host vehicle and the travel condition of the remote vehicle that a distance between the host vehicle the remote vehicle is decreasing.

3. The traffic circle warning system according to claim 1, wherein the electronic controller is configured to control the warning system to issue the warning upon determining based on the travel condition of the host vehicle and the travel condition of the remote vehicle that a travel path of the host vehicle and a travel path of the remote vehicle intersect each other within the traffic circle.

4. The traffic circle warning system according to claim 1, wherein the electronic controller is configured to control the warning system to issue the warning upon determining based on the travel condition of the host vehicle and the travel condition of the remote vehicle that the host vehicle is approaching a traffic entry location of the traffic circle and the remote vehicle is travelling within the traffic circle at a predetermined distance from the traffic entry location.

5. The traffic circle warning system according to claim 1, wherein the electronic controller is configured to control the warning system to issue the warning upon determining based on the travel condition of the host vehicle and the travel condition of the remote vehicle that the remote vehicle is approaching a traffic entry location of the traffic circle and the host vehicle is travelling within the traffic circle at a predetermined distance from the traffic entry location.

6. The traffic circle warning system according to claim 1, wherein the electronic controller is configured to identify sections of the traffic circle, and to control the warning system to issue the warning upon determining based on the travel condition of the host vehicle and the travel condition of the remote vehicle that the host vehicle is approaching one of the sections of the traffic circle and the remote vehicle is travelling within the one of the sections of the traffic circle.

7. The traffic circle warning system according to claim 1, wherein the electronic controller is configured to identify sections of the traffic circle, and to control the warning system to issue the warning upon determining based on the travel condition of the host vehicle and the travel condition of the remote vehicle that the remote vehicle is approaching one of the sections of the traffic circle and the host vehicle is travelling within the one of the sections of the traffic circle.

8. The traffic circle warning system according to claim 1, wherein the remote vehicle information includes information representing a heading of a remote vehicle.

9. The traffic circle warning system according to claim 8, wherein the remote vehicle information includes information representing a turning radius of the remote vehicle.

10. The traffic circle warning system according to claim 1, wherein the electronic controller is configured to evaluate a travel condition of the host vehicle relative to the traffic circle and the travel condition of the remote vehicle based on whether the remote vehicle is ahead of the host vehicle, whether the remote vehicle is to the left of the host vehicle, and whether the host vehicle and the remote vehicle are at the same elevation.

11. The traffic circle warning system according to claim 1, wherein the electronic controller is configured to establish coordinate areas about the host vehicle, and evaluates the travel condition of the remote vehicle within a respective one of the coordinate areas.

12. The traffic circle warning system according to claim 1, wherein the electronic controller is configured to determine a location of the traffic circle relative to the location of the host vehicle at a predetermined time when the electronic controller determines that the traffic circle exists.

13. The traffic circle warning system according to claim 12, wherein the electronic controller is configured to determine the location of the traffic circle relative to the location of the host vehicle and a location of the remote vehicle at the predetermined time when the electronic controller determines that the traffic circle exists.

14. A traffic circle warning system comprising:

an electronic controller configured to determine whether a traffic circle exists along a current travel path of the host vehicle based on remote vehicle information representing a travel condition of at least one remote vehicle and, upon determining that the traffic circle exists, evaluate a travel condition of the host vehicle relative to the traffic circle and the travel condition of the remote vehicle to determine whether to control a warning system onboard the host vehicle to issue a warning, the receiver being configured to receive the remote vehicle information via direct communication with the at least one remote vehicle.

15. A traffic circle warning method comprising:

determining, by an electronic controller, whether a traffic circle exists along a current travel path of the host vehicle based on remote vehicle information representing a travel condition of at least one remote vehicle, the travel condition of the at least one remote vehicle indicating an arcuate path of the at least one remote vehicle; and upon determining that the traffic circle exists, evaluating by the electronic controller a travel condition of the host vehicle relative to the traffic circle and the travel condition of the remote vehicle to determine whether to control a warning system onboard the host vehicle to issue a warning.

16. The method according to claim 15, further comprising controlling, by the electronic controller, the warning system to issue the warning upon determining based on the travel condition of the host vehicle and the travel condition of the remote vehicle that a distance between the host vehicle the remote vehicle is decreasing.

17. The method according to claim 15, further comprising controlling, by the electronic controller, the warning system to issue the warning upon determining based on the travel condition of the host vehicle and the travel condition of the remote vehicle that a travel path of the host vehicle and a travel path of the remote vehicle intersect each other within the traffic circle.

18. The method according to claim 15, further comprising controlling, by the electronic controller, the warning system to issue the warning upon determining based on the travel condition of the host vehicle and the travel condition of the remote vehicle that the host vehicle is approaching a traffic entry location of the traffic circle and the remote vehicle is travelling within the traffic circle at a predetermined distance from the traffic entry location.

19. The method according to claim 15, further comprising controlling, by the electronic controller, the warning system to issue the warning upon determining based on the travel condition of the host vehicle and the travel condition of the remote vehicle that the remote vehicle is approaching a traffic entry location of the traffic circle and the host vehicle is travelling within the traffic circle at a predetermined distance from the traffic entry location.

20. The method according to claim 15, wherein the remote vehicle information includes information representing at least one of a heading of a remote vehicle and a turning radius of the remote vehicle.

* * * * *